US008499973B2

(12) United States Patent
Bell et al.

(10) Patent No.: US 8,499,973 B2
(45) Date of Patent: Aug. 6, 2013

(54) TUBE DISPENSING DEVICE

(76) Inventors: William A. Bell, Kew (GB); Jonathan Francis Jones, Lymington (GB)

( * ) Notice: Subject to any disclaimer, the term of this patent is extended or adjusted under 35 U.S.C. 154(b) by 504 days.

(21) Appl. No.: 12/096,214

(22) PCT Filed: Dec. 8, 2006

(86) PCT No.: PCT/GB2006/004589

§ 371 (c)(1),
(2), (4) Date: Jun. 5, 2008

(87) PCT Pub. No.: WO2007/066123

PCT Pub. Date: Jun. 14, 2007

(65) Prior Publication Data

US 2008/0302832 A1 Dec. 11, 2008

(30) Foreign Application Priority Data

Dec. 10, 2005 (GB) ..... 0525219.2

(51) Int. Cl.
*B65D 35/00* (2006.01)

(52) U.S. Cl.
USPC ..... 222/107; 222/389; 222/145.4; 222/342; 222/386.5

(58) Field of Classification Search
USPC ..... 222/107–109, 145.2, 145.4, 206–215, 222/256, 260–261, 342, 386, 386.5, 389, 222/424, 491–497, 92, 95–96
See application file for complete search history.

(56) References Cited

U.S. PATENT DOCUMENTS

| | | | | |
|---|---|---|---|---|
| 2,361,647 | A | 10/1944 | Nyden | 221/60 |
| 2,777,612 | A | 1/1957 | Bensen | 222/209 |
| 3,184,120 | A | 5/1965 | Undi | 222/209 |
| 3,201,003 | A * | 8/1965 | Wark et al. | 222/206 |
| 3,493,147 | A | 2/1970 | Bailin | 222/158 |
| 3,521,795 | A * | 7/1970 | Bergishagen et al. | 222/386 |
| RE27,057 | E * | 2/1971 | Bailin | 222/107 |
| 4,645,098 | A | 2/1987 | Hoffmann | 222/386 |
| 2002/0148854 | A1 * | 10/2002 | Egerhazy | 222/107 |
| 2007/0062977 | A1 | 3/2007 | Ferrarin | |

FOREIGN PATENT DOCUMENTS

| | | |
|---|---|---|
| DE | 19 59 349 | 6/1971 |
| FR | 2 244 678 | 5/1975 |
| GB | 2 257 108 A | 6/1993 |
| WO | WO 2004/039685 A1 | 5/2004 |

OTHER PUBLICATIONS

International Search Report from PCT/GB2006/004589.

* cited by examiner

*Primary Examiner* — Kevin P Shaver
*Assistant Examiner* — Andrew P Bainbridge
(74) *Attorney, Agent, or Firm* — Woodard Emhardt Moriarty McNett & Henry LLP

(57) ABSTRACT

This invention provides a deformable dispensing tube (1) with an internal device (8). The device is contained within the deformable dispensing tube but is a separate physical entity to the deformable dispensing tube and has the ability to move within the deformable dispensing tube. The object of the device is to aid the dispensing of part or all of the contents (16) of the deformable dispensing tube by the user.

13 Claims, 51 Drawing Sheets

TUBE DISPENSING DEVICE

CROSS REFERENCES TO RELATED APPLICATIONS

This application is a National Stage filing of International Application PCT/GB2006/004589, filed Dec. 8, 2006, claiming priority to United Kingdom Application No. 0525219.2, filed Dec. 10, 2005, entitled "TUBE DISPENSING DEVICE". The subject application claims priority to PCT/GB2006/004589 and to United Kingdom Application No. 0525219.2 and both references are expressly incorporated by reference herein, in their entirety.

This invention relates to dispensing of paste or gel like substances or any viscous or liquid substances, hereinafter referred to as the "contents" from flexible or deformable containers or tubes, hereinafter referred to as "deformable dispensing tubes".

Many paste like substances, such as toothpaste or creams or hair gels or food substances or glue, are sold in deformable dispensing tubes such that the user can deform the tube by manually squeezing or creating an external pressure on the tube to dispense the contents. The external pressure or force created by the user to dispense the contents is hereinafter referred to as the "external pressure".

The shape of the tube is generally circular in cross section at the end where an opening is formed for dispensing the contents. This formed open end of the deformable dispensing tube is hereinafter referred to as the "formed opening". The formed opening has the ability to be opened and resealed by the user.

The opposite end of the deformable dispensing tube to that of the formed opening is flattened and permanently sealed on manufacture or production. This flattened and sealed end of the deformable dispensing tube is hereinafter referred to as the "sealed end".

The area between the sealed end and the formed opening is the deformable part of the deformable dispensing tube and is hereinafter referred to as the "deformable body".

During production the tube is filled with the contents.

The shape created by the above process has the advantage of allowing the user to dispense varying quantities of the contents by applying an external pressure to the tube such that part or all of the contents are moved towards the end with the formed opening, thereby dispensing the desired quantity of the contents through the formed opening.

The disadvantages of such tubes are that a small amount of the contents may continue to flow after the user has removed the external pressure, thereby leaving some of the contents around the formed opening compromising both the re-sealing of the formed opening and general hygiene.

Also when the deformable dispensing tube is no longer completely full the contents can move away from the formed opening. This can make further dispensing awkward, requiring the user to manipulate the contents towards the formed opening, either by squeezing their fingers along the outside of the tube or by rolling the tube up from the sealed end towards the formed opening. Also it can be difficult to entirely dispense the last of the contents from such tubes.

Alternatively the contents may be sold in non-deformable dispensing tubes containing an internal piston to move the contents towards the opening for dispensing. This type of packaging has the disadvantage of being more complex and more expensive to produce than a deformable dispensing tube.

An object of this invention is to enable easier dispensing of part or all of the contents of a flexible or deformable dispensing tube even when part or near empty.

Accordingly, this invention provides a deformable dispensing tube with an internal device hereinafter referred to as "the device". The device is contained within the deformable dispensing tube but is a separate physical entity to the deformable dispensing tube and has the ability to move within the deformable dispensing tube. The object of the device is to aid the dispensing of part or all of the contents of the deformable dispensing tube by the user.

As already described the deformable dispensing tube will have a formed opening, a sealed end and a deformable body.

Additionally, on production and before first use the device is inserted into the deformable dispensing tube such that the device is situated at the sealed end of the deformable dispensing tube.

The contents are located in the area within the deformable dispensing tube between the device and the formed opening. This area in which the contents are located is hereinafter referred to as the "internal volume". A small quantity of the contents may also be contained within the formed opening itself.

The part of the device that sits nearest to the sealed end of the deformable dispensing tube will hereinafter be referred to as the "device tail". The part of the device at the opposing end to the device tail is the section or face of the device that is presented to the contents within the deformable dispensing tube and this section or face of the device is hereinafter referred to as the "device top".

It is a required characteristic of the device that it forms an effective and consistent seal between itself and the inside surface or surfaces of the deformable dispensing tube when the deformable dispensing tube is full or empty or at any stage between. This seal is hereinafter referred to as the "consistent seal" and will be situated at or near the device top.

The consistent seal prevents any transgression by the contents so that the contents remain between the device top and the formed opening even under pressure.

The consistent seal can be achieved through the shape of the device or material nature of the device or additional components fixed to the device or a combination of all three. Consequently the device may be rigid or flexible or a combination or mixture of both.

When the device is inside the deformable dispensing tube the three dimensional shape of the device is such that it provides the stability needed to maintain the consistent seal.

The cross section of the device where it creates the consistent seal with the deformable dispensing tube needs to match in shape and size or be able to match in shape or size the internal cross section of the deformable body at the end of the formed opening so that device not only maintains the consistent seal throughout the movement of the device within the deformable dispensing tube but also maximises the capacity of the internal volume.

The shape and material nature of the device is such that at the point of sealing the deformable dispensing tube is forced to adapt to the shape of the device thereby providing the consistent seal throughout the movement of the device within the deformable dispensing tube.

Alternatively the shape and material nature of the device is such that the shape of the device is able to deform in keeping with any deformation caused to the deformable dispensing tube and thereby maintaining the consistent seal.

Alternatively the shape and material nature of both the device and the deformable dispensing tube when combined is such that the consistent seal is both created and maintained under any deformation or pressure.

The cross section of the device changes or tapers along it's length from the device top to the device tail such that when the external pressure is applied by the user to the deformable dispensing tube at or near the location of the device there is a resultant force on the device in the direction of the formed opening and away from the sealed end of the deformable dispensing tube. This resultant force towards the formed opening will hereinafter referred to as the "resultant force".

The device will be shaped or will have features such that it will only physically move in the direction towards the formed opening and not in the direction towards the sealed end and this shaping or feature will hereinafter be referred to as the "non-return feature".

The device may be able to flex or deform in the direction of the formed opening and then return to its original un-flexed or un-deformed state.

Preferably the device should be made of a material or materials that not only maintain the consistent seal within the deformable dispensing tube but also enable easy movement of the device within the deformable dispensing tube in the direction of the formed opening.

Preferably the three dimensional form of the device top should match or have the ability to match the interior three dimensional form of the formed opening in a male to female manner such that the device top can enter the formed opening and thereby expel as much of the contents as is feasibly possible.

Preferably the cross section of the device changes or tapers along its length from the device top towards the device tail in such a manner that allows or encourages the deformable dispensing tube to collapse or be deformed behind the device such that the then empty or near empty part of the deformable dispensing tube can deform to a flat or near flat state.

Preferably the cross section of the device tail matches in shape and size the internal cross section at or near the sealed end of the deformable dispensing tube in order to minimise the length of the device and or the overall length of the deformable dispensing tube.

The cross section of the deformable dispensing tube is ideally round at the end where the formed opening is created, although this cross section may also be oval, elliptical, or any polygon shape with or without radius-ed corners or edges.

As already stated, when an external pressure is applied to the deformable dispensing tube by the user at or near the location of the device, the resultant force is created on the device acting towards the formed opening. Therefore the user indirectly creates and controls the resultant force.

When the resultant force is produced on the device it is transmitted through the device and onto the contents of the deformable dispensing tube thereby creating a state of internal pressure within the contents, this internal pressure is hereinafter referred to as the "internal pressure".

The internal pressure of the contents will in turn create an opposing force on the device hereinafter referred to as the "opposing force". The opposing force will be in the direction of the sealed end and away from the formed opening.

The internal pressure can also be created by the user applying an external pressure to the deformable tube in the area between the device and the formed opening. In such circumstances the opposing force will try to move the device in the direction of the sealed end however the non-return feature of the device will prevent any such movement.

The internal pressure may also be created directly or indirectly by the user or by any remote means or by gravity.

The internal pressure will also bear against the internal surfaces of the deformable dispensing tube, thereby forcing the internal volume of the deformable dispensing tube to its greatest capacity.

As the device is a separate physical entity to the deformable dispensing tube the resultant force will act to move the device in the direction of the formed opening.

The movement of the device in the direction of the formed opening is resisted by the opposing force of the contents together with any frictional forces that will occur between the device and the internal surface of the deformable tube. These frictional forces will hereinafter be referred to as the "internal frictional force".

The combination of the resultant force, the opposing force and the internal frictional force acting on the device will produce a tendency for the device to flex or deform and as such additional forces will be created or stored in the material or materials of the device, these additional forces will hereinafter be referred to as the "stored force".

If the deformable dispensing tube is not sealed at the formed opening and the internal pressure is great enough some of the contents will be forced to flow through the formed opening. This flowing out of some of the contents will result in a reduction in the volume of the contents contained with the deformable dispensing tube. At this point the internal volume will be greater than the volume required by the remainder of the contents and as such a corresponding reduction in the internal pressure will result.

As the contents begin to flow through the formed opening the resultant reduction in internal pressure will result in a corresponding reduction in the opposing force. The reduction in the opposing force will create a change or increase in the stored force as the balance of the resultant force is no longer taken up by the opposing force but is directed through the device and against the internal frictional force. This change or increase in the stored force will result in further flexure or deformation of the device.

The amount of flexure or deformation that the device is allowed to develop will be dictated by the design and material specification of the device. At all times the consistent seal will be maintained.

The device may be so designed that it is effectively rigid and therefore no significant flexure or deformation of the device takes place under the forces developed as a consequence of the user applying an external pressure. In this instance if the resultant force is greater than both the internal frictional force and the opposing force the device will begin to move in the direction of the resultant force, that is, in the direction of the formed opening. In moving towards the formed opening of the deformable dispensing tube the internal device will reduce the internal volume in line with the reduced volume of the remainder of contents contained within the deformable dispensing tube. In balancing the internal volume with the volume of the remainder of the contents in this way the internal pressure can be maintained at a level where the contents continue to flow through the formed opening.

Alternatively, the device may be so designed that a significant flexure or deformation of the device takes place in the direction of the resultant force and towards the formed opening. The flexure or deformation of the device produced by the resultant force will hereinafter be referred to as the "deformed volume". The creation and increasing size of the deformed volume will balance the reduced volume required by the remainder of the contents within the internal volume and so the internal pressure can be maintained at a level where the contents continue to flow through the formed opening. The deformed volume will increase in size until the device reaches its maximum designed state for the deformed volume. At this point the deformed volume cannot balance any further reduction in volume of the remainder of the contents within the internal volume and in this instance if the resultant force remains greater than both the internal frictional force and the opposing force the device as a whole will begin to move in the direction of the resultant force, that is in the direction of the formed opening. In moving towards the formed opening of the deformable dispensing tube the internal device will reduce the internal volume in line with the reduced volume of the remainder of contents contained within the deformable dispensing tube. In balancing the internal volume with the volume of the remainder of the contents in this way the internal pressure can be maintained at a level where the contents continue to flow through the formed opening.

If the user continues to create the resultant force and the above-mentioned balance of forces, the device will continue to move towards the formed opening thereby dispensing more or all of the contents.

When the resultant force is reduced by the user to a level were it no longer overcomes the combination of the internal frictional force and the opposing force the device will cease to move and the consequent flow of the contents through the formed opening will also cease.

At this point if the device is one so designed as to be effectively rigid and have little or no deformed volume no further significant movement will take place.

Alternatively, if at this point the device is one so designed as to have a deformed volume the flexure or deformation of the deformed volume will remain in place until the user reduces still further or even removes entirely the resultant force. When the resultant force is reduced or removed in such a manner the stored force will act to return the device to its original un-deformed state and as such the deformed volume will retract and no longer make up the balance in the internal volume that it originally did. The internal volume however cannot sustain a vacuum and therefore the retraction of the deformed volume by the stored force will cause the device as a whole and the contents to be drawn together. When the device and contents are drawn together in such a way the device can be so designed as to act in one of two ways or a combination of both. Either the device as a whole can move in the direction of the formed opening to make-up the space occupied by the deformed volume or alternatively the contents can be drawn or sucked back into the deformable dispensable tube to fill the space occupied by the deformed volume. This movement of the contents back into the deformable dispensing tube is hereinafter referred to as "content retraction". Ideally the design of the device would allow for a small amount of content retraction combined with the device as a whole moving in the direction of the formed opening.

As described, the three dimensional form and physical or material nature of the device and its behavioural properties when within the deformable dispensing tube provides the ability of the device to maintain a consistent seal within a deformable dispensing tube and allows the device to act as an internal piston that can effectively dispense the contents from a deformable dispensing tube.

As described, the three dimensional form and physical or material nature of the device and its behavioural properties when within the deformable dispensing tube allows an external pressure or force applied by the user to the deformable dispensing tube to be translated into forces or pressure or movement within the deformable dispensing tube or within the device itself such that the contents can be effectively dispensed. As the resultant force is indirectly created and controlled by the user, the user is able to dispense varying quantities of the contents and at varying rates and at will.

As described, the combination of the device being able to move internally within the deformable dispensing tube combined with the non-return feature or features of the device preventing the device from moving back in the direction of the sealed end provides the advantage of the contents always being presented correctly to the formed opening for easy and immediate dispensing even when the deformable dispensing tube is part or near empty. Therefore awkwardness of further dispensing requiring the user to manipulate the contents towards the formed opening is removed.

As described, when within the deformable dispensing tube the non-return feature or features of the device prevent the device from moving back in the direction of the sealed end and so provides the advantage of the contents still being dispensed even when the user applies the external force in the area between the device top and the formed opening.

As described, the three dimensional form and physical or material nature of the device top and its behavioural properties allow the device top to match or have the ability to match the interior three dimensional form of the formed opening and thereby ensure that as much of the contents are expelled from the deformable dispensing tube as is feasibly possible.

As described, the three dimensional form and physical or material nature of the device and its behavioural properties when within the deformable dispensing tube create the content retraction effect that provides the advantage of alleviating or removing the aspect of excess contents being left around the formed opening after use. This is particularly advantageous for resealing the formed opening and the overall hygiene of the product.

One specific embodiment of the invention, titled Embodiment A, will now be described by way of example only with reference to the accompanying drawings, FIGS. 1 through to 19 only.

Of which:—

FIG. 1 shows a perspective view of the deformable dispensing tube 1.

FIG. 2 shows a perspective view of the deformable dispensing tube 1 with the deformable dispensing tube 1 illustrated in 3 sections: —the formed opening 4, the sealed end 3, and the deformable body 2.

Figure 7:
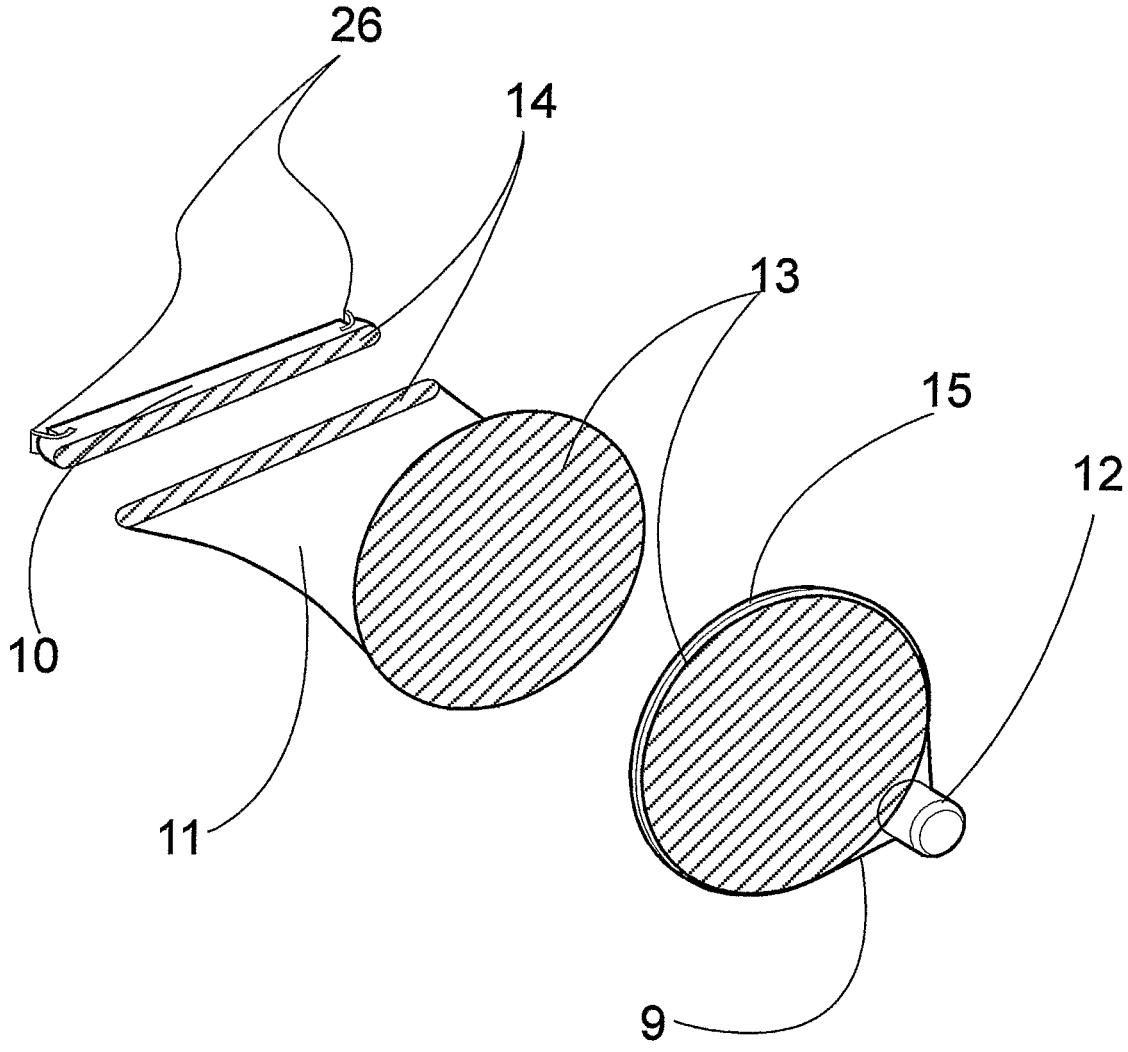

FIG. 7 shows a perspective view of the device 8 with the device 8 illustrated in 3 sections; the device tail 10, the device body 11 and the device top 9.

Figure 8:
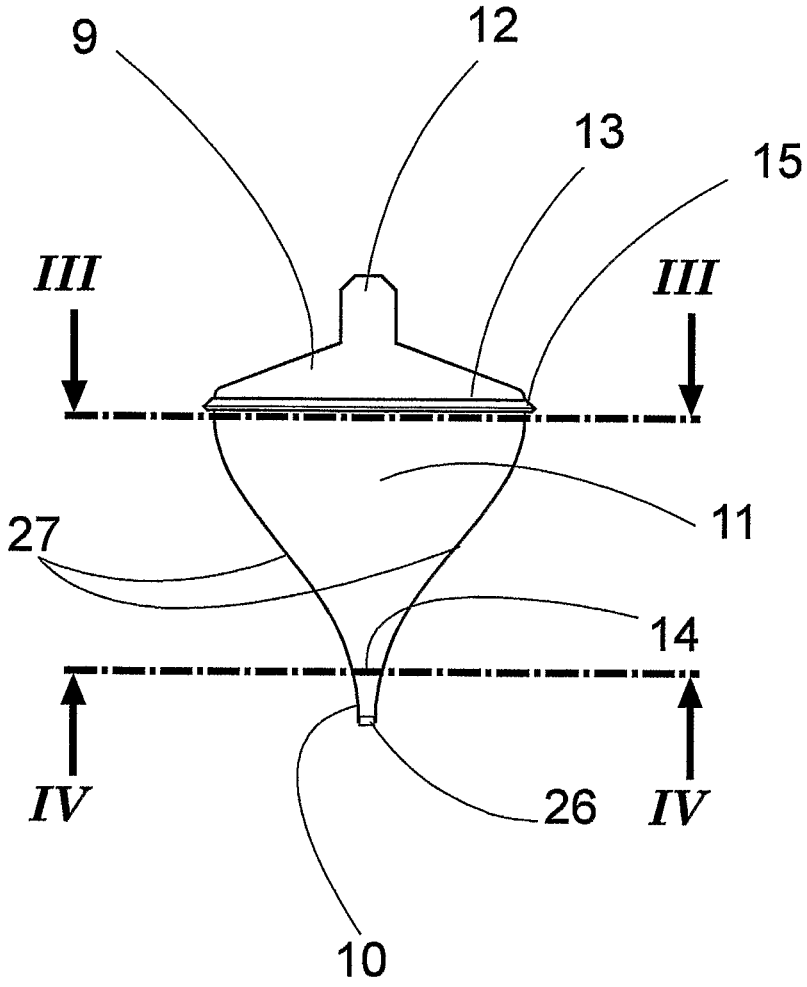

FIG. 8 shows a side view of the device 8.

Figure 9:
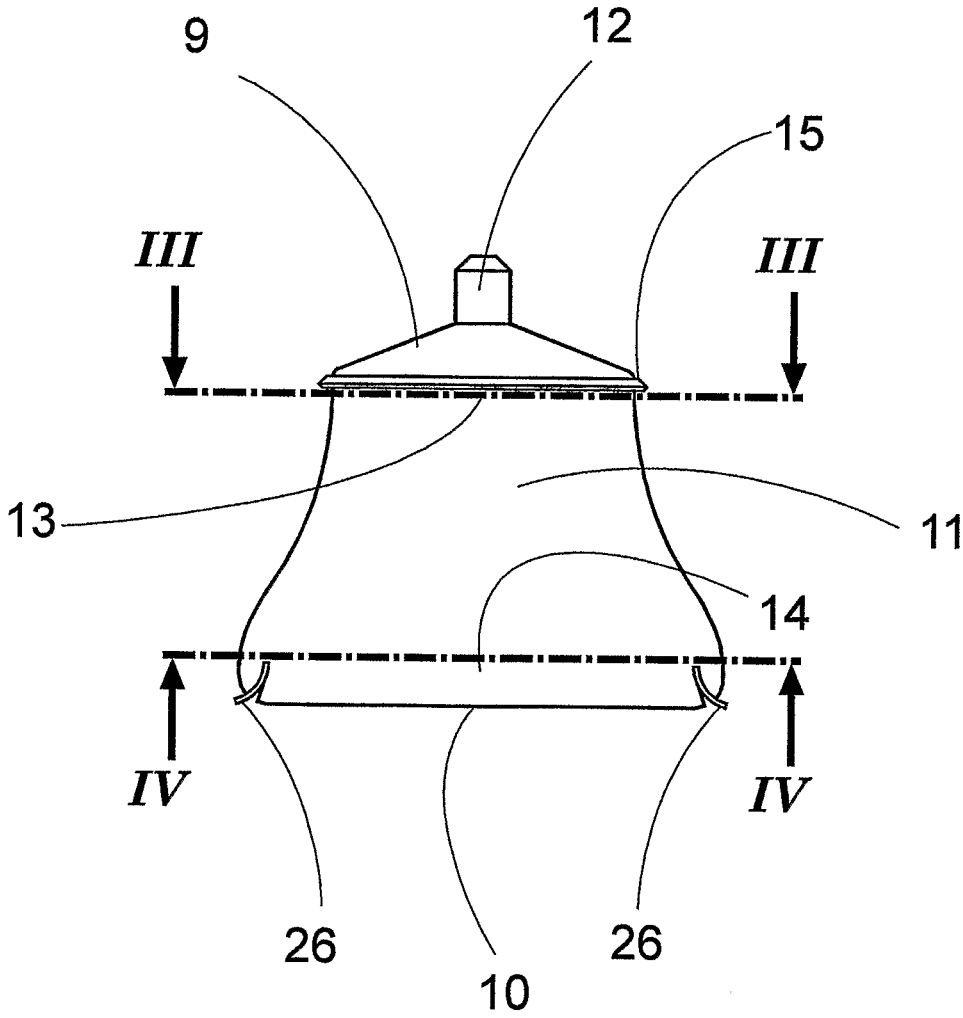

FIG. 9 shows a front view of the device 8.

Figure 10:
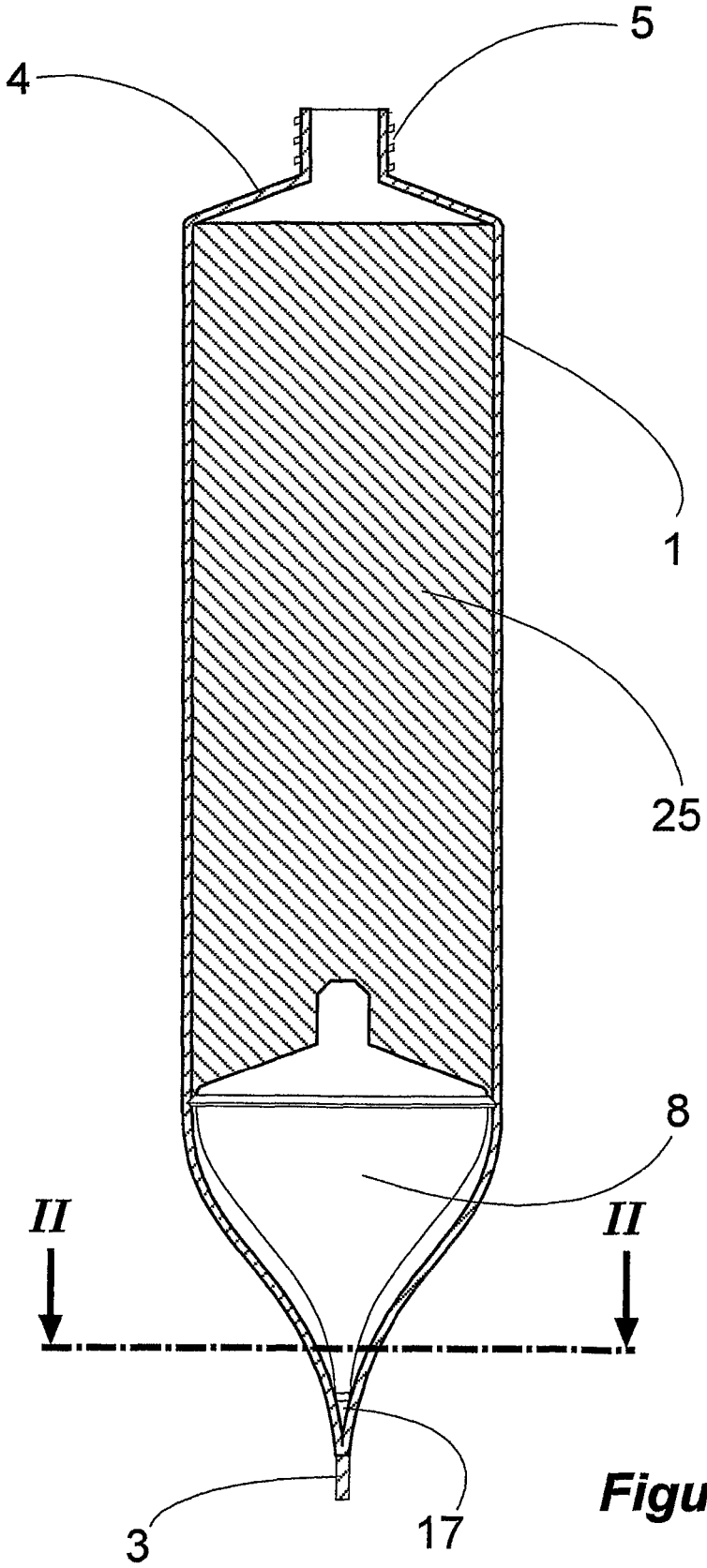

FIG. 10 shows a section through the deformable dispensing tube 1 from a side view of the deformable dispensing tube 1 with the device 8 in place at the sealed end 3 and the internal volume 25 within the deformable dispensing tube 1.

Figure 11:
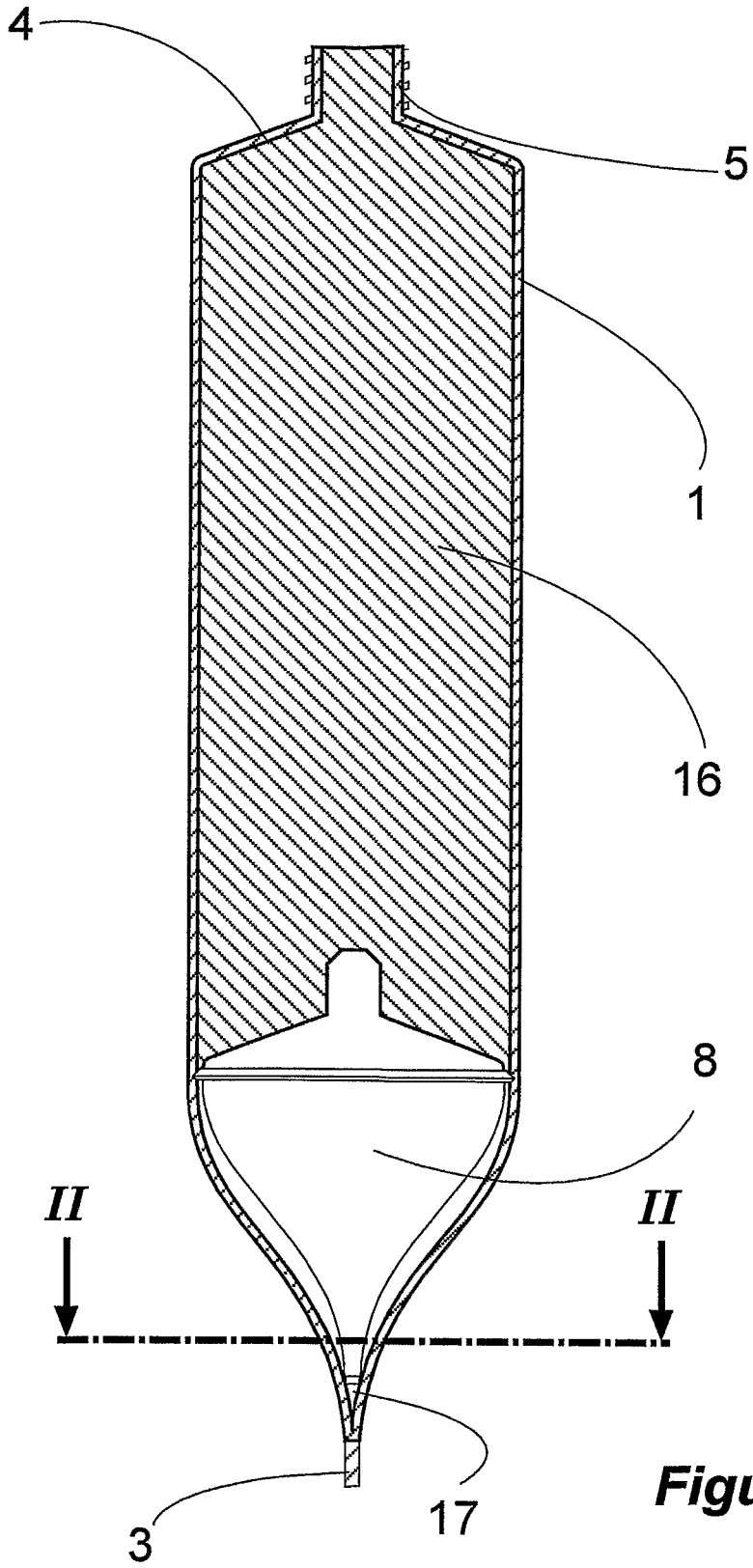

FIG. 11 shows a section through the deformable dispensing tube 1 from a side view of the deformable dispensing tube 1 with the device 8 in place at the sealed end 3 and the contents 16 within the deformable dispensing tube 1.

Figure 12:
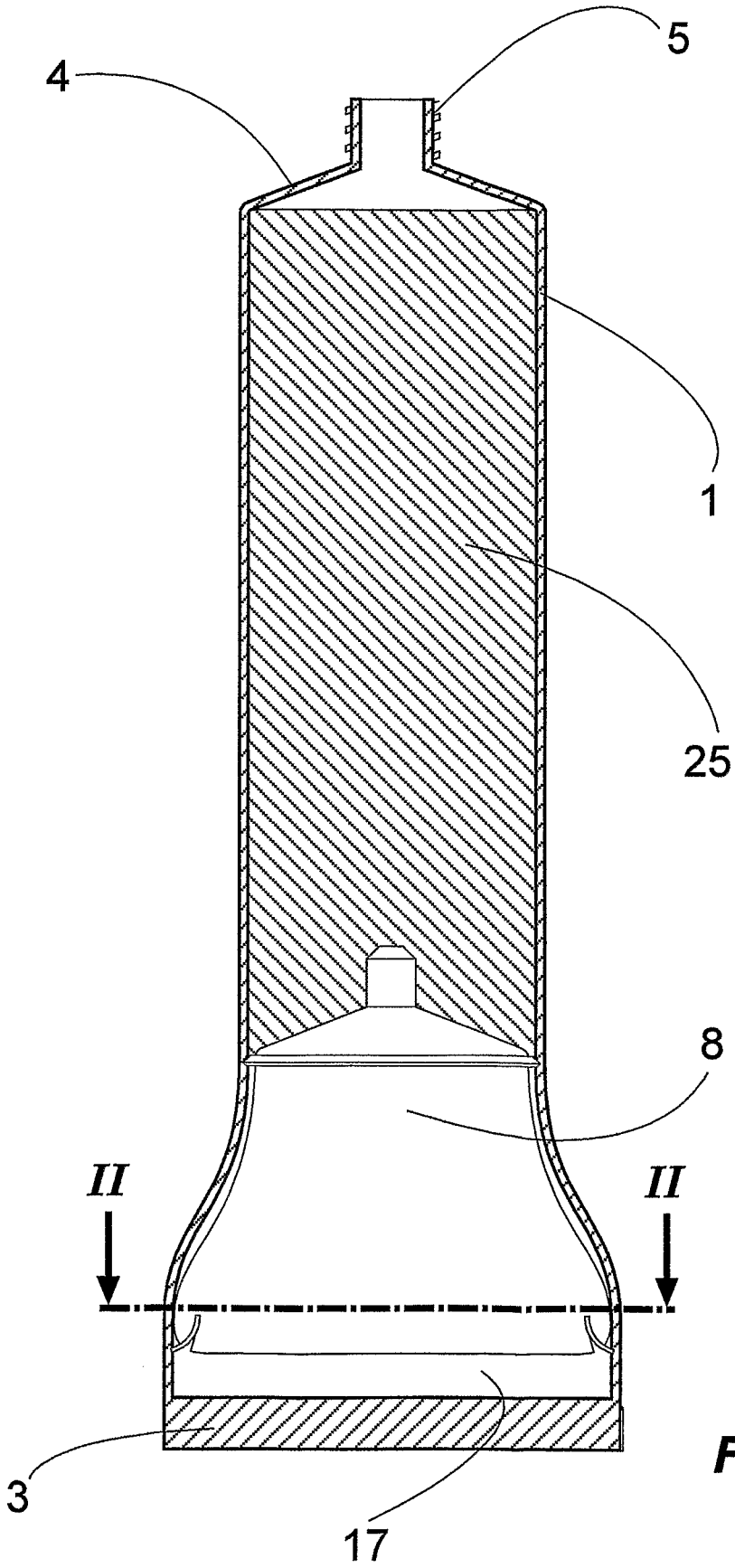

FIG. 12 shows a section through the deformable dispensing tube 1 from a front view of the deformable dispensing tube 1 with the device 8 in place at the sealed end 3 and the internal volume 25 within the deformable dispensing tube 1.

Figure 13:
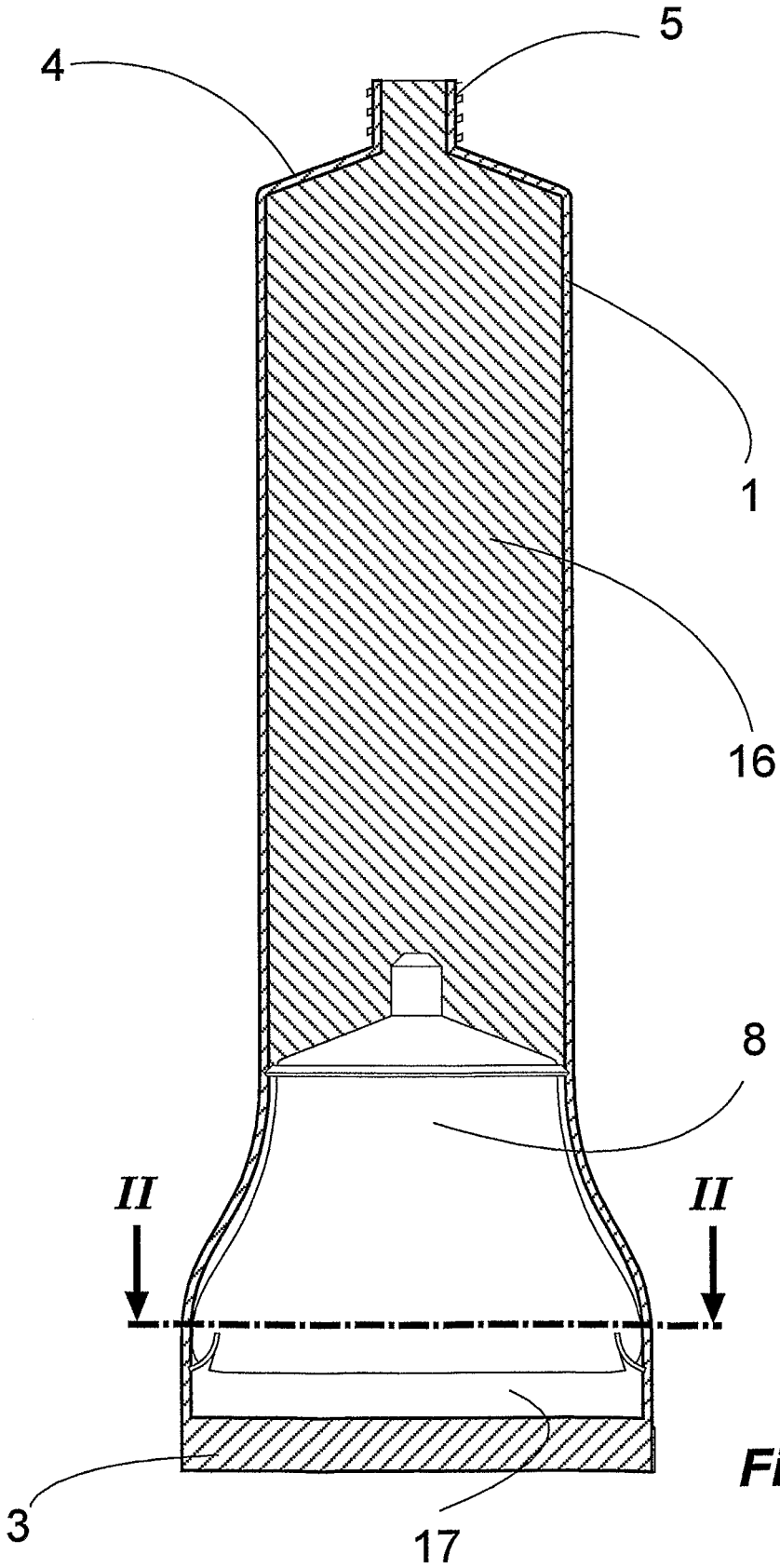

FIG. 13 shows a section through the deformable dispensing tube 1 from a front view of the deformable dispensing tube 1 with the device 8 in place at the sealed end 3 and the contents 16 within the deformable dispensing tube 1.

Figure 14:
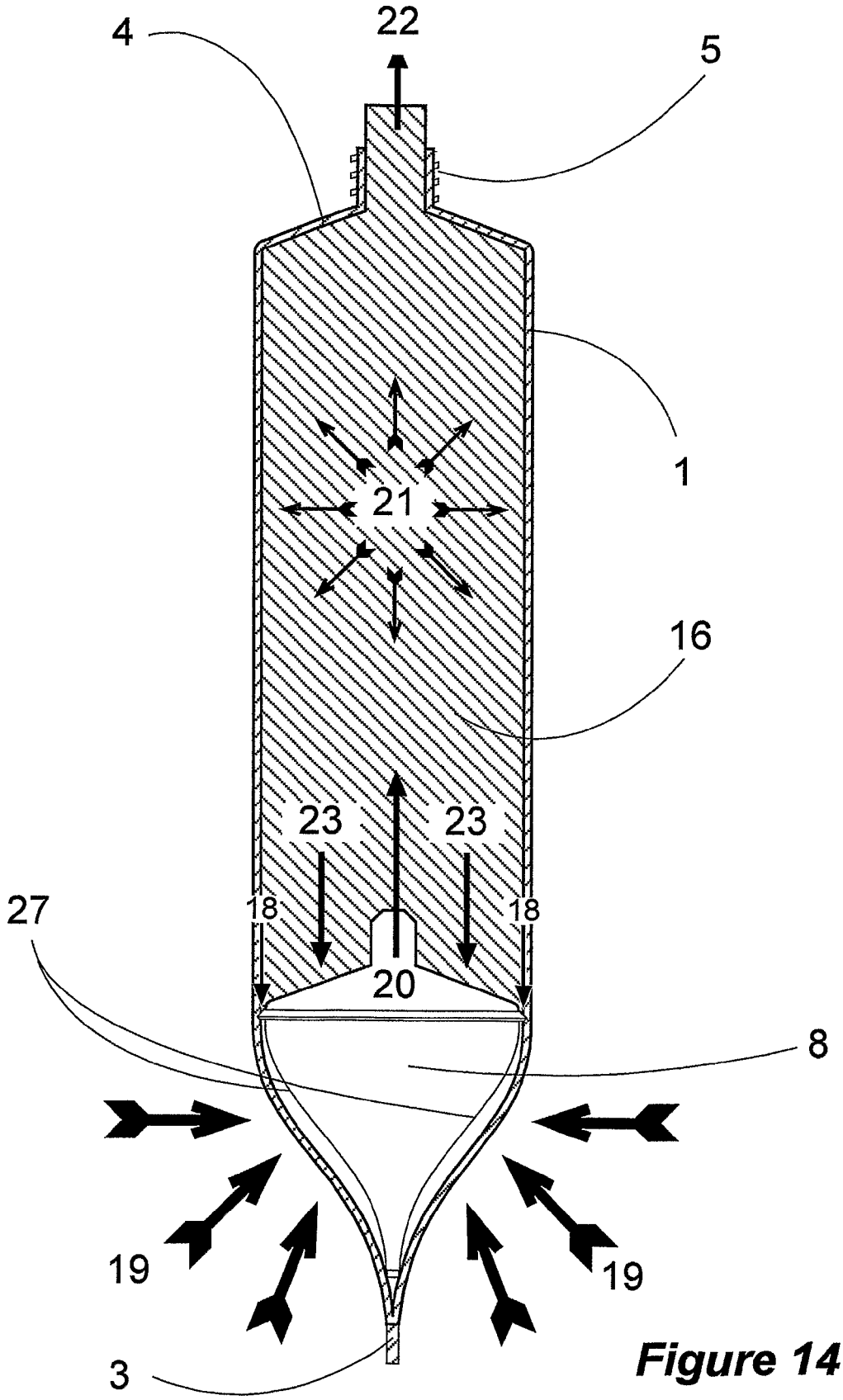

FIG. 14 shows a section through the deformable dispensing tube 1 from a side view of the deformable dispensing tube 1 with the device 8 in place at the sealed end 3 with external forces 19 acting.

Figure 15:
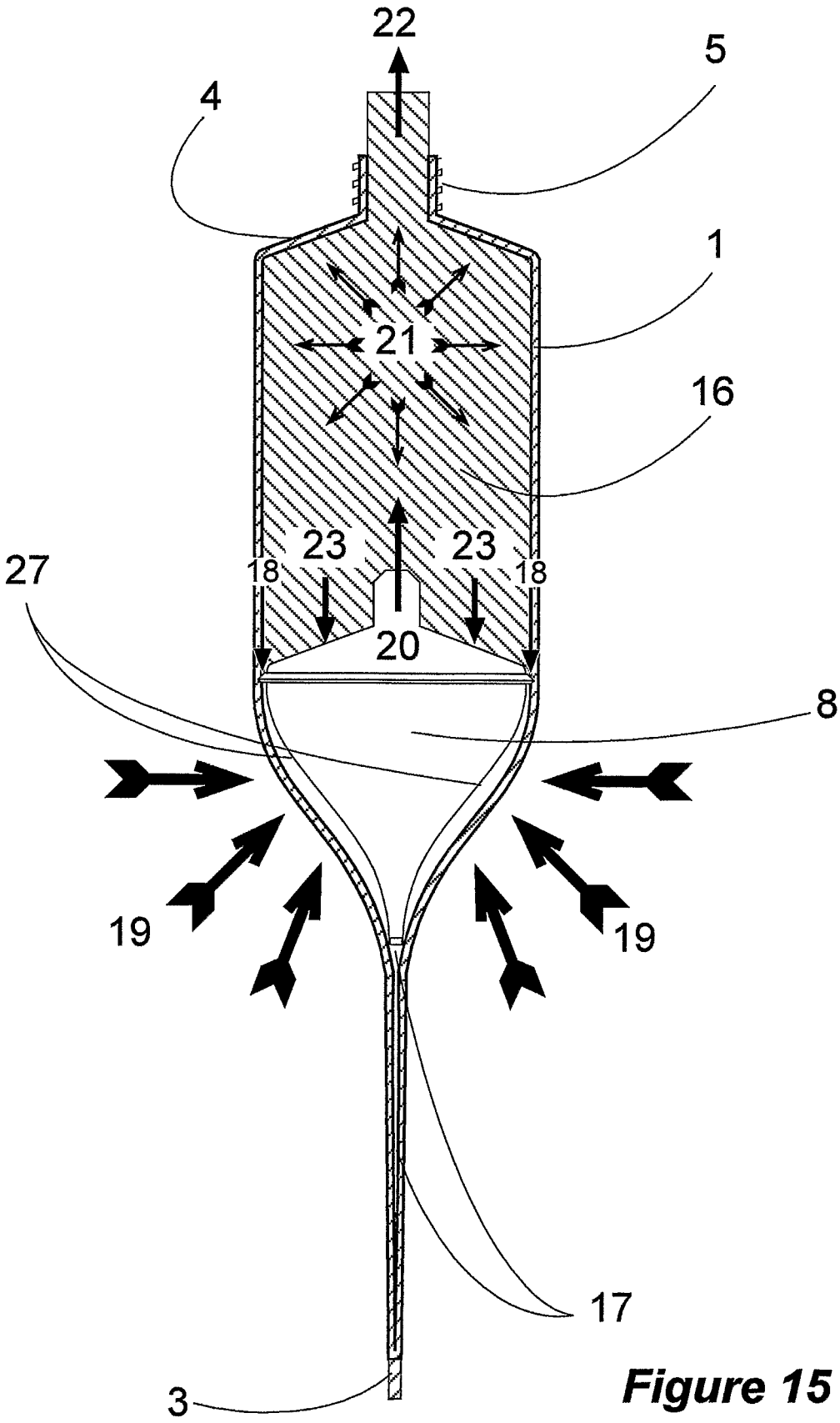

FIG. 15 shows a section through the deformable dispensing tube 1 from a side view of the deformable dispensing tube 1 with the device 8 in place at a point halfway between the sealed end 3 and the formed opening 4 with external forces 19 acting.

Figure 16:
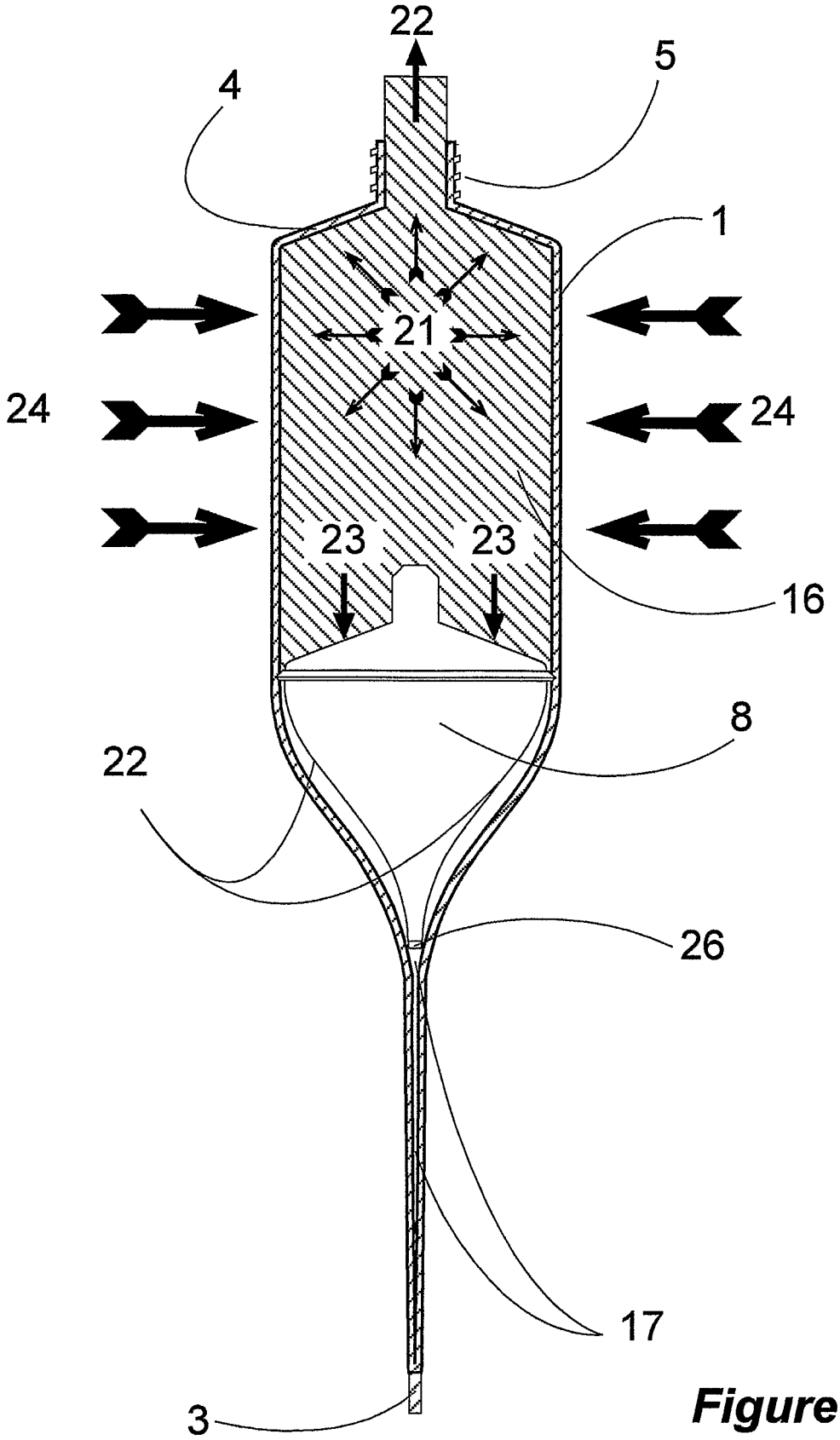

FIG. 16 shows a section through the deformable dispensing tube 1 from a side view of the deformable dispensing tube 1 with the device 8 in place at a point halfway between the sealed end 3 and the formed opening 4 with external forces 24 acting.

Figure 17:
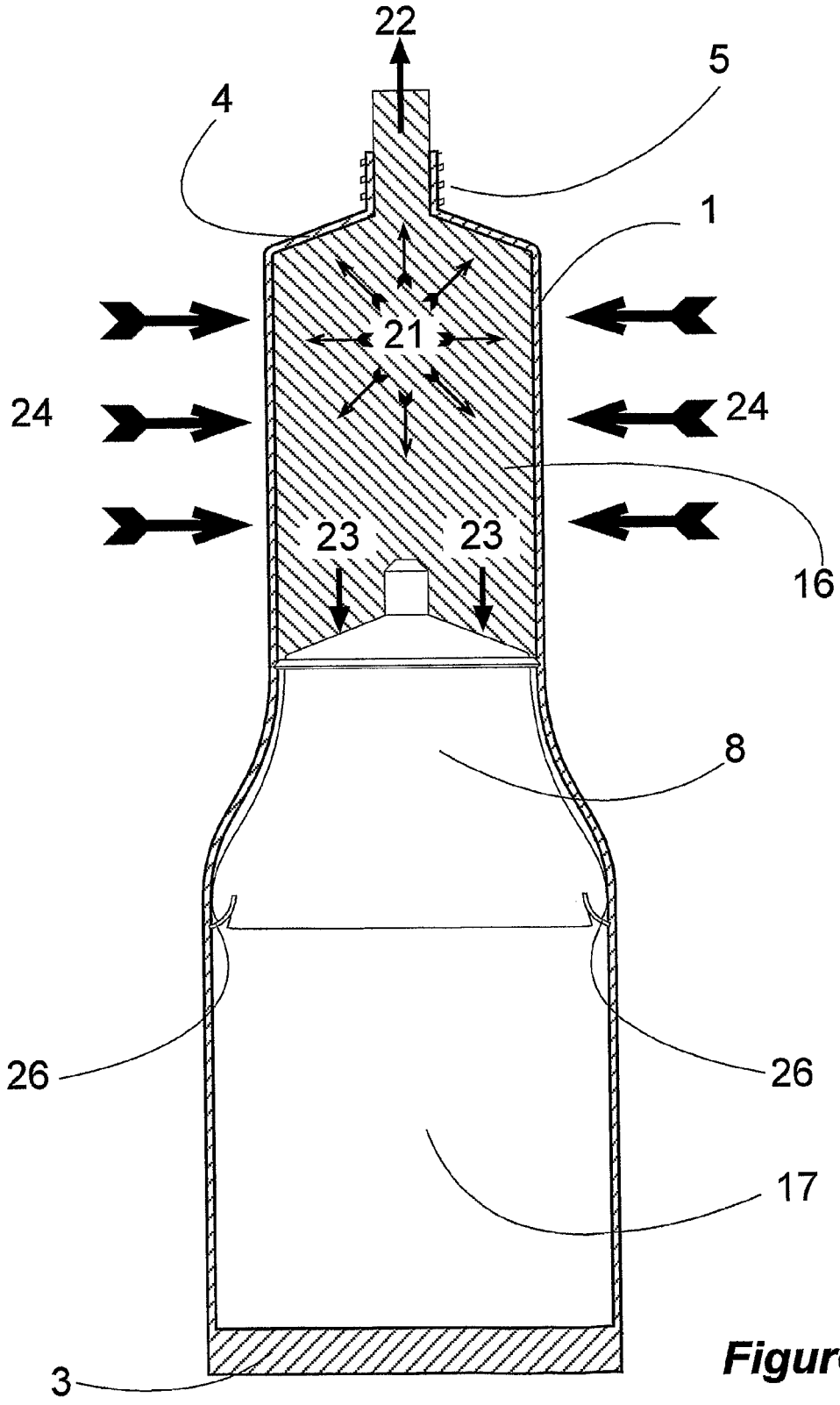

FIG. 17 shows a section through the deformable dispensing tube 1 from a front view of the deformable dispensing tube 1 with the device 8 in place at a point halfway between the sealed end 3 and the formed opening 4 with external forces 24 acting.

Figure 18:
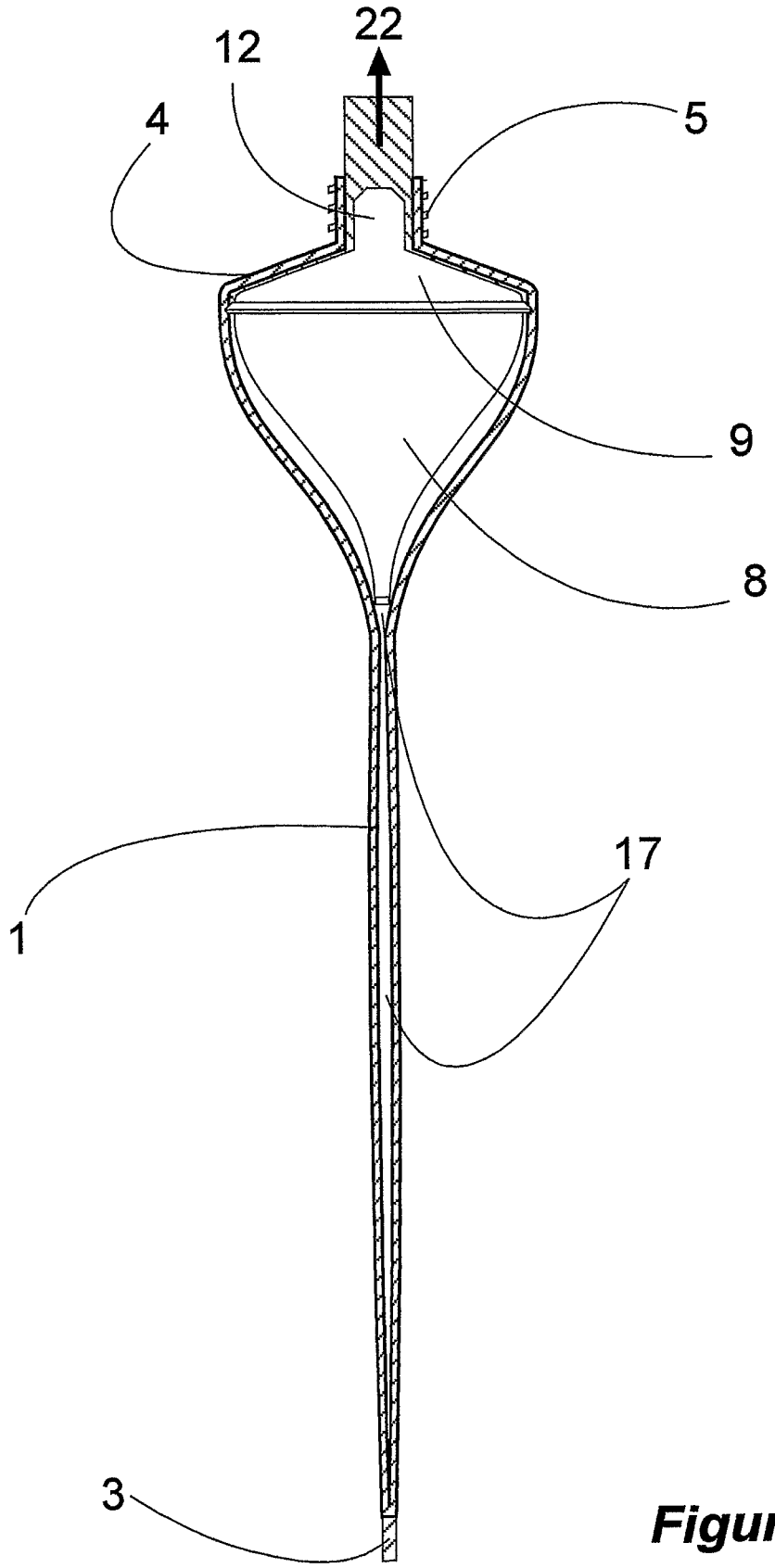

FIG. 18 shows a section through the deformable dispensing tube 1 from a side view of the deformable dispensing tube 1 with the device 8 in place at the formed opening 4.

Figure 19:
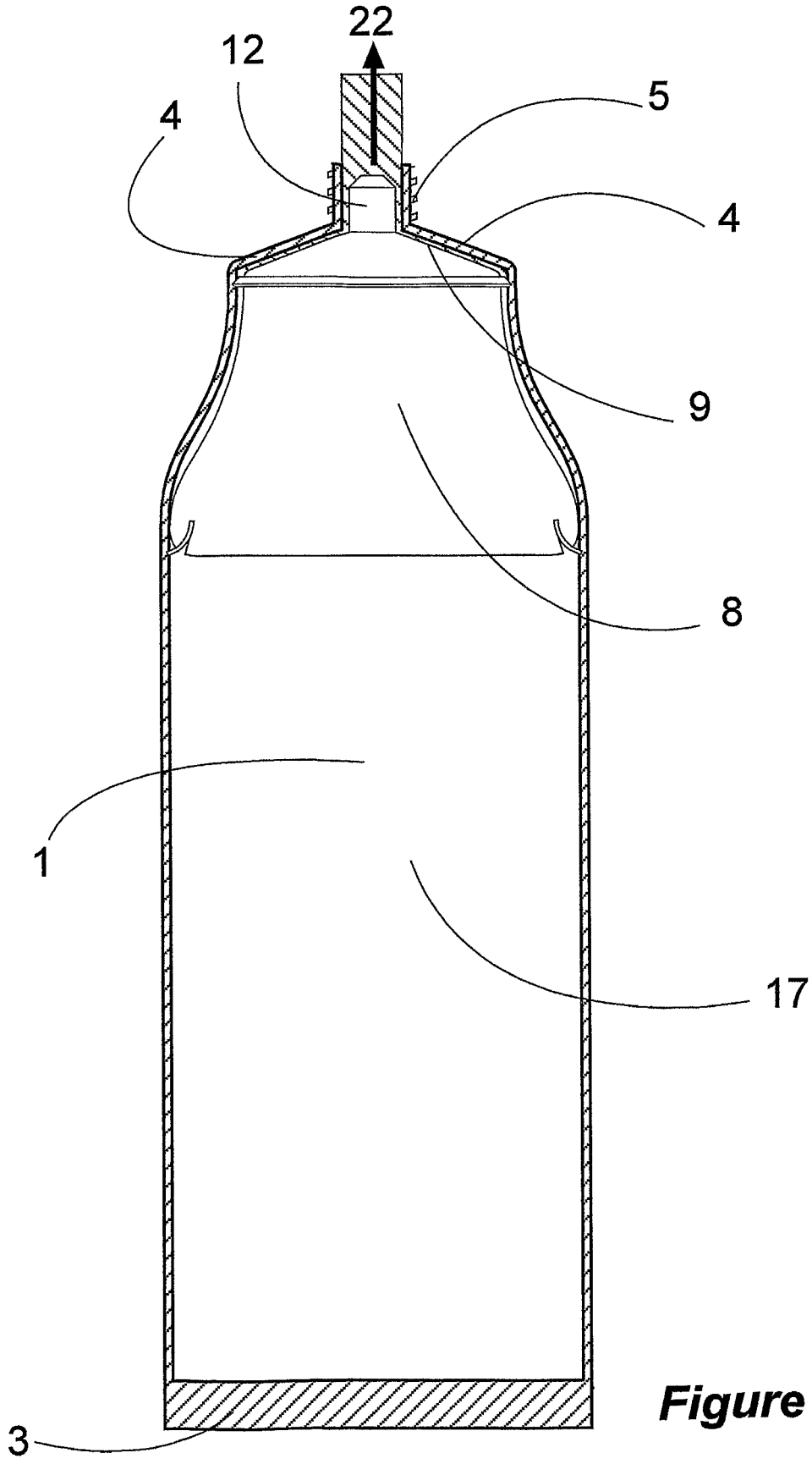

FIG. 19 shows a section through the deformable dispensing tube 1 from a front view of the deformable dispensing tube 1 with the device 8 in place at the formed opening 4.

Embodiment A of the invention is a device, hereinafter referred to as the device 8, provided as a separate insert to existing deformable dispensing tubes. A description of a typical deformable dispensing tube is given in reference to the inclusion and working of the device 8. Such a deformable dispensing tube will hereinafter referred to as the deformable dispensing tube 1.

The deformable dispensing tube 1 has a deformable body 2, which is hollow. At one end of the deformable body 2 is a sealed end 3 and at the opposing end of the deformable body 2 is a formed opening 4, which is hollow. Although shown separated in FIG. 2 for clarity the deformable body 2, the sealed end 3 and the formed opening 4 form the deformable dispensing tube 1 as a homogenous whole when the deformable dispensing tube 1 is in its finished manufactured state.

The formed opening 4 has at one end a formed orifice 5 for the opening and re-sealing the formed opening 4, thereby allowing the dispensing of the contents 16 of the deformable dispensing tube 1.

The formed opening 4 transforms in shape and size from the formed orifice 5 into a larger shape where it meets the deformable body 2. The meeting point of the formed opening 4 and the deformable body 2 is herein after referred to as cross-section 6 and is shown hatched on FIG. 2 and is referenced by the line I-I on FIG. 3 and by the line I-I on FIG. 4.

The formed opening 4 varies in rigidity and is substantially more rigid than the deformable body 2, thereby forcing the deformable body 2 to adopt the same shape and size at cross-section 6.

The sealed end 3 is formed by flattening and then permanently sealing or fusing together the material of the deformable dispensing tube 1 at that point such that an internal volume or space can no longer exist within the deformable dispensing tube 1.

By sealing the deformable dispensing tube 1 at the sealed end 3 the deformable body 2 is forced to adopt a certain cross-section as it nears the sealed end 3. The hollow cross section formed by the deformable body 2 in the area just before it becomes part of the sealed end 3 is hereinafter referred to as cross-section 7 and is shown hatched on FIG. 2 and is referenced by the line II-II on FIG. 3 and by the line II-II on FIG. 4.

The volume between cross-section 7 and the sealed end 3 is hereinafter referred to as the void 17.

The deformable body 2 therefore transforms in shape from the cross-section 6 to the cross-section 7 along the length of the deformable body 2 thereby giving the deformable body 2 an internal volume.

The device 8 is a formed three-dimensional moulded shape and is mostly rigid or substantially more rigid than the deformable body 2. The device 8 comprises the device top 9, the device tail 10, and the device body 11. Although shown separated in FIG. 7 for clarity the device top 9, the device tail 10, and the device body 11 form the device 8 as a homogenous whole.

The device tail 10 has at its widest point the cross-section 14 shown hatched on FIG. 7 and is referenced by the line IV-IV on FIG. 8 and by the line IV-IV on FIG. 9. The device tail 10 also has two non-return features 26. The non-return features 26 may be integrally moulded to the device 8 or may be formed as separate parts from alternative materials.

The device top 9 consists of the device plug 12 that transforms into the larger cross-section 13 at the device top 9's widest rigid point. The cross-section 13 is shown hatched on FIG. 7 and is referenced by the line III-III on FIG. 8 and by the line III-III on FIG. 9.

At or near the cross-section 13 is a flexible seal 15. The flexible seal 15 may be integrally moulded to the device 8 or may be formed as a separate part from alternative materials. The flexible seal 15 will be of similar shape to cross-section 13 but of slightly larger size than the cross-section 13.

The device body 11 transforms smoothly in shape from the cross-section 13 to the cross-section 14.

The device tail 10 is formed from the cross-section 14 tapering or rounding into an end in the direction directly away from the device top 9, as shown in FIGS. 7, 8 and 9. The shape and size of the device tail 10 is such that it will fit into the void 17 when the device 8 is in place within the deformable dispensing tube 1 at the sealed end 3.

The cross-section 14 at the device tail 10 matches in shape and size the internal shape and internal size of cross-section 7 of the deformable dispensing tube 1.

When the device 8 is in place within the deformable dispensing tube 1, the cross-section 14 at the device tail 10 forces the deformable body 2 to adopt an internal cross-section the same shape and size as the cross-section 14 at any point along the deformable body 2's length at which the device tail 10 and the deformable body 2 are in contact.

The cross-section 13 at the device top 9 matches in shape and size the internal shape and internal size of the cross-section 6 of the deformable dispensing tube 1.

When the device 8 is in place within the deformable dispensing tube 1, the cross-section 13 at the device top 9 forces the internal cross-section of the deformable body 2 to adopt to the same shape and size as the cross-section 13 at any point along the deformable body 2's length at which the device top 9 and the deformable body 2 are in contact.

FIG. 10 and FIG. 12 show the device 8 situated inside of the deformable dispensing tube 1 at the sealed end 3. The internal volume 25 is created inside the deformable dispensing tube 1 between the device top 9 and the formed opening 4. The contents 16 are contained within internal volume 25 and partly with the formed opening 4 as shown in FIG. 11 and FIG. 13. The void 17 will be partly occupied with the device tail 10.

The fit between the internal surface of the deformable body 2 and the cross-section 13 of the device 8 is such that a seal is formed between the internal surface of the deformable body 2 and the device 8 thereby preventing any transgression by the contents 16 even when under pressure.

When as part of the assembly that makes device 8 and not under any pressure or force, the flexible seal 15 will be of similar shape to cross-section 13 but of slightly larger size than the cross-section 13. It follows that the cross-section of the flexible seal 15 is also slightly larger than the internal cross-section of the deformable body 2 formed by the presence of the device 8 within the deformable body 2.

When the device 8 is in place within the deformable dispensing tube 1, the flexible seal 15 is compressed to fit within the internal cross-section of the deformable body 2.

The flexible seal 15 having been compressed to fit within the deformable dispensing tube 1 is under pressure against the internal surface of the deformable body 2 thereby providing enhanced or further sealing against any transgression by the contents 16 while still allowing the device 8 to move freely within the dispensing tube 1.

When as part of the assembly that makes device 8 and not under any pressure or force, the non-return features 26 are flexible parts that have external dimensions greater than those of the cross-section 14 and the corresponding cross-section 7 into which they must fit.

When the device 8 is in place within the deformable dispensing tube 1, the non-return features 26 are compressed to fit within the cross-section 7 in such a manner that if the device 8 is moved in the direction of the formed opening 4 the non-return features compress further thereby allowing the device 8 to move freely within the dispensing tube 1 in the direction of the formed opening 4. However, when the device 8 is in place within the deformable dispensing tube 1, the non-return features 26 are compressed to fit within the cross-section 7 in such a manner that if the device 8 is moved in the direction of the sealed end 3 the non-return features 26 are forced against or into the internal surface of the deformable dispensing tube 1 thereby locking the device 8 at that point and preventing the device 8 from moving any further in the direction of the sealed end 3.

The outer shape of the device top 9 will be of such a shape and size that it can move inside of the formed opening 4 of the deformable dispensing tube 1 in such a manner that it expels as much of the contents 16 as is feasible, as shown in FIG. 18 and FIG. 19.

The device plug 12 of the device top 9 will be of such a shape and size that it can move inside of the formed orifice 5 while still allowing the contents 16 to be expelled, as shown in FIG. 18 and FIG. 19.

The device 8 features tapered surfaces 27. The tapered surfaces 27 are formed by the smooth transition from the cross-section 13 to the cross-section 14.

The user applies external pressure directly or indirectly to the outside of the deformable dispensing tube 1 as shown by the arrows at 19 on FIGS. 14 and 15. A result of the external pressure 19 is to create the resultant force 20 acting on the device 8 in the direction of the formed opening 4. The resultant force 20 in turn acts through the device 8 onto the contents 16 thereby creating an internal pressure 21 within contents 16 contained within the deformable dispensing tube 1.

The internal pressure 21 will create an opposing force 23 on the device 8. The opposing force 23 resists the resultant force 20 and acts to move the device 8 in the direction towards the sealed end 3 but any such movement is resisted by the non-return features 26.

The effects of the sealing between the device 8 and the internal surface of the deformable body 2 coupled with the additional sealing provided by the flexible seal 15 ensure the contents 16 remain within the internal volume 25 that is on the formed opening 4's side of the device 8.

When the formed orifice 5 is un-sealed the internal pressure 21 will force the contents 16 to be expelled through the formed orifice 5, as arrowed 22.

Initially, as the contents 16 begin to be expelled from the deformable dispensing tube 1 the internal pressure 21 will reduce with a corresponding reduction in the opposing force 23. As such the resultant force 20 will be larger than the opposing force 23 created by the internal pressure 21 of the contents 16.

The difference between the resultant force 20 and the opposing force 23 will be accounted for by the internal friction force 18 that exists between the device 8 and the internal surfaces of the deformable dispensing tube 1, as shown in FIGS. 14 and 15.

As the contents 16 continue to be expelled from the deformable dispensing tube 1 there is a corresponding further reduction in the opposing force 23. Eventually the resultant force 20 will be greater than both the opposing force 23 and the internal frictional force 18 combined and at this point the device 8 will begin to move forward in the direction of the resultant force 20 that is towards the formed opening 4.

As the device 8 moves towards the formed opening 4 the internal pressure 21 will be maintained at a level where the contents 16 will continue to be expelled through the formed orifice 5 and void 17 will increase in size leaving the deformable body 2 empty and in a flat or near flat state, as shown in FIG. 15.

With reference to FIG. 16 and FIG. 17, the internal pressure 21 can also be created by an external force 24 on the deformable body 2 between the formed opening 4 and the location of the device 8.

In the aforementioned instance the opposing force 23 can act to move the device 8 away from the formed opening 4 and towards the sealed end 3. The non-return features 26 are so designed as to prevent the device 8 moving in the direction of the sealed end 3 and therefore the internal pressure 21 generated by an external force at 24 will also result in the contents 16 being expelled through the formed orifice 5, as arrowed at 22.

As the device 8 nears the formed opening 4 the shape and size of the device top 9 corresponding to the internal shape and internal size of the formed opening 4 allows the device top 9 to move inside the formed opening 4 in such a manner that as much of the contents 16 are expelled as is feasibly possible. In this instance, the device plug 12 is of such a shape and size that the contents 16 are still able to flow through the formed orifice 5 even when the device plug 12 has moved inside of the formed orifice 5, as shown in FIG. 18 and FIG. 19.

The user is able to vary the external pressure 19 or 24 in such a manner that the user can then control the rate at which the contents 16 are expelled.

When the user removes the external pressure 19 or external pressure 24 the consequent forces set up within the deformable dispensing tube 1 and the device 8 are removed and therefore the contents 16 cease to flow.

As the device 8 is prevented from moving back towards the sealed end 3 by the non-return features 26 the contents 16 will always remain in the area of the formed opening 4 ready for further use.

An alternative specific embodiment of the invention, titled Embodiment B, will now be described by way of example only with reference to the accompanying drawings, FIGS. 1 through to 5 only and additional FIGS. 20 through to 38 only.

Of which:—

Figure 1:
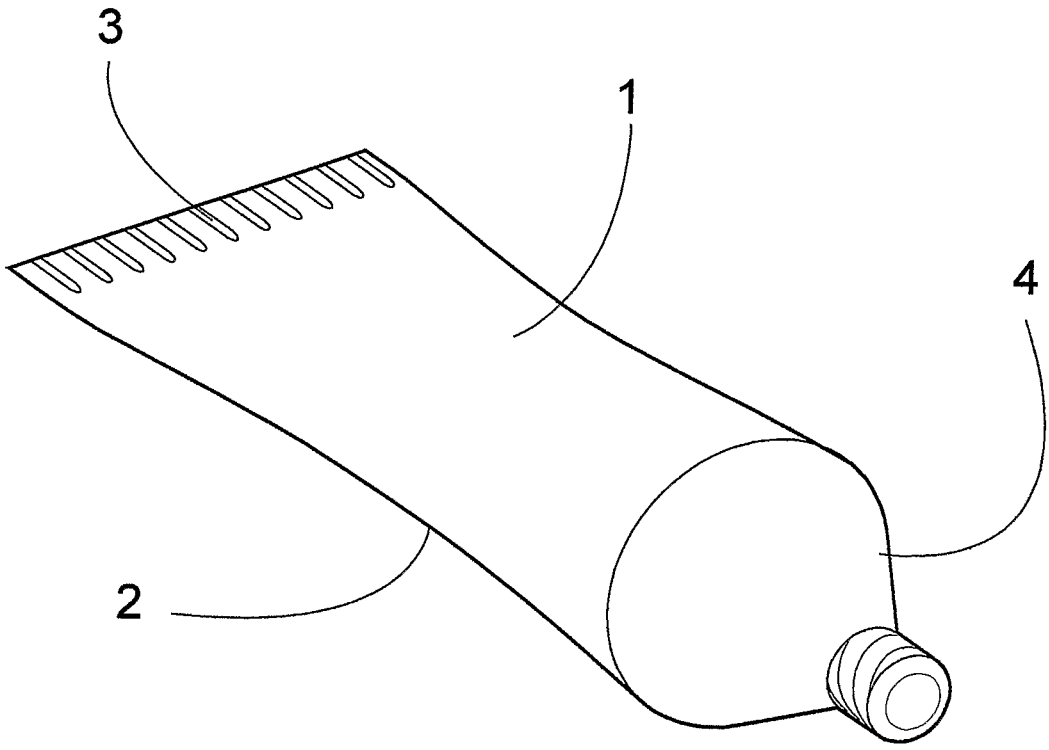

FIG. 1 shows a perspective view of the deformable dispensing tube 1.

Figure 2:
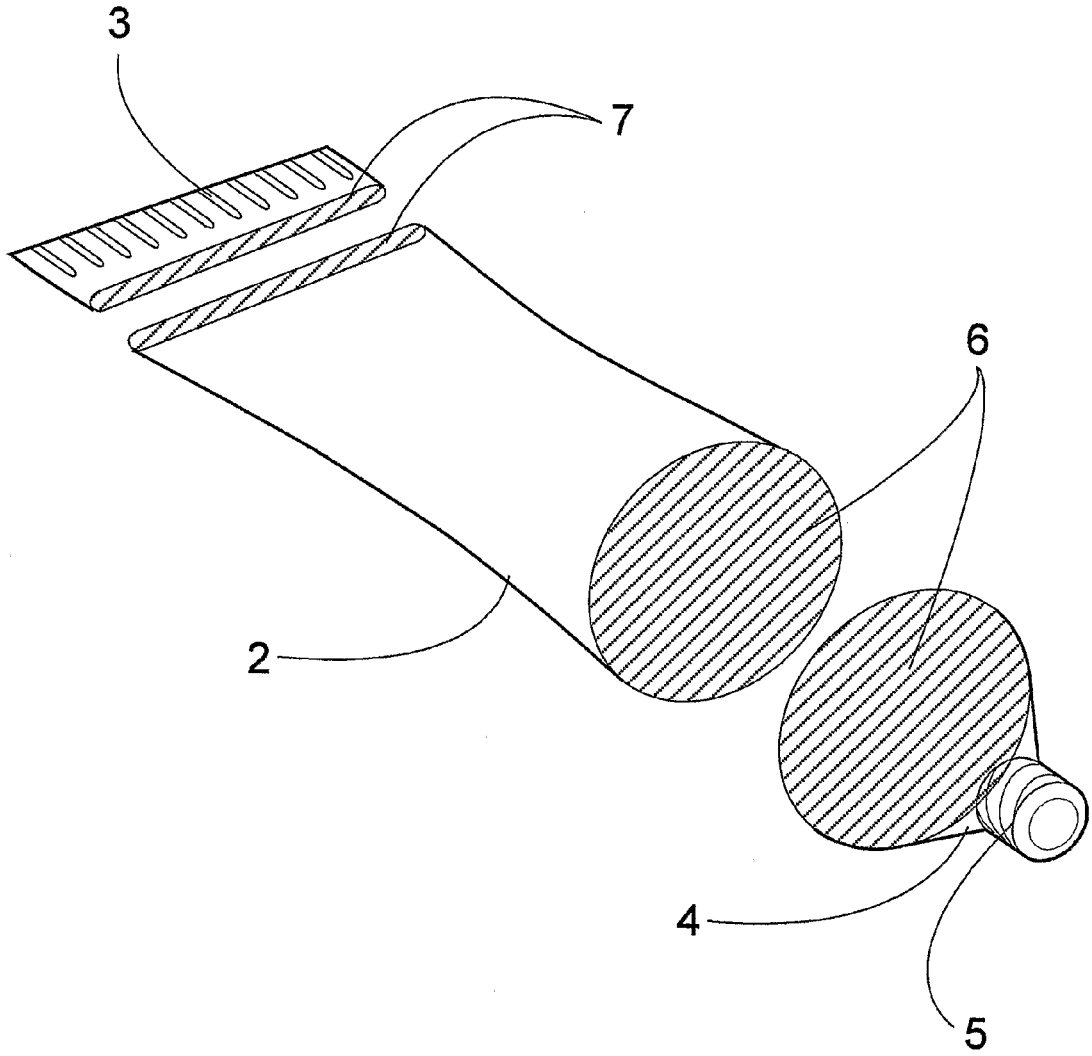

FIG. 2 shows a perspective view of the deformable dispensing tube 1 with the deformable dispensing tube 1 illustrated in 3 sections: —the formed opening 4, the sealed end 3, and the deformable body 2.

Figure 3:
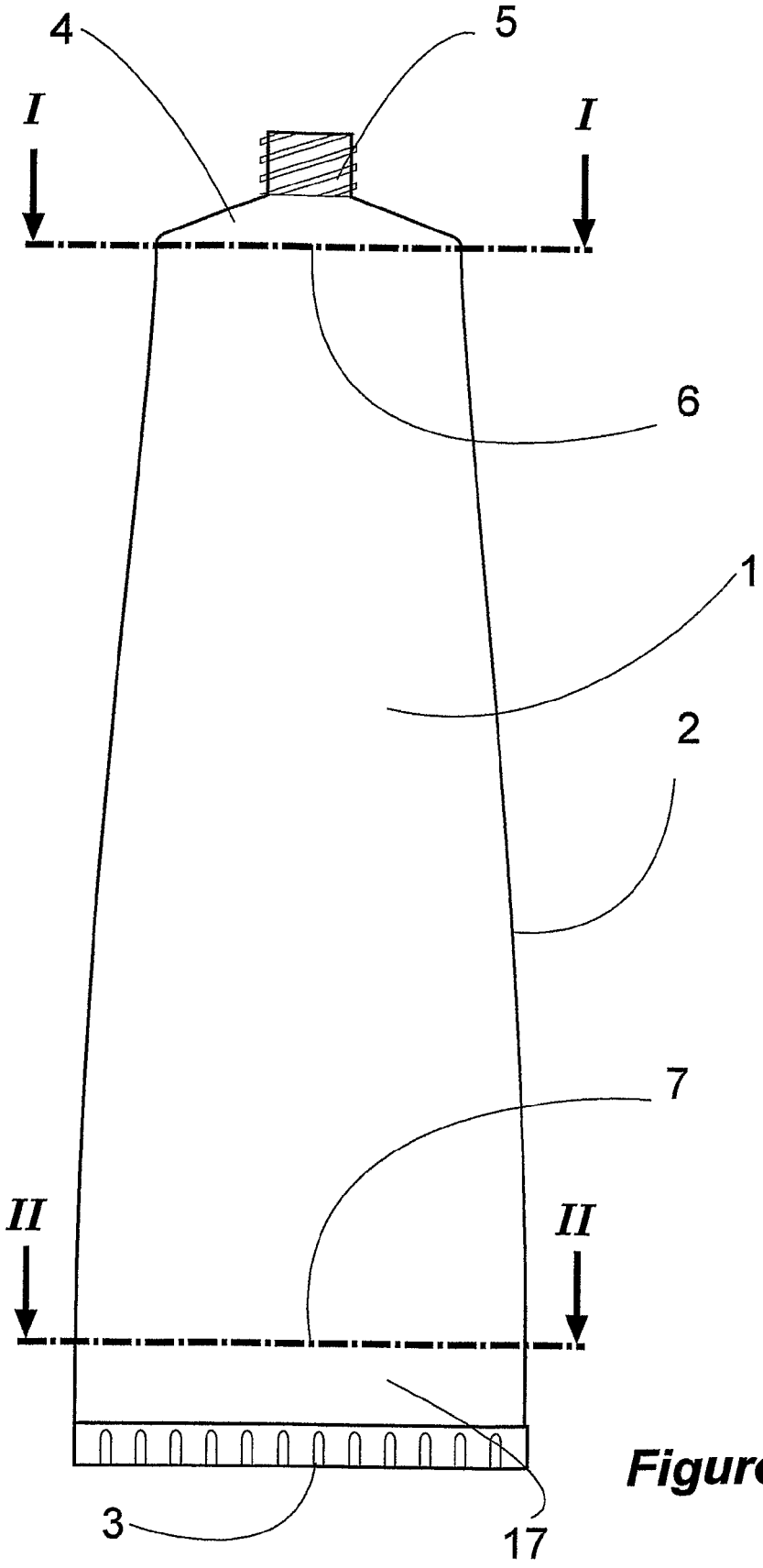
FIG. 3 shows a front view of the deformable dispensing tube 1.

FIG. 3 shows a front view of the deformable dispensing tube 1.

Figure 4:
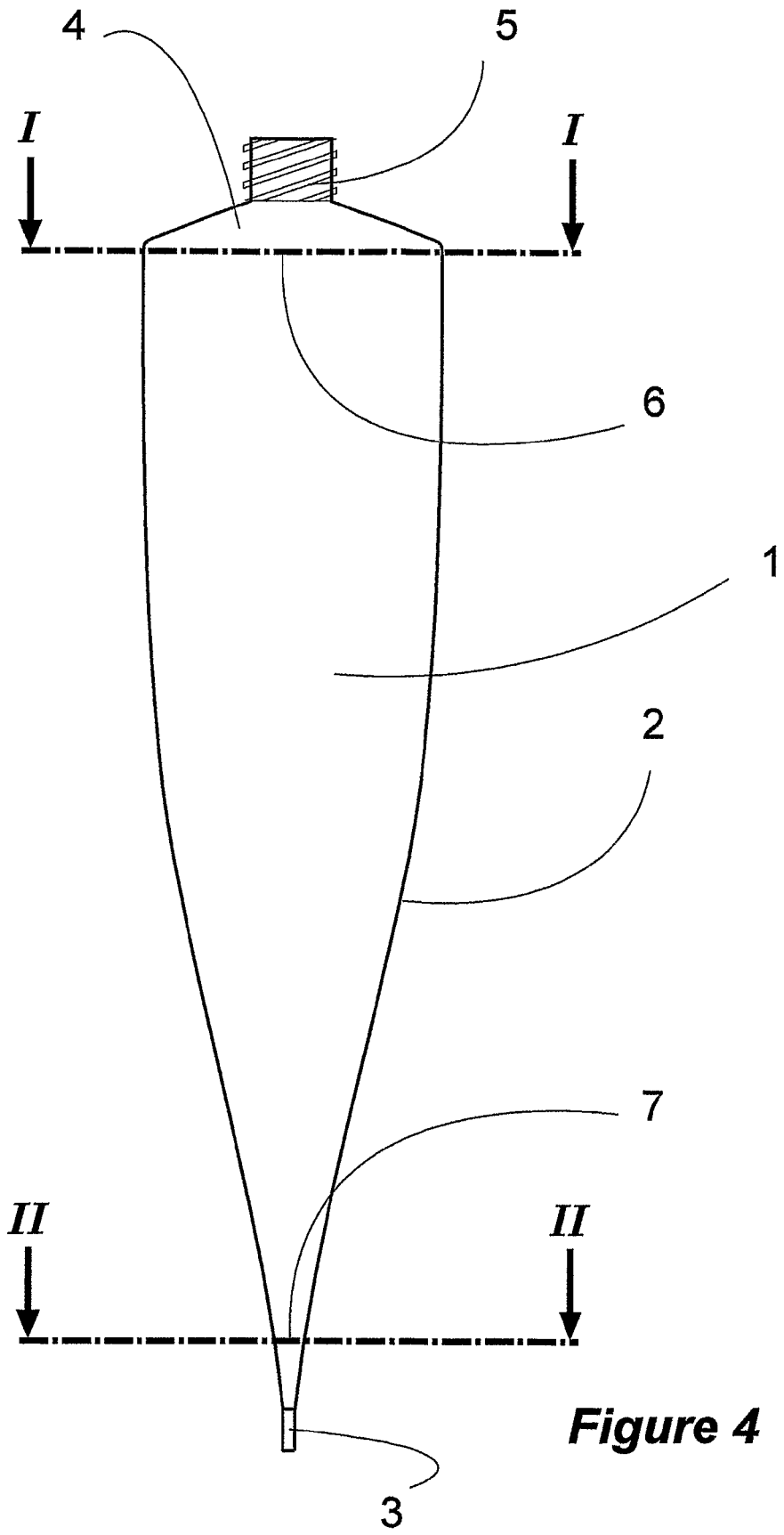
FIG. 4 shows a side view of the deformable dispensing tube 1.

FIG. 4 shows a side view of the deformable dispensing tube 1.

Figure 5:
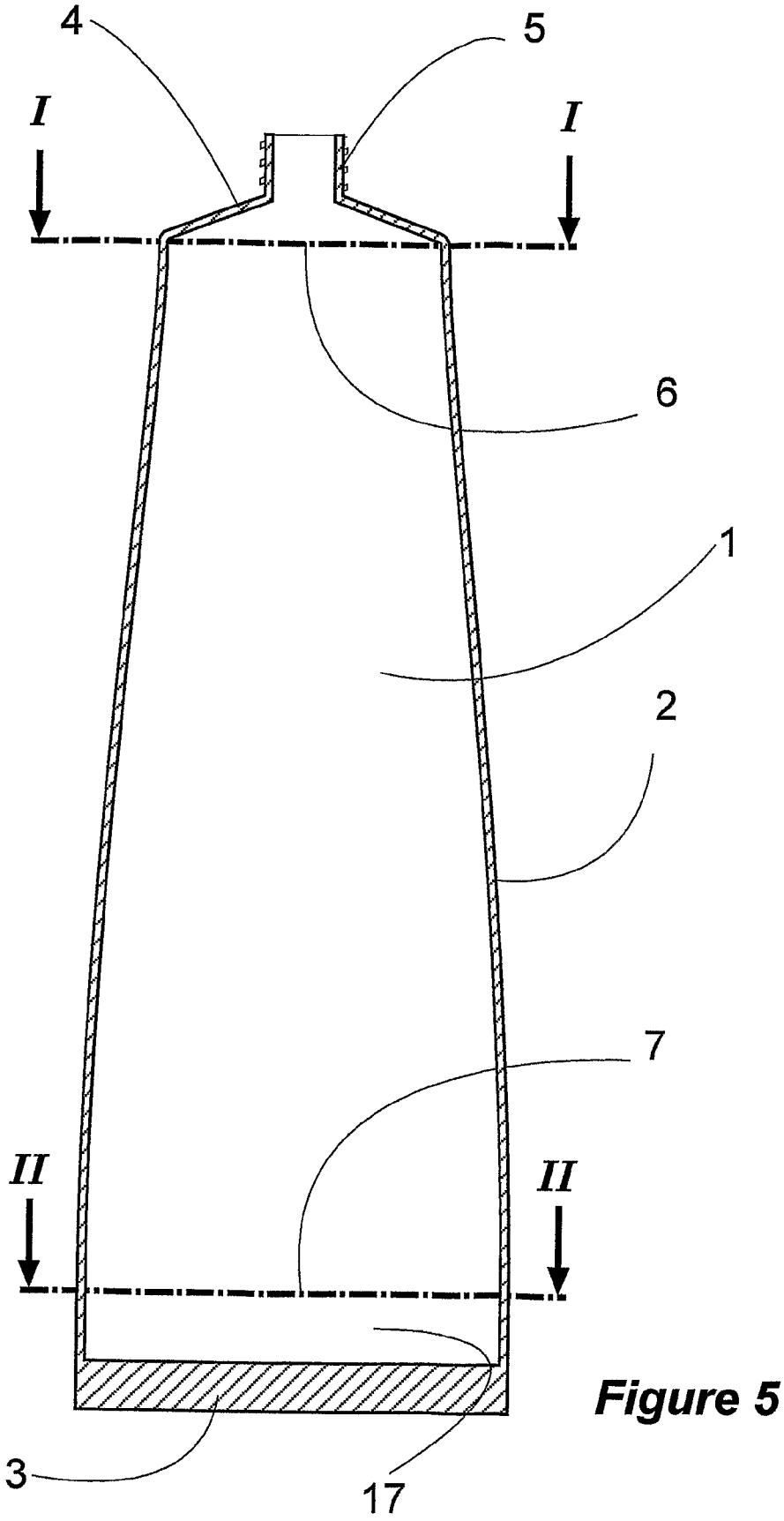
FIG. 5 shows a section through the deformable dispensing tube 1 from a front view of the deformable dispensing tube 1.
Figure 6:
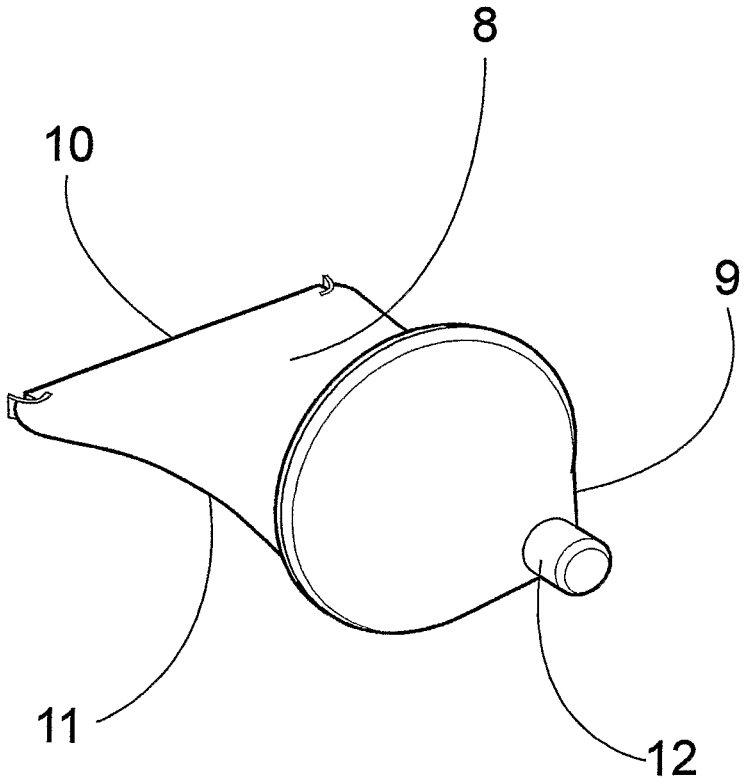
FIG. 6 shows a perspective view of the device 8.

FIG. 5 shows a section through the deformable dispensing tube 1 from a front view of the deformable dispensing tube 1.

Figure 20:
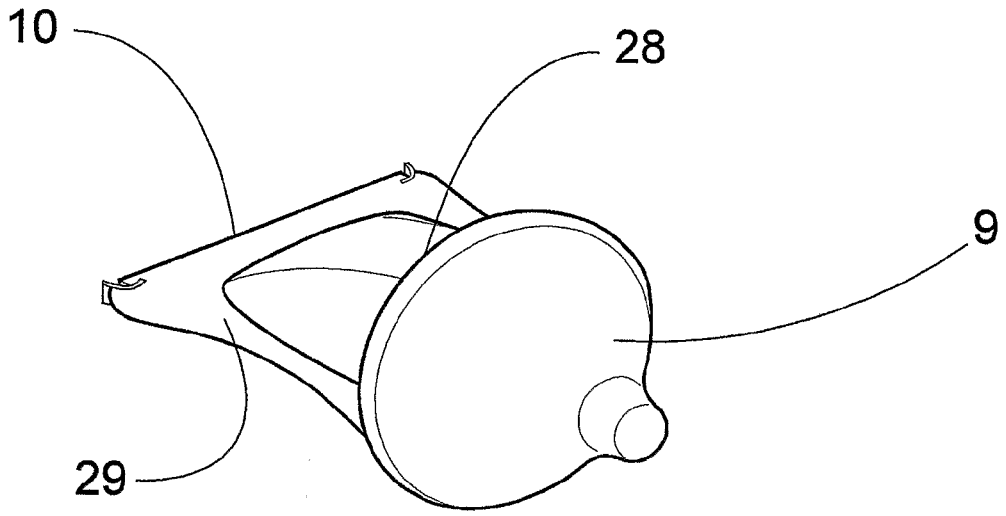

FIG. 20 shows a perspective view of the device 8 looking at the device top 9.

Figure 21:
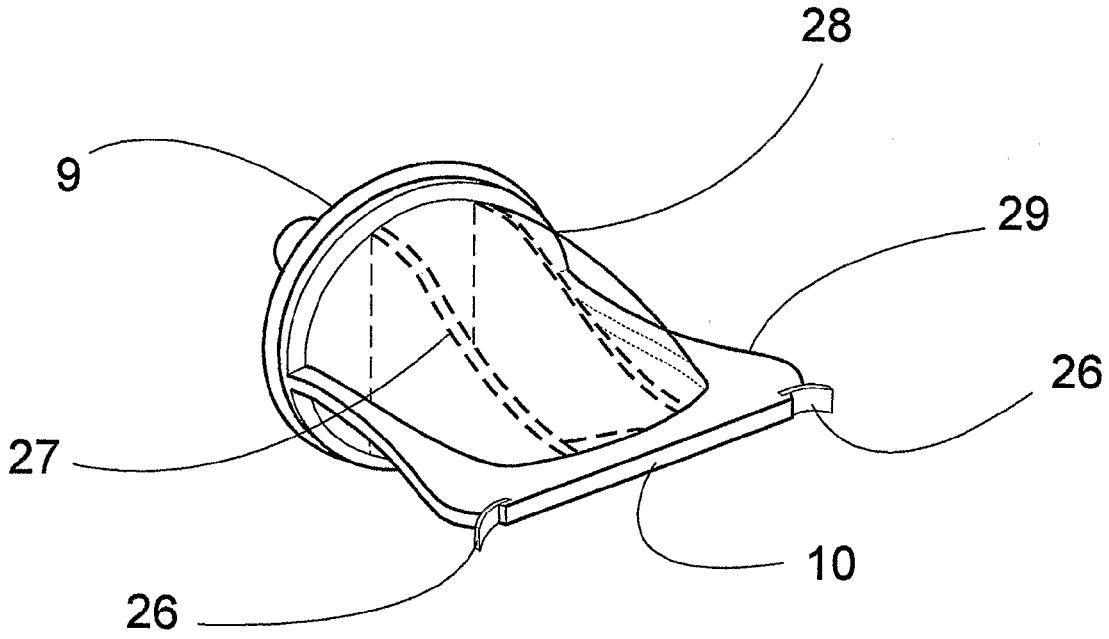

FIG. 21 shows a perspective view of the device 8 looking at the device tail 10.

Figure 22:
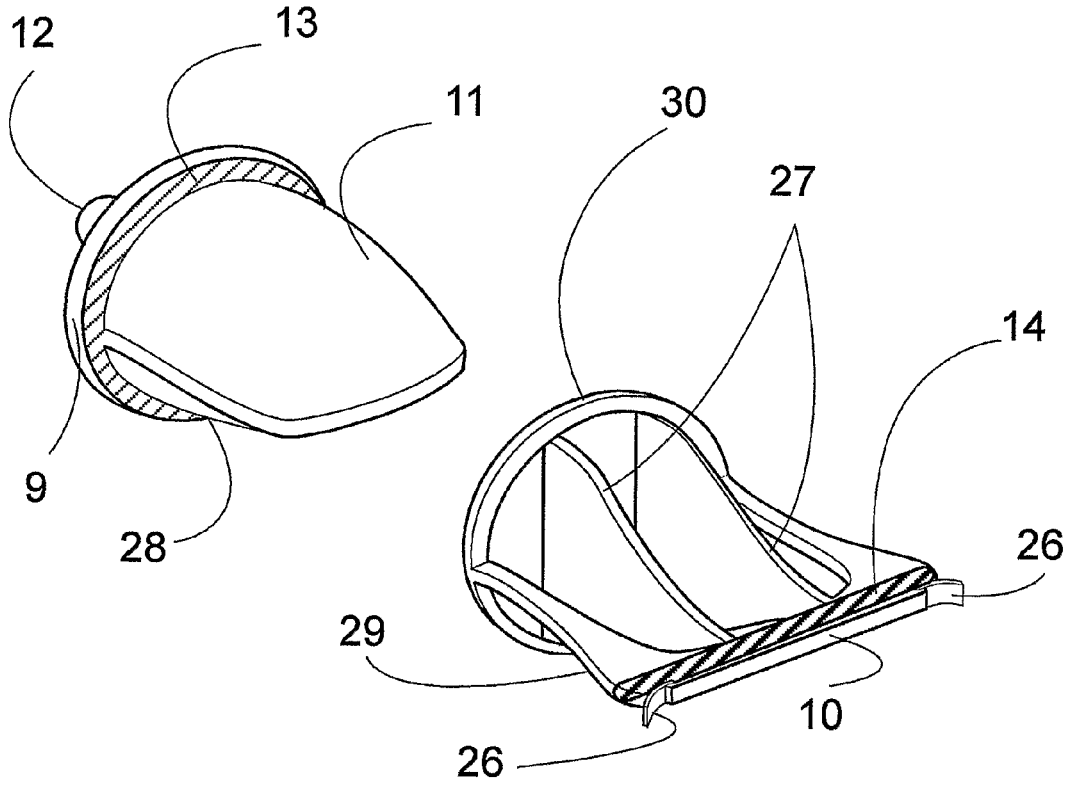

FIG. 22 shows a perspective view of the device 8 looking at the device tail 10 with the device 8 illustrated in 2 parts for clarity: the rigid frame 29 and the deformable centre 28.

Figure 23:
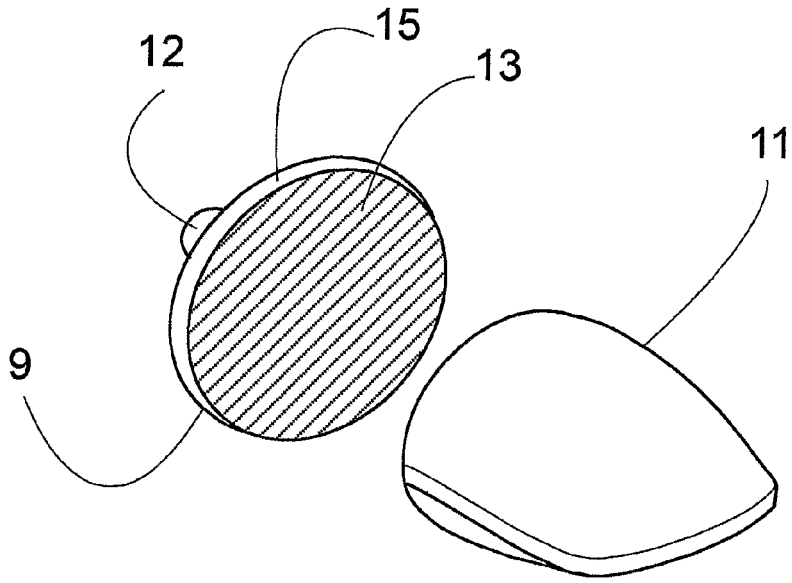

FIG. 23 shows a perspective view of the deformable centre 28 looking from the direction of the device tail 10 with the deformable body 16 illustrated in 2 parts for clarity: the device body 11 and the device top 9.

Figure 24:
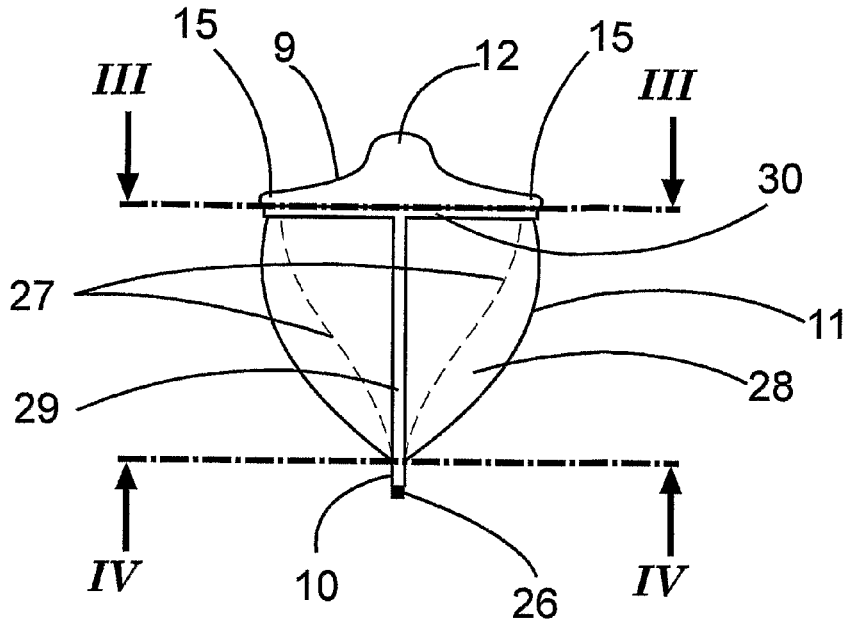

FIG. 24 shows a side view of the device 8.

Figure 25:
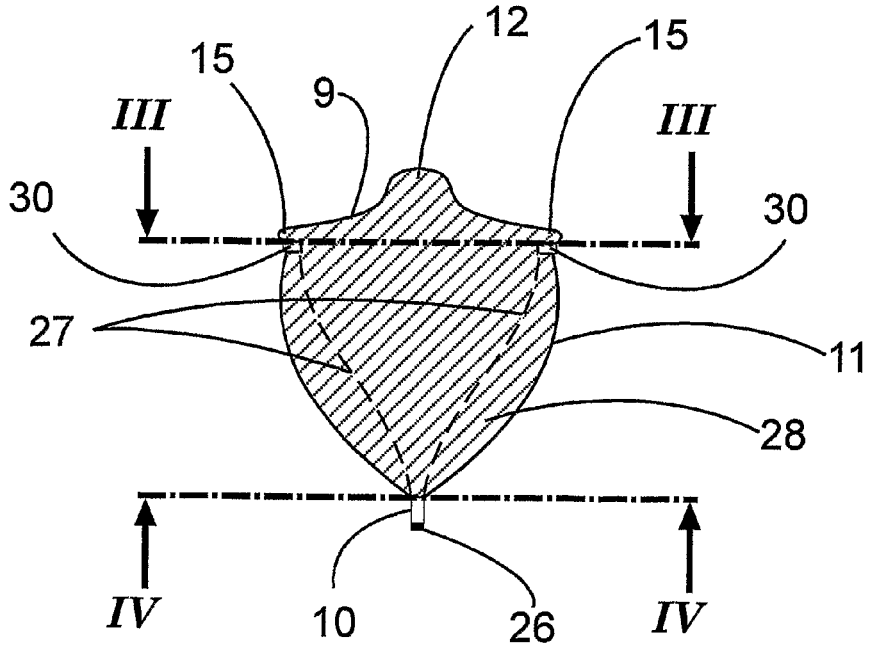

FIG. 25 shows a section through the device 8 taken from the side.

Figure 26:
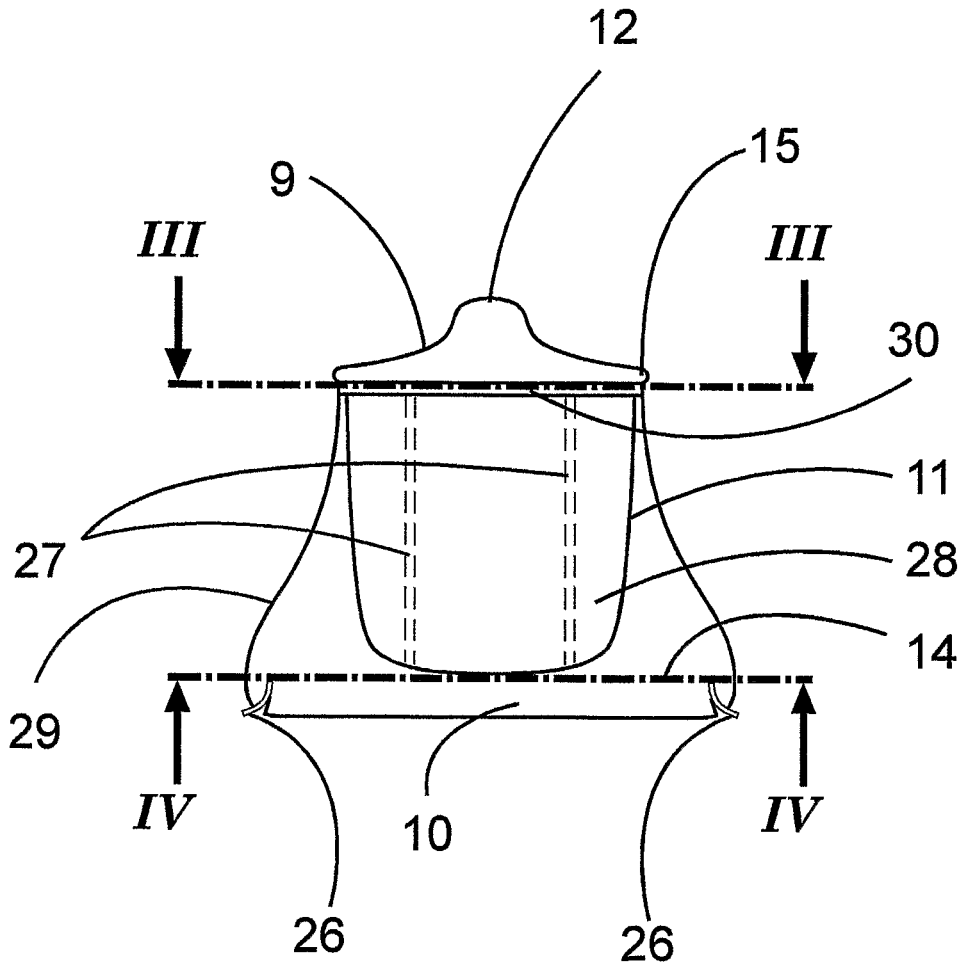

FIG. 26 shows a front view of the device 8.

Figure 27:
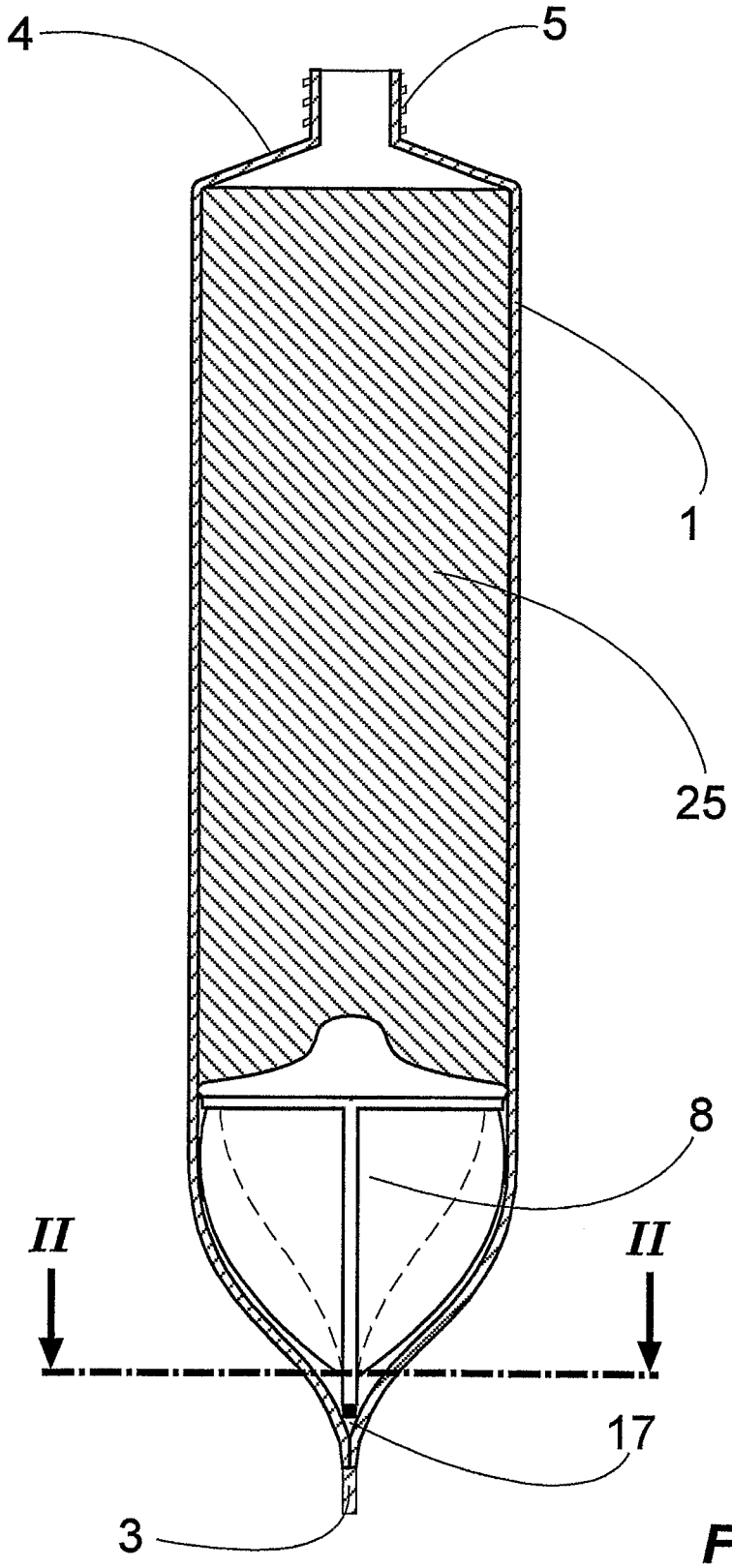

FIG. 27 shows a section through the deformable dispensing tube 1 from a side view of the deformable dispensing tube 1 with the device 8 in place at the sealed end 3 and the internal volume 25 within the deformable dispensing tube 1.

Figure 28:
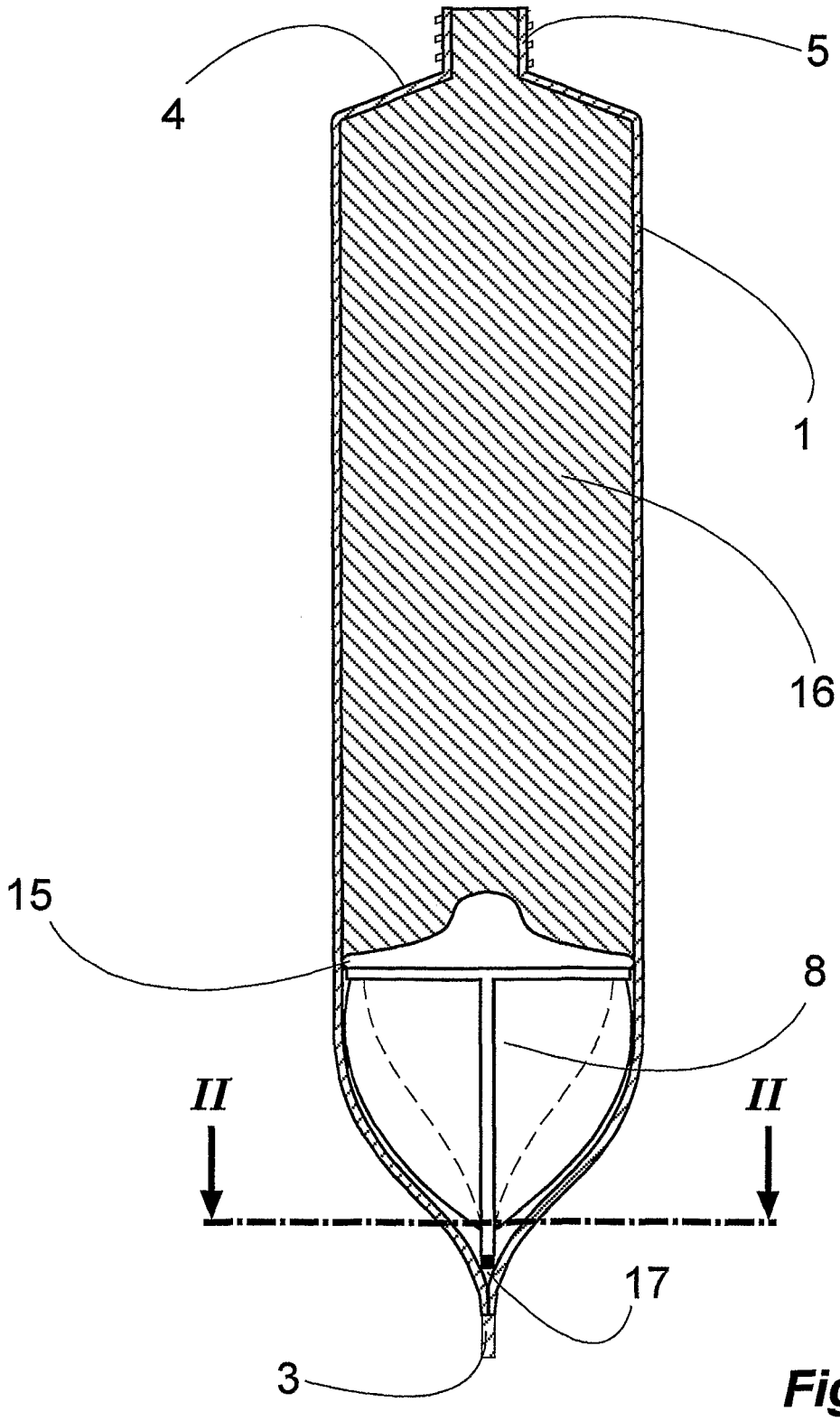

FIG. 28 shows a section through the deformable dispensing tube 1 from a side view with the device 8 in place at the sealed end 3 and the contents 16 within deformable dispensing tube 1.

Figure 29:
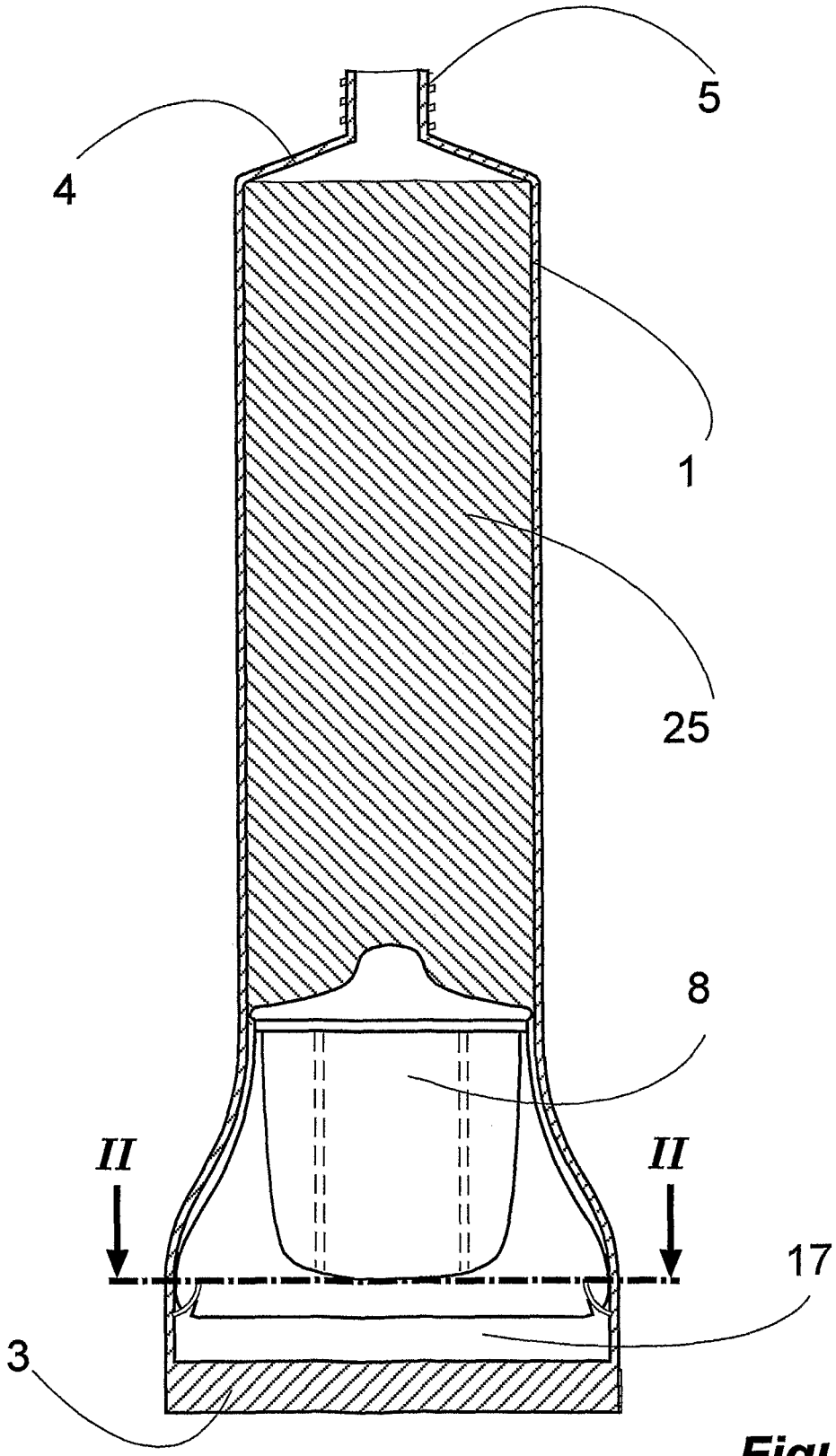

FIG. 29 shows a section through the deformable dispensing tube 1 from a front view of the deformable dispensing tube 1 with the device 8 in place at the sealed end 3 and the internal volume 25 within the deformable dispensing tube 1.

Figure 30:
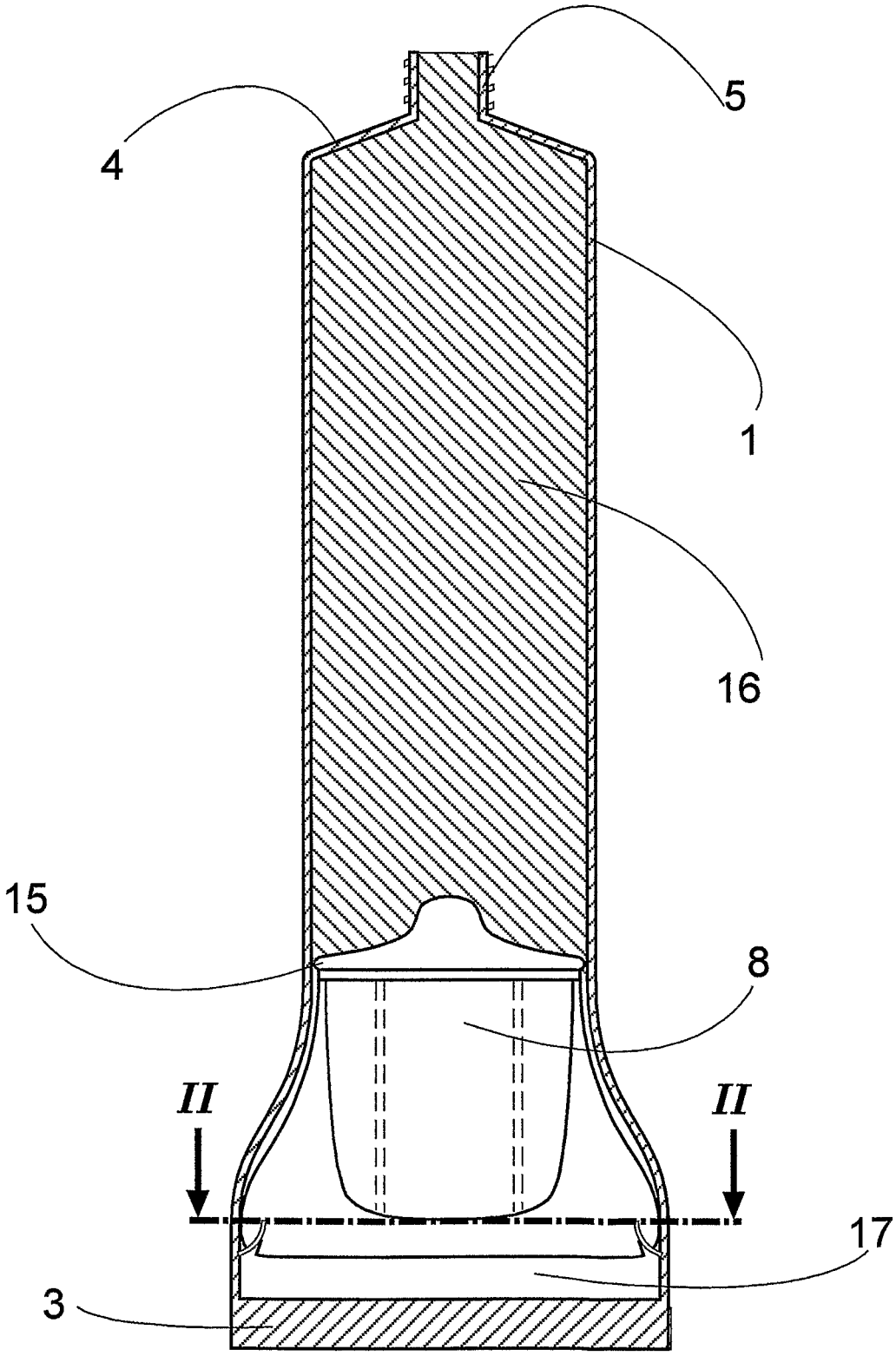

FIG. 30 shows a section through the deformable dispensing tube 1 from a front view with the device 8 in place at the sealed end 3 and the contents 16 within the deformable dispensing tube 1.

Figure 31:
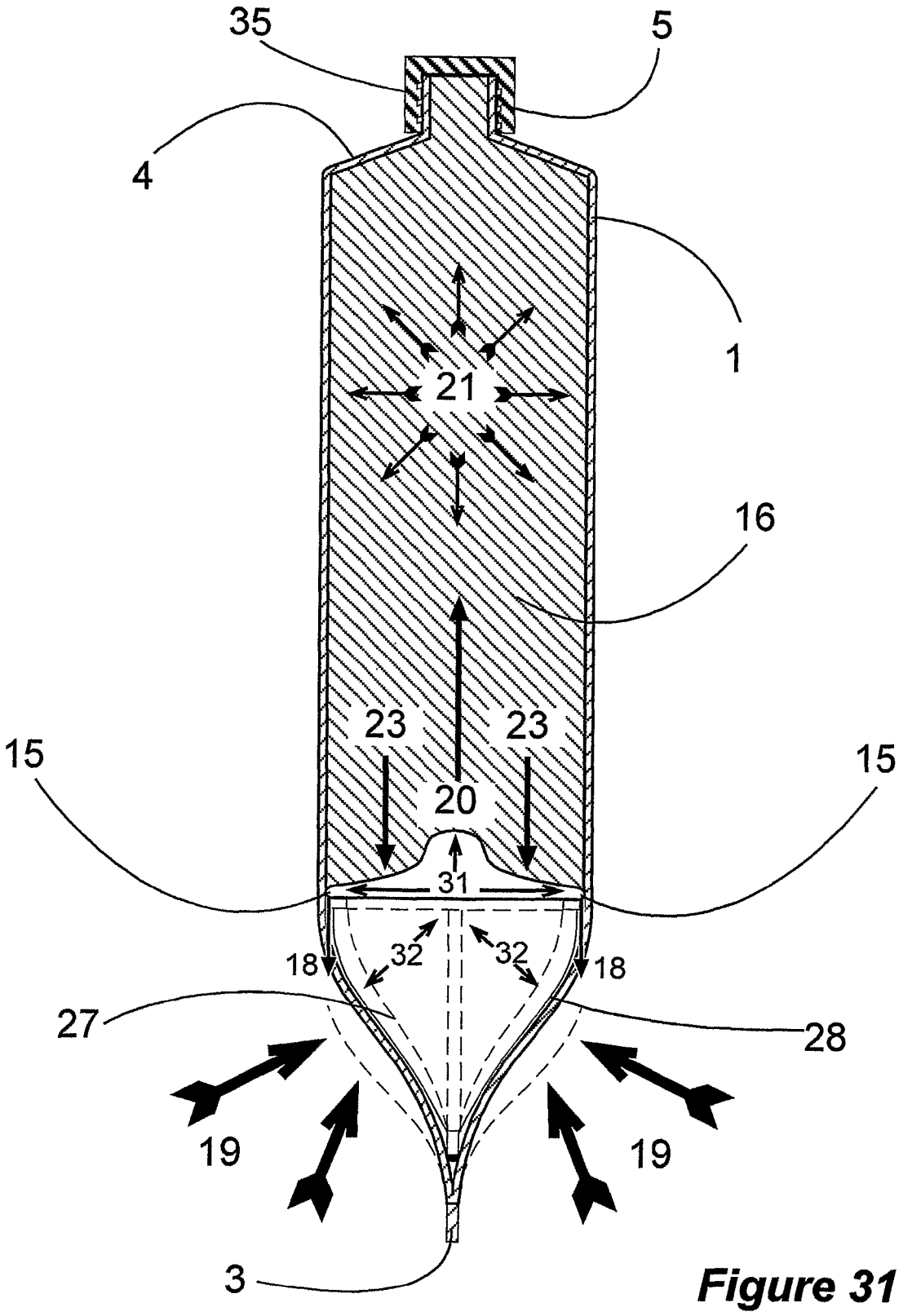

FIG. 31 shows a section through the deformable dispensing tube 1 from a side view of the deformable dispensing tube 1 with the device 8 in place at the sealed end 3, the orifice 5 sealed and external forces 19 acting.

Figure 32:
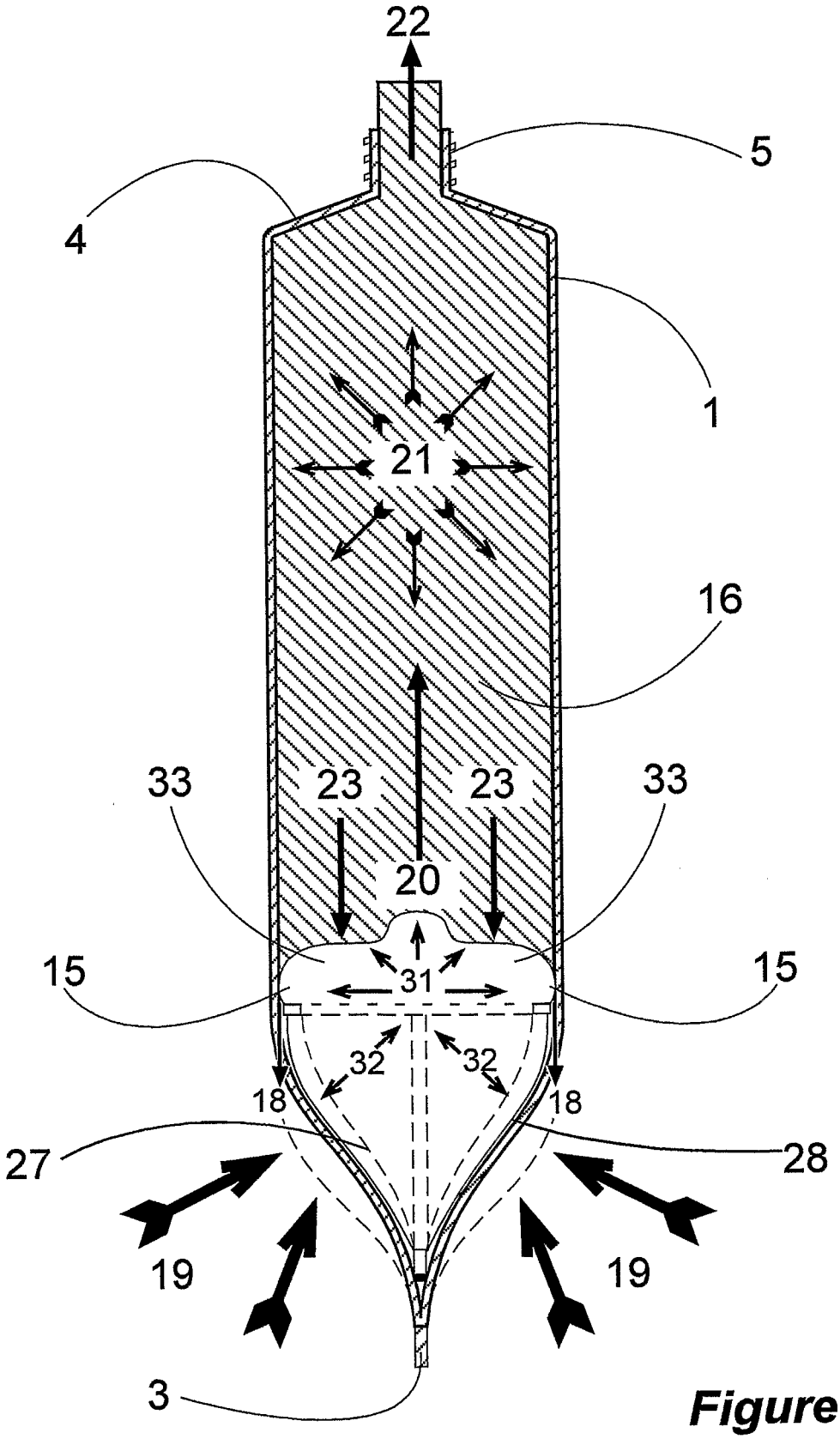

FIG. 32 shows a section through the deformable dispensing tube 1 from a side view of the deformable dispensing tube 1 with the device 8 in place at the sealed end 3, the orifice 5 un-sealed and external forces 19 acting.

Figure 33:
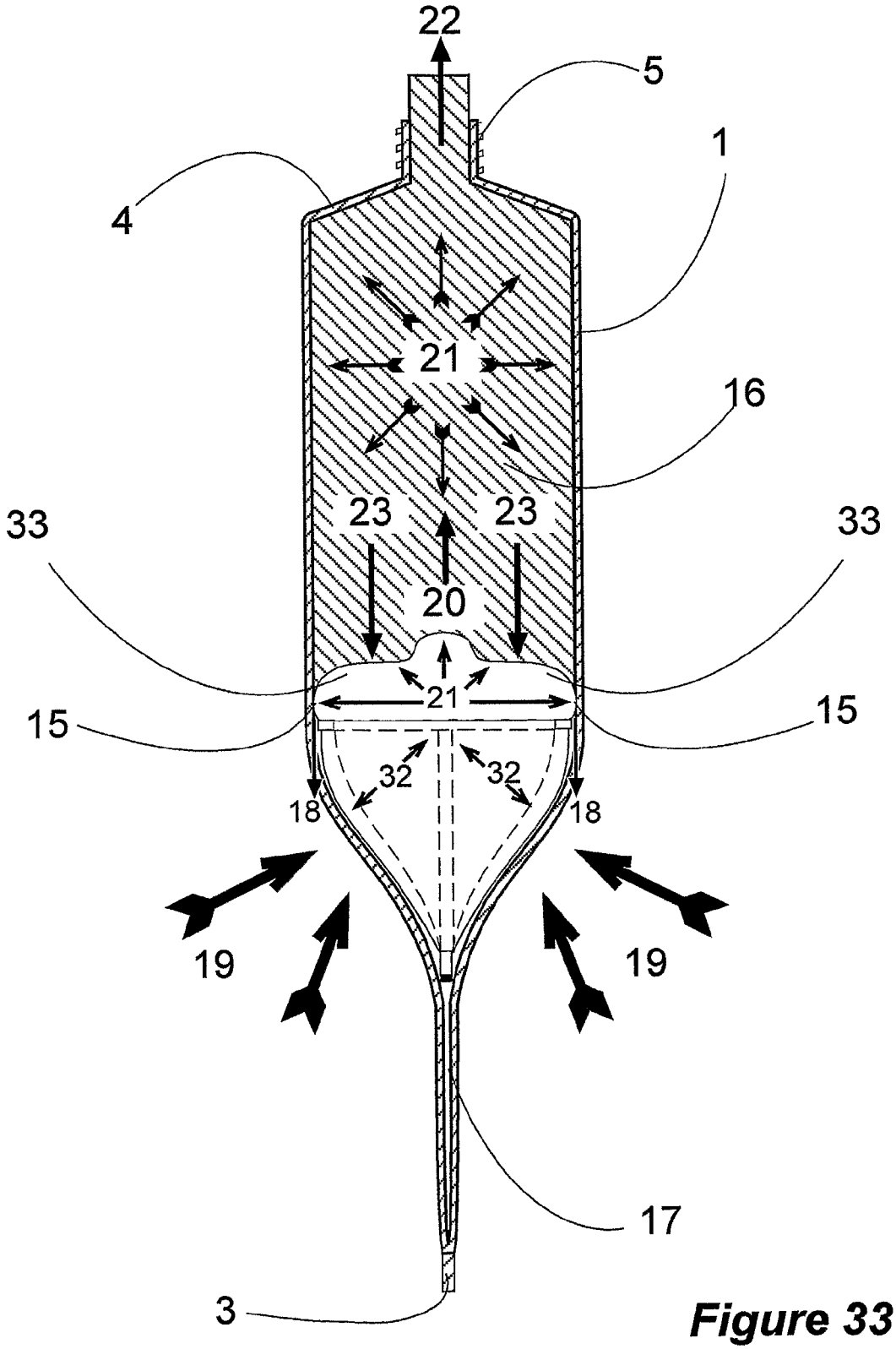

FIG. 33 shows a section through the deformable dispensing tube 1 from a side view of the deformable dispensing tube 1 with the device 8 in place at a point approximately halfway between the sealed end 3 and the formed opening 4, the orifice 5 un-sealed and external forces 19 acting.

Figure 34:
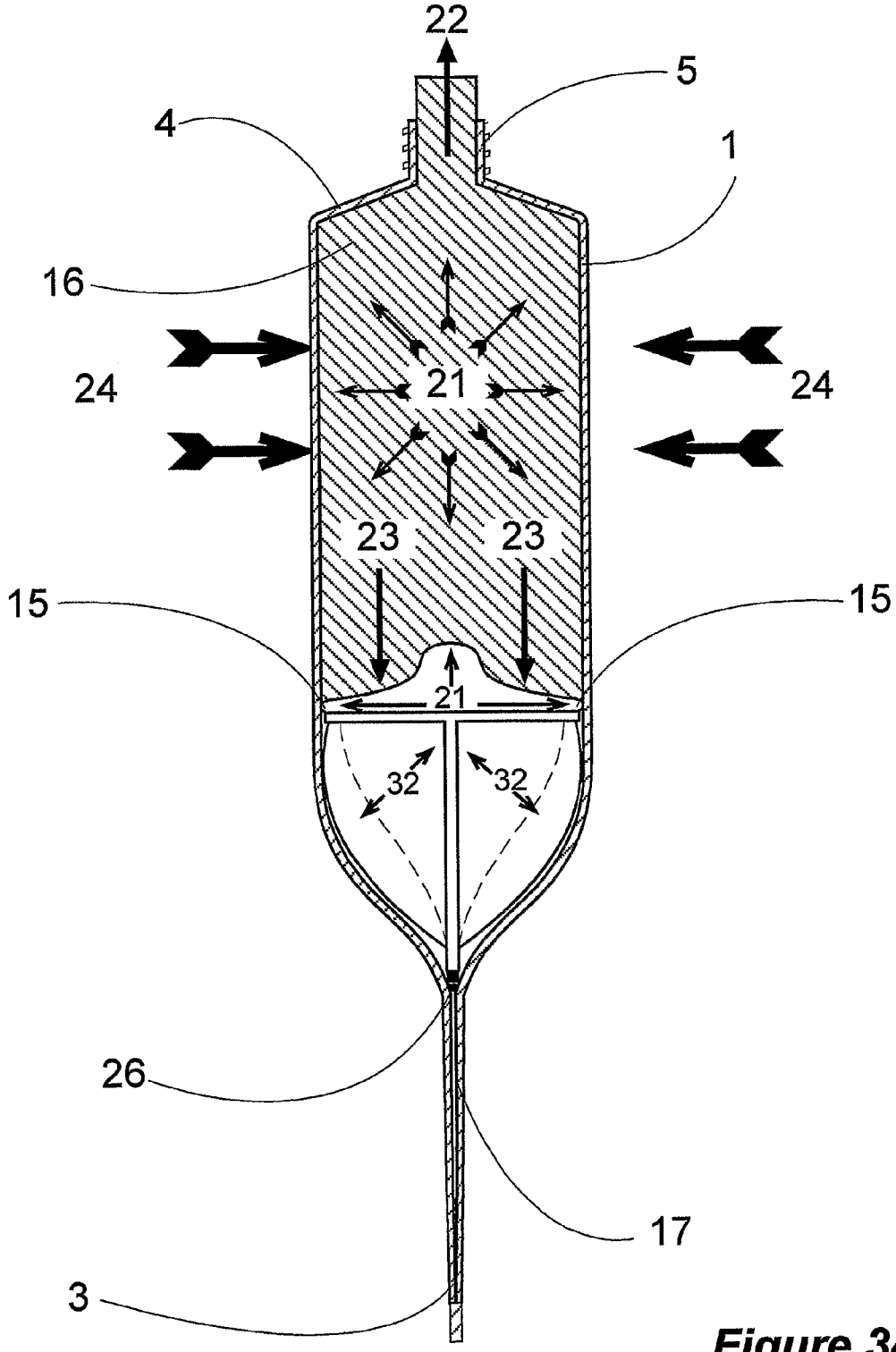

FIG. 34 shows a section through the deformable dispensing tube 1 from a side view of the deformable dispensing tube 1 with the device 8 in place at a point approximately halfway between the sealed end 3 and the formed opening 4, the orifice 5 un-sealed and pressure 24 acting.

Figure 35:
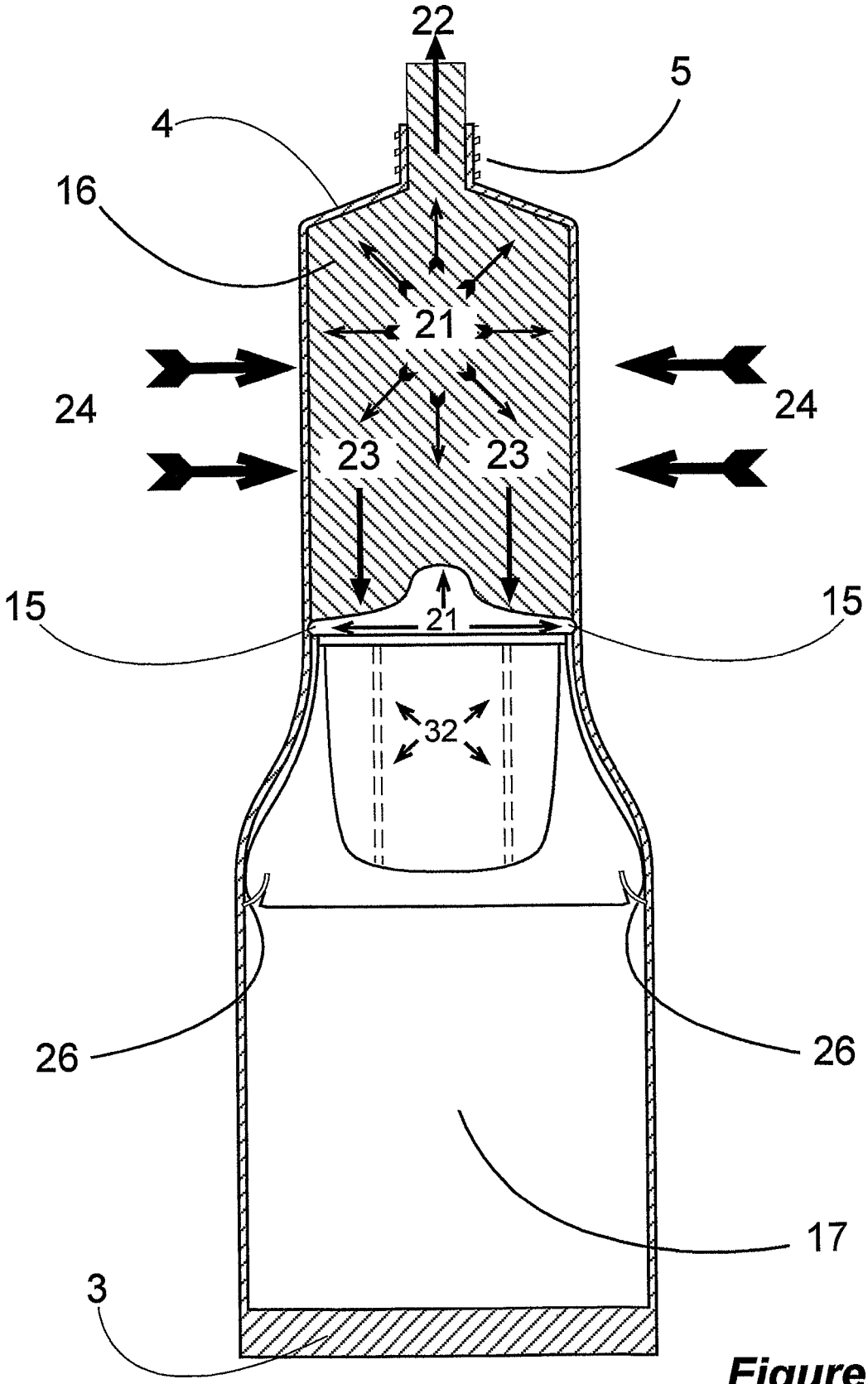

FIG. 35 shows a section through the deformable dispensing tube 1 from a front view of the deformable dispensing tube 1 with the device 8 in place at a point approximately halfway between the sealed end 3 and the formed opening 4, the orifice 5 un-sealed and pressure 24 acting.

Figure 36:
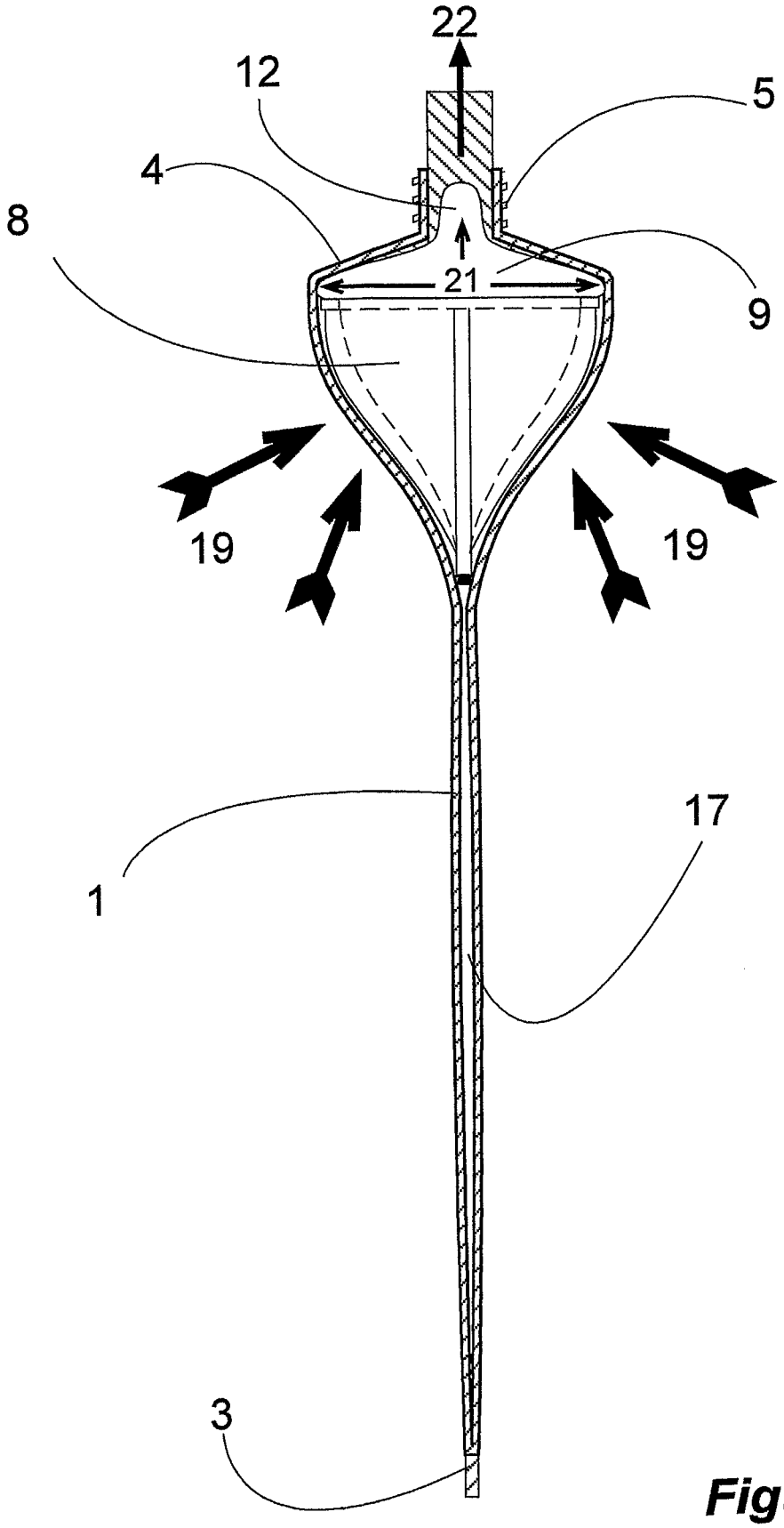

FIG. 36 shows a section through the deformable dispensing tube 1 from a side view of the deformable dispensing tube 1 with the device 8 in place at the formed opening 4, the orifice 5 un-sealed and external forces 19 acting.

Figure 37:
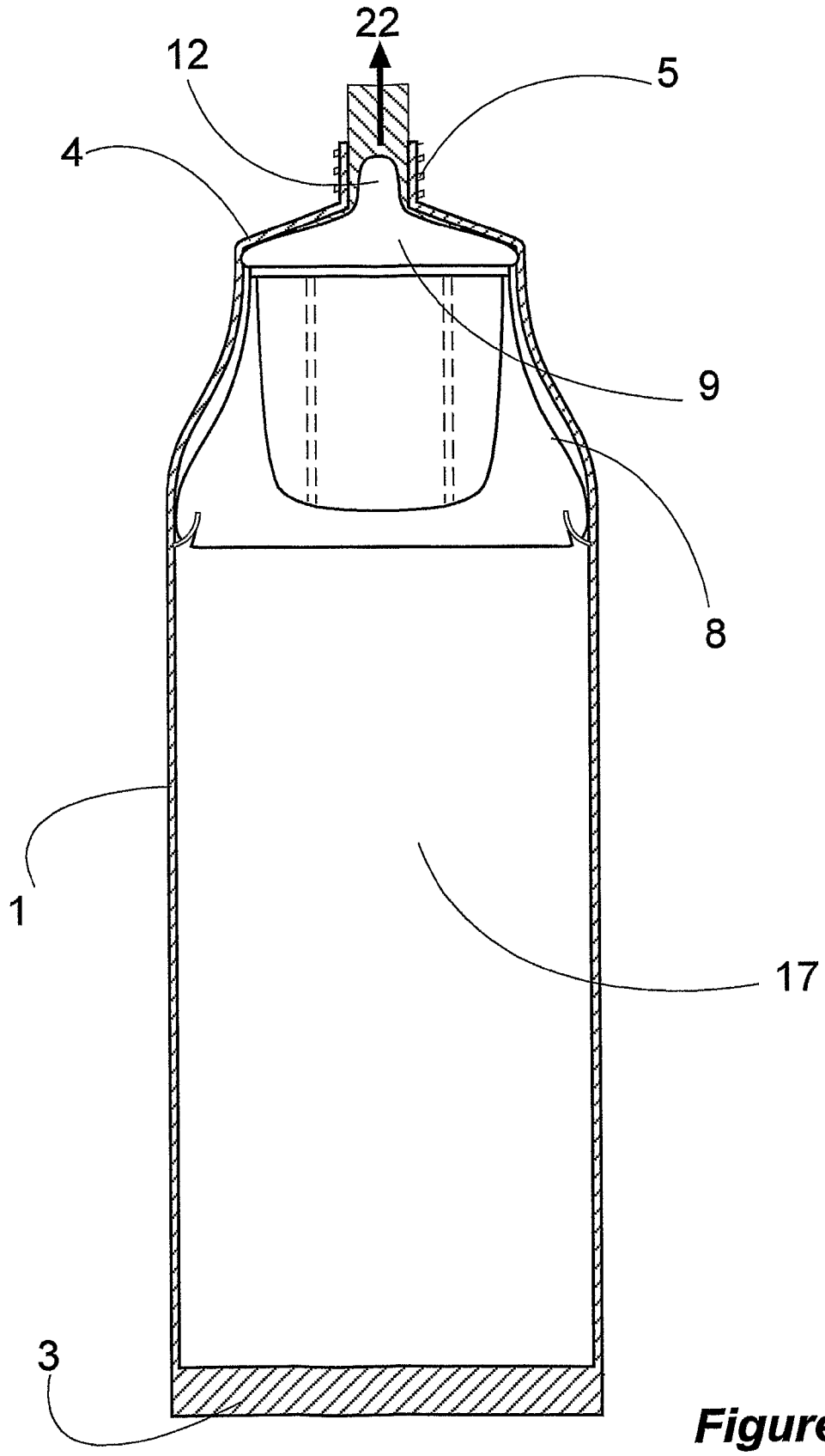

FIG. 37 shows a section through the deformable dispensing tube 1 from a front view of the deformable dispensing tube 1 with the device 8 in place at the formed opening 4, the orifice 5 un-sealed.

Figure 38:
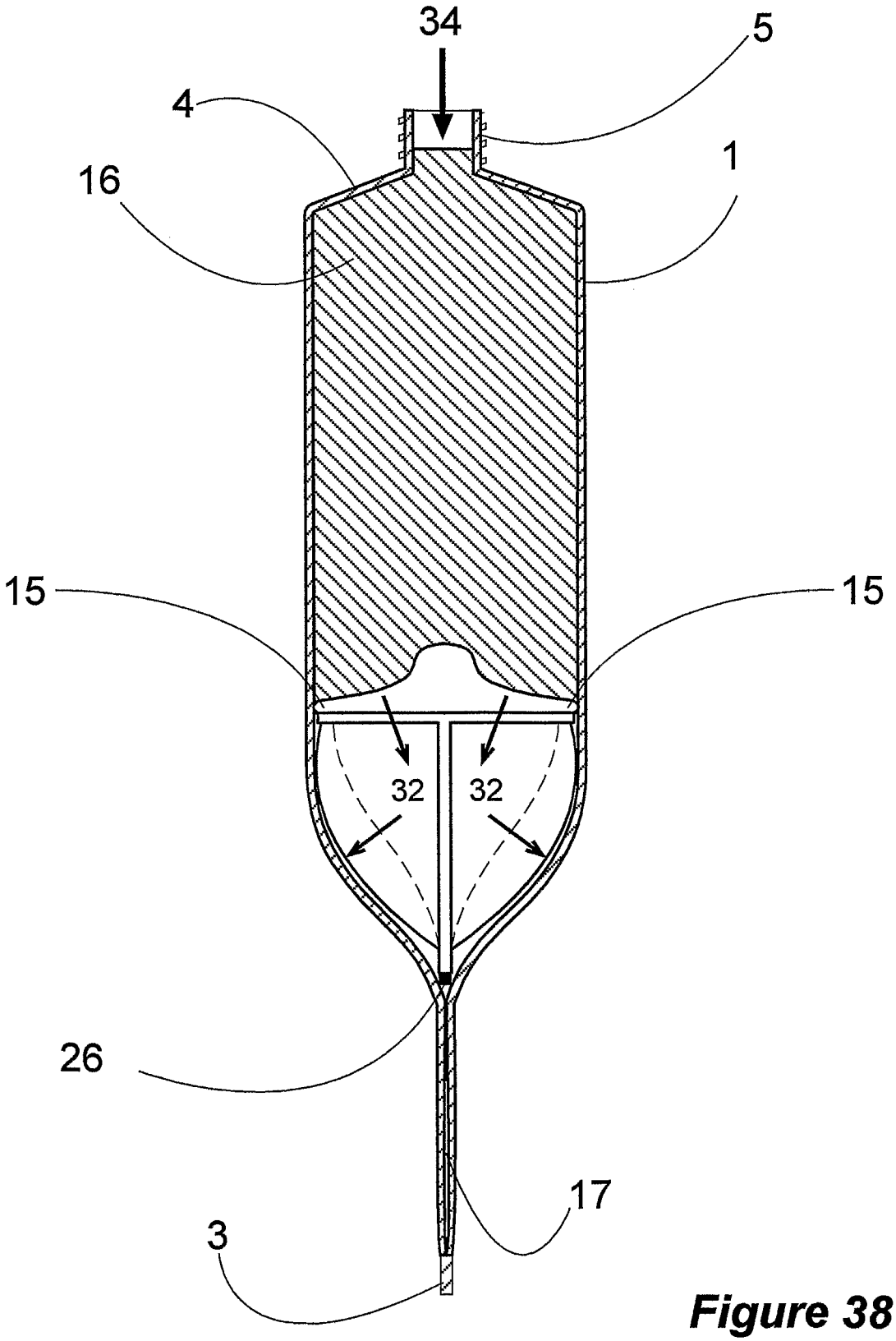

FIG. 38 shows a section through the deformable dispensing tube 1 from a side view of the deformable dispensing tube 1 with the device 8 in place at a point approximately halfway between the sealed end 3 and the formed opening 4 with content retraction 34 acting.

Embodiment B of the invention is a device, hereinafter referred to as the device 8, provided as a separate insert to existing deformable dispensing tubes. A description of a typical deformable dispensing tube is given in reference to the inclusion and working of the device 8. Such a deformable dispensing tube will hereinafter referred to as the deformable dispensing tube 1.

The deformable dispensing tube 1 has a deformable body 2, which is hollow. At one end of the deformable body 2 is a sealed end 3 and at the opposing end of the deformable body 2 is a formed opening 4, which is hollow. Although shown separated in FIG. 2 for clarity the deformable body 2, the sealed end 3 and the formed opening 4 form the deformable dispensing tube 1 as a homogenous whole when the deformable dispensing tube 1 is in its finished manufactured state.

The formed opening 4 has at one end a formed orifice 5 for the opening and re-sealing the formed opening 4, thereby allowing the dispensing of the contents 16 of the deformable dispensing tube 1.

The formed opening 4 transforms in shape and size from the formed orifice 5 into a larger shape where it meets the deformable body 2. The meeting point of the formed opening 4 and the deformable body 2 is herein after referred to as cross-section 6 and is shown hatched on FIG. 2 and is referenced by the line I-I on FIG. 3 and by the line I-I on FIG. 4.

The formed opening 4 varies in rigidity and is substantially more rigid than the deformable body 2, thereby forcing the deformable body 2 to adopt the same shape and size at cross-section 6.

The sealed end 3 is formed by flattening and then permanently sealing or fusing together the material of the deformable dispensing tube 1 at that point such that an internal volume or space can no longer exist within the deformable dispensing tube 1.

By sealing the deformable dispensing tube 1 at the sealed end 3 the deformable body 2 is forced to adopt a certain cross-section as it nears the sealed end 3. The hollow cross section formed by the deformable body 2 in the area just before it becomes part of the sealed end 3 is hereinafter referred to as cross-section 7 and is shown hatched on FIG. 2 and is referenced by the line II-II on FIG. 3 and by the line II-II on FIG. 4.

The volume between cross-section 7 and the sealed end 3 is hereinafter referred to as the void 17.

The deformable body 2 therefore transforms in shape from the cross-section 6 to the cross-section 7 along the length of the deformable body 2 thereby giving the deformable body 2 an internal volume.

The device 8 is a formed three-dimensional moulded part that combines a rigid frame 29 with a deformable centre 28. It is envisaged that the rigid frame 29 and the deformable centre 28 will form a co-moulding although they could equally be moulded as separate parts and subsequently assembled together. FIG. 22 shows the device 8 with the deformable centre 28 and the rigid frame 29 separated for clarity.

The deformable centre 28 comprises the device top 9 and the device body 11 that have been shown separated in FIG. 23 for clarity. The deformable centre 28 will be made from a material or materials that will allow it to be compressed in one direction while correspondingly expanding or elongating in another direction.

A suitable material may be an elastomer material, a foamed rubber material, a gel type material, a formed outer skin with a fluid or gel filled centre or any combination of such.

The rigid frame 29 comprises the device tail 10, the tapered walls 27, the device collar 30 and the non-return features 26. The rigid frame 29 will most likely be moulded from plastic.

The device tail 10 has at its widest point the cross-section 14 shown hatched on FIG. 22 and FIG. 23 and is referenced by the line IV-IV on FIG. 24, the line IV-IV on FIG. 25 and by the line IV-IV on FIG. 26. It is at the device tail that the non-return features 26 are located.

The non-return features 26 may be integrally moulded to the rigid frame 29 or may be formed as separate parts from alternative materials.

At the opposing end of the rigid frame 29 from the device tail 10 is the device collar 30. The device collar 30 has an outer circumference that is coincident with the cross section 13 on the deformable centre 28 when the two parts are moulded or assembled together. The cross-section 13 is shown hatched on FIG. 22 and FIG. 23 and is referenced by the line III-III on FIG. 24, the line III-III on FIG. 25 and by the line III-III on FIG. 26. The tapered walls 27 run from the device collar 30 to the device tail 10 shown in FIG. 22.

The device top 9 and the device body 11 are described separately for clarity but are a single homogenous part. With reference to FIGS. 24, 25 and 26, the device top 9 consists of the device plug 12 that transforms into the larger flexible seal 15 before reducing slightly to the cross-section 13 that has an outer circumference that is coincident with the outer circumference of the device collar 30 on the rigid frame 29 when the two parts are moulded or assembled together. The cross-section 13 is shown hatched on FIG. 22 and FIG. 23 and is referenced by the line III-III on FIG. 24, the line III-III on FIG. 25 and by the line III-III on FIG. 26. The flexible seal 15 will be of similar shape to the cross-section 13 but of slightly larger size than the cross-section 13.

The device collar 10 has an aperture within it through will the device body 11 is located. The device body 11 sits within the dimensions of the cross section 13 and transforms smoothly to meet the device tail 10 as shown in FIG. 20 and FIG. 21. When the rigid frame 29 and the deformable centre 28 are moulded together or assembled together the tapered walls 27 sit within the volume or outline of the device body 11 as illustrated by the dashed lines of the tapered wall in FIGS. 21, 24 and 25.

The device tail 10 is formed from the cross-section 14 tapering or rounding into an end in the direction directly away from the device collar 30, as shown in FIGS. 22 and 26. The shape and size of the device tail 10 is such that it will fit into the void 17 when the device 8 is in place within the deformable dispensing tube 1 at the sealed end 3 as shown in FIG. 27 and FIG. 29.

The cross-section 14 at the device tail 10 matches in shape and size the internal shape and internal size of the cross-section 7 of the deformable dispensing tube 1.

When the device 8 is in place within the deformable dispensing tube 1, the cross-section 14 at the device tail 10 forces the deformable body 2 to adopt an internal cross-section the same shape and size as the cross-section 14 at any point along the deformable body 2's length at which the device tail 10 and the deformable body 2 are in contact or are coincident.

The device collar 30 and corresponding cross-section 13 match in shape and size the internal shape and internal size of the cross-section 6 of the deformable dispensing tube 1.

When the device 8 is in place within the deformable dispensing tube 1, the device collar 30 and corresponding cross-section 13 force the internal cross-section of the deformable body 2 to adopt to the same shape and size as the device collar 30 at any point along the deformable body 2's length at which the device collar 30 and the deformable body 2 are in contact or are coincident.

FIG. 27 and FIG. 29 show the device 8 situated inside of the deformable dispensing tube 1 at the sealed end 3. The internal volume 25 is created inside the deformable dispensing tube 1 between the device top 9 and the formed opening 4. The contents 16 are contained within the internal volume 25 and partly within the formed opening 4 as shown in FIG. 28 and FIG. 30. The void 17 will be partly occupied with the device tail 10.

The fit between the internal surface of the deformable body 2 and the collar 30 of the device 8 is such that a seal is formed between the internal surface of the deformable body 2 and the device 8 thereby preventing any transgression by the contents 16 even when under pressure.

When as part of the assembly that makes device 8 and not under any pressure or force, the flexible seal 15 will be of similar shape to cross-section 13 but of slightly larger size than the cross-section 13. It follows that the cross-section of the flexible seal 15 is also slightly larger than the internal cross-section of the deformable body 2 formed by the presence of the device 8 within the deformable body 2.

When the device 8 is in place within the deformable dispensing tube 1, the flexible seal 15 is compressed to fit within the internal cross-section of the deformable body 2.

The flexible seal 15 having been compressed to fit within the deformable dispensing tube 1 is under pressure against the internal surface of the deformable body 2 thereby providing enhanced or further sealing against any transgression by the contents 16 while still allowing the device 8 to move freely within the dispensing tube 1.

When as part of the assembly that makes device 8 and not under any pressure or force, the non-return features 26 are flexible parts that have external dimensions greater than those of the cross-section 14 and the corresponding cross-section 7 into which they must fit.

When the device 8 is in place within the deformable dispensing tube 1, the non-return features 26 are compressed to fit within the cross-section 7 in such a manner that if the device 8 is moved in the direction of the formed opening 4 the non-return features are compressed further thereby still allowing the device 8 to move freely within the dispensing tube 1. However, if the device 8 begins to move in the direction away from the formed opening 4 and towards the sealed end 3 the non-return features 26 are forced against or into the internal surface of the deformable dispensing tube 1 thereby locking the device 8 at that point and preventing the device 8 from moving any further in the direction of the sealed end 3.

The outer shape of the device top 9 will be of such a shape and size or can deform to such a shape and size that it can move inside of the formed opening 4 of the deformable dispensing tube 1 in such a manner that it expels as much of the contents 16 as is feasible, as shown in FIG. 36 and FIG. 37.

The device plug 12 of the device top 9 will be of such a shape and size or can deform to such a shape and size that it can move inside of the formed orifice 5 while still allowing the contents 16 to be expelled, as shown in FIG. 36 and FIG. 37.

With reference to FIG. 31, the user applies external pressure directly or indirectly to the outside of the deformable dispensing tube 1 as indicated by the arrows at 19. A result of the external pressure 19 acting on the device 8 through the deformable dispensing tube 1 will be to create a resultant force 20 within the device 8 in the direction of the formed opening 4. The resultant force 20 in turn acts through the device 8 onto the contents 16 thereby creating an internal pressure 21 within contents 16 contained within the deformable dispensing tube 1. The cap 35 is shown as a method of sealing the orifice 5.

In order to transfer the external pressure 19 into the resultant force 20 that acts on the contents 16 the deformable centre 28 will become subject to internal forces or internal pressure 31 hereinafter referred to as the "device pressure 31".

Also, dependent on the material nature of the deformable centre 28 a further result of the external pressure 19 will be to compress or distort the deformable centre 28 as shown in FIG. 31. This compression or distortion is illustrated by the differing outlines of the non-compressed deformable dispensing tube 1 in FIG. 28 compared with the compressed deformable dispensing tube 1 in FIG. 31. This compression or distortion is also illustrated by the differing outlines between the dashed lines of the non-compressed deformable dispensing tube 1 indicated at 19 on FIG. 31 and the new outlines of both the deformable dispensing tube 1 and the deformable centre 28 also shown on FIG. 31. The device 8 is so designed that when the device 8 is in the afore-mentioned compressed or distorted state the resultant outer three-dimensional form the device 8 adopts is such that the external pressure 19 continues to produce the resultant force 20.

The internal pressure 21 will create an opposing force 23 on the device 8. An internal friction force 18 occurs between the device 8 and the internal surfaces of the deformable dispensing tube 1. The opposing force 23 combines with the internal friction force 18 to resist the resultant force 20.

The effects of the sealing between the device 8 and the internal surface of the deformable body 2 ensure the contents 16 remain within the internal volume 25 that is on the formed opening 4's side of the device 8. As the internal pressure 21 increases there is a corresponding increase in the device pressure 31 which will further enhance the effectiveness of the flexible seal 15.

With reference to FIG. 32, when the formed orifice 5 is un-sealed the internal pressure 21 will cause the contents 16 to begin to be expelled through the formed orifice 5, as arrowed 22.

Initially as the contents 16 are expelled from the deformable dispensing tube 1 the volume required to contain the remaining contents 16 will be reduced which in turn will create a corresponding reduction in the internal pressure 21. In this instance the resultant force 20 will not be balanced by the opposing force 23 and so will cause the deformable centre 28 to distort into the internal volume 25. The distortion of the deformable centre 28 in the direction of the resultant force 20 and towards the formed opening 4 will hereinafter be referred to as the "deformed volume 33" and is indicated as 33 in FIG. 32.

The distortion of the deformable centre 28 will result in additional forces being created or stored in the material of the deformable centre 28, these additional forces will hereinafter be referred to as the "stored force 32" and are represented by the arrows at 32 in FIG. 31 and FIG. 32.

The deformed volume 33 will continue to distort until the stored force 32 combined with the opposing force 23 balances with the resultant force 20 and the forces are in equilibrium.

Alternatively the deformed volume 33 may reach its maximum designed state of distortion at which point if the resultant force 20 is great enough it will also begin to overcome the internal friction force 18 and the device 8 as a whole unit will begin to move forward within the deformable dispensing tube 1 in the direction of the resultant force 20, that is towards the formed opening 4.

The tapered walls 27 provide a means by which the external pressure 19 can be limited in its distorting effect on the deformable centre 28.

By moving forward in this manner the device 8 will reduce the size of the internal volume 25 in line with the reduction in the volume of the remainder of the contents 16 and thereby maintain the internal pressure 21 at a level where the contents 16 will continue to be expelled through the formed orifice 5. As the device 8 moves towards the formed opening 4 the void 17 will increase in length leaving the deformable body 2 empty and in a flat or near flat state around the void 17, as shown in FIG. 33.

With reference to FIGS. 36 and 37, as the device 8 nears the formed opening 4 the shape and size of the device top 9 will distort to correspond to the internal shape and internal size of the formed opening 4 in such a manner that as much of the contents 16 are expelled as is feasibly possible. At this point, the device plug 12 is of such a shape and size or is able to distort to such a shape and size that the contents 16 are still able to flow through the formed orifice 5 even when the device plug 12 has moved inside of the formed orifice 5, as also shown in FIG. 36 and FIG. 37.

The user is able to vary the external pressure 19 in such a manner that the user can then control the rate at which the contents 16 are expelled.

When the user removes the external pressure 19 the consequent forces set up within the deformable dispensing tube 1 and the device 8 are removed in the reverse order to which they were set up.

Therefore, firstly the device 8 as a whole unit will stop moving and consequently the contents 16 will cease to flow. Secondly, the stored force 32 will retract the deformed volume 33 to its original state. At this point one of two alternatives or a combination of both can occur by design.

Either the device 8 as a whole unit can move in the direction of the formed opening 4 to fill the space occupied by the deformed volume 33. Or alternatively the contents 16 can be drawn or retracted back into the deformable dispensable tube 1 to fill the space occupied by the deformed volume 33. This movement of the contents 16 back into the deformable dispensing tube is hereinafter referred to as "content retraction 34" as is shown by arrow 34 in FIG. 38.

With reference to FIG. 34 and FIG. 35, the internal pressure 21 can also be created by an external force at 24 on the deformable body 2 between the formed opening 4 and the location of the device 8.

When an external force at 24 generates the internal pressure 21, the consequent opposing force 23 can act to move the device 8 as a whole unit in the direction of the opposing force 23 and towards the sealed end 3. The non-return features 26 will prevent the device 8 moving in the direction of the sealed end 3. Consequently the opposing force 23 will act on the deformable centre 28 to make it distort in the direction of the opposing force 23. However, the location of the deformable centre 28 to the rigid frame 29 and the constraint of the deformable body 2 will prevent any distortion or compression in the direction of the opposing force 23. Therefore if the formed orifice 5 is un-sealed the internal pressure 21 generated by an external force at 24 will result in the contents 16 being expelled through the formed orifice 5, as arrowed at 22.

As the device 8 is prevented from moving back towards the sealed end 3 by the non-return features 26 the contents 16 will always presented correctly to the formed opening 4 ready for further use.

An alternative specific embodiment of the invention, titled Embodiment C, will now be described by way of example only with reference to the accompanying drawings, FIGS. 1 through to 5 only and additional FIGS. 39 through to 56 only.

Of which:—

FIG. 1 shows a perspective view of the deformable dispensing tube 1.

FIG. 2 shows a perspective view of the deformable dispensing tube 1 with the deformable dispensing tube 1 illustrated in 3 sections: —the formed opening 4, the sealed end 3, and the deformable body 2.

FIG. 3 shows a front view of the deformable dispensing tube 1.

FIG. 4 shows a side view of the deformable dispensing tube 1.

FIG. 5 shows a section through the deformable dispensing tube 1 from a front view of the deformable dispensing tube 1.

Figure 39:
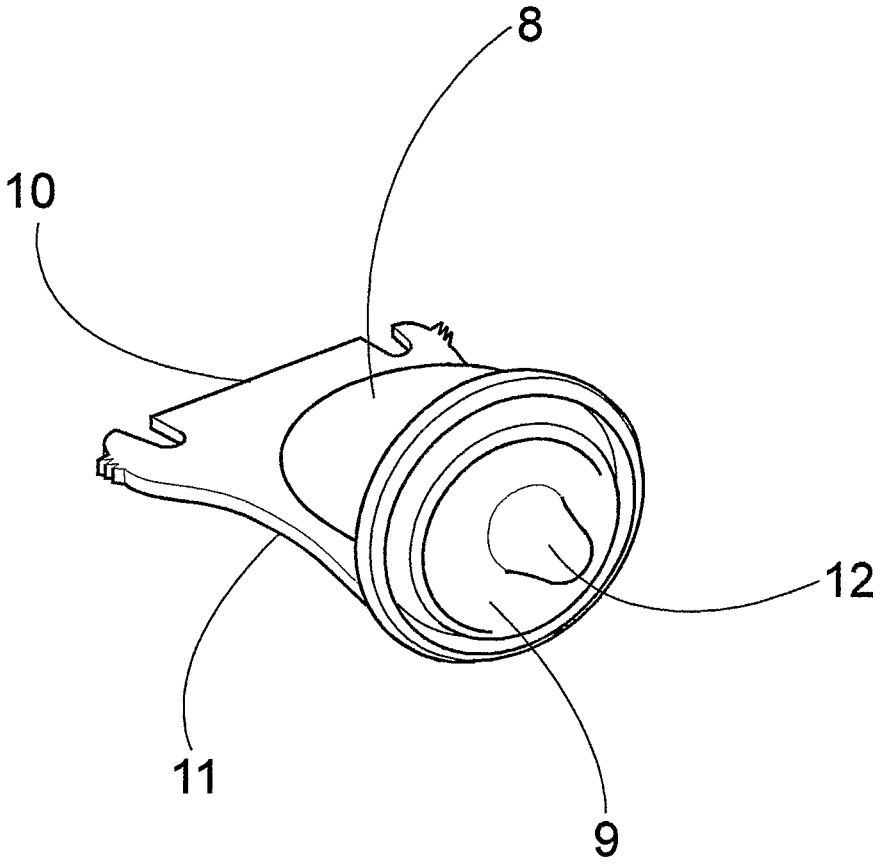

FIG. 39 shows a perspective view of the device 8 looking at the device top 9.

Figure 40:
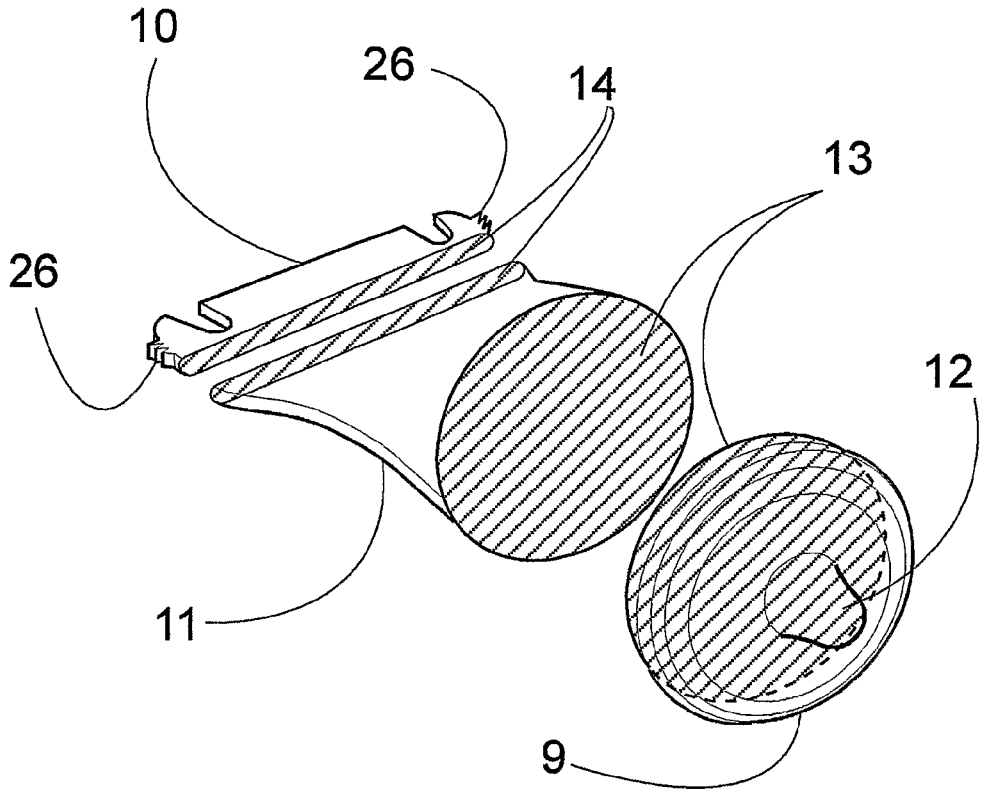

FIG. 40 shows a perspective view of the device 8 looking at the device top 9 with the device 8 illustrated as 3 sections for clarity; the device top 9, the device tail 10 and the device body 11.

Figure 41:
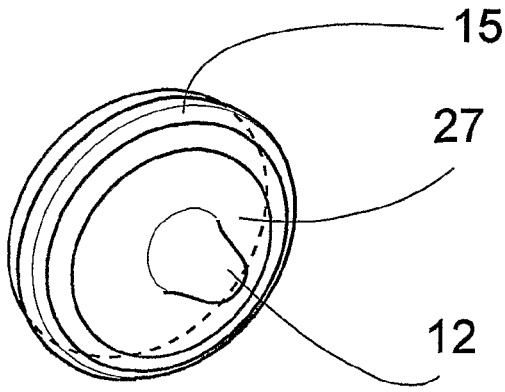

FIG. 41 shows the device top 9 separated from the rest of the device 8 for reasons of clarity.

Figure 42:
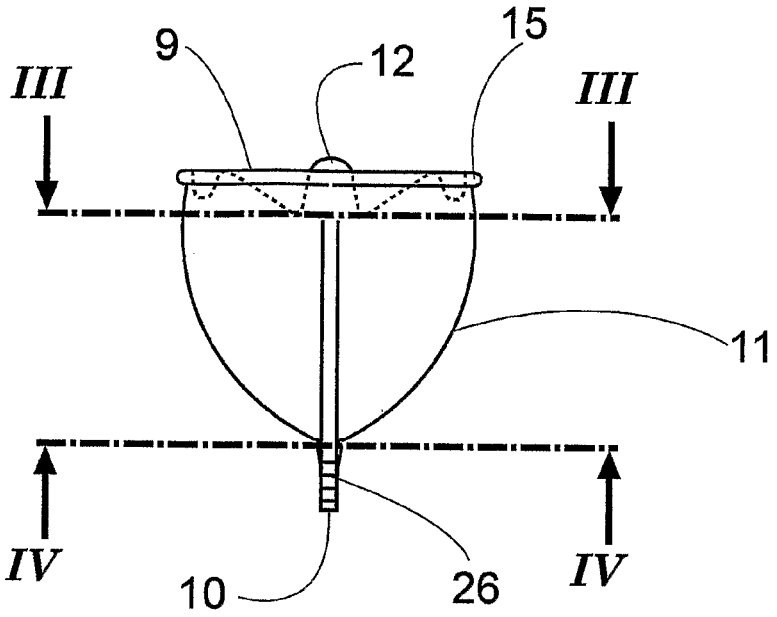

FIG. 42 shows a side view of the device 8.

Figure 43:
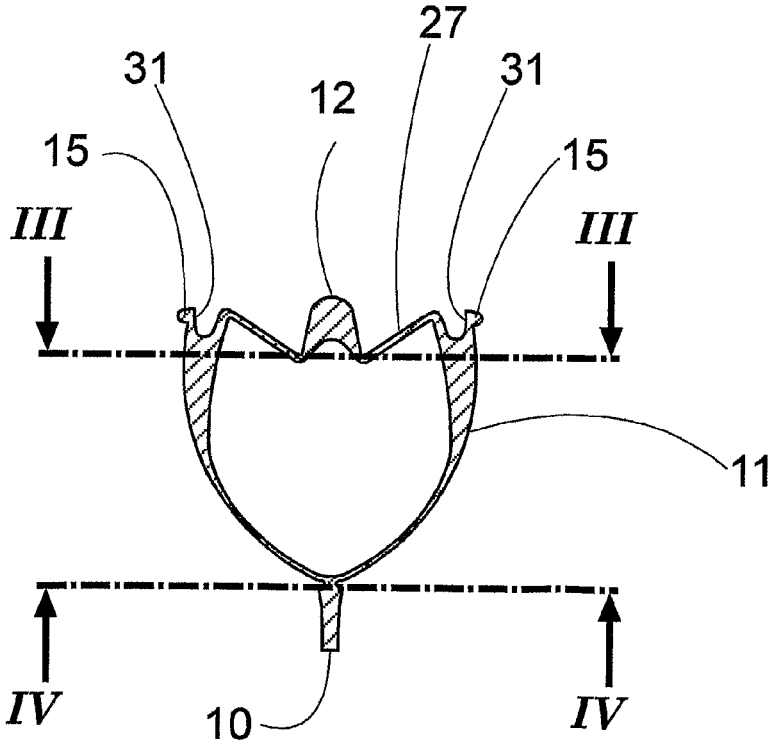

FIG. 43 shows a section through the device 8 taken from the side view.

Figure 44:
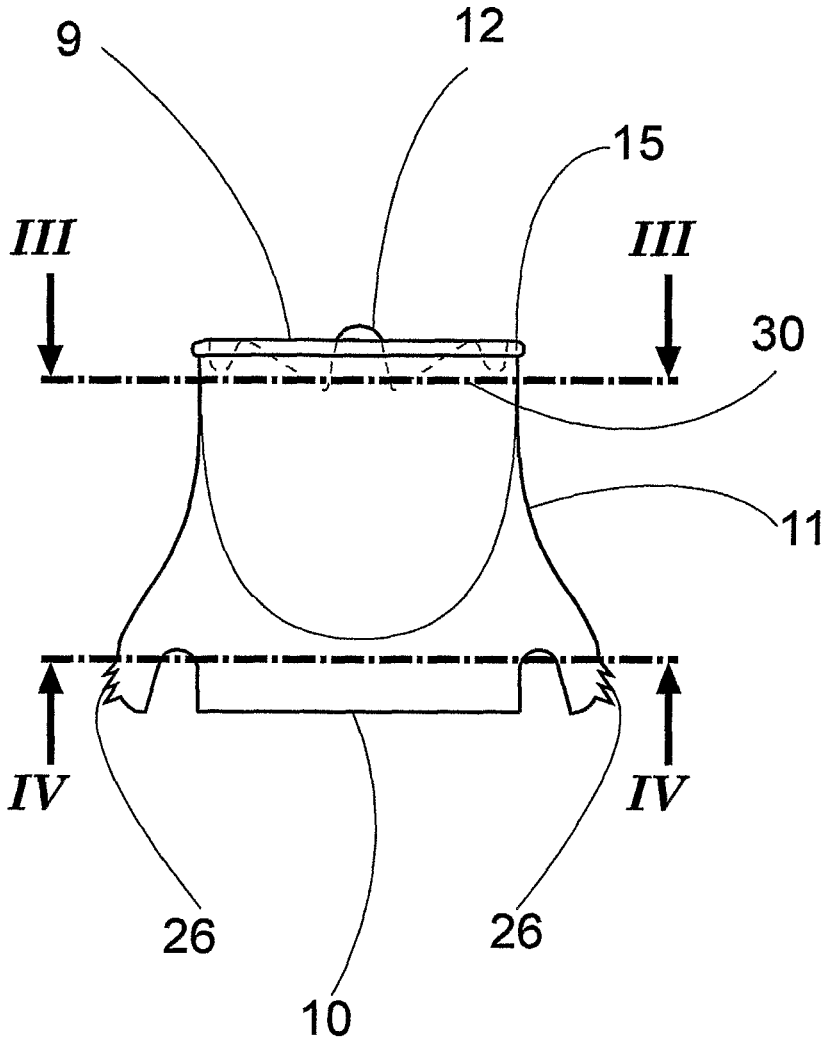

FIG. 44 shows a front view of the device 8.

Figure 45:
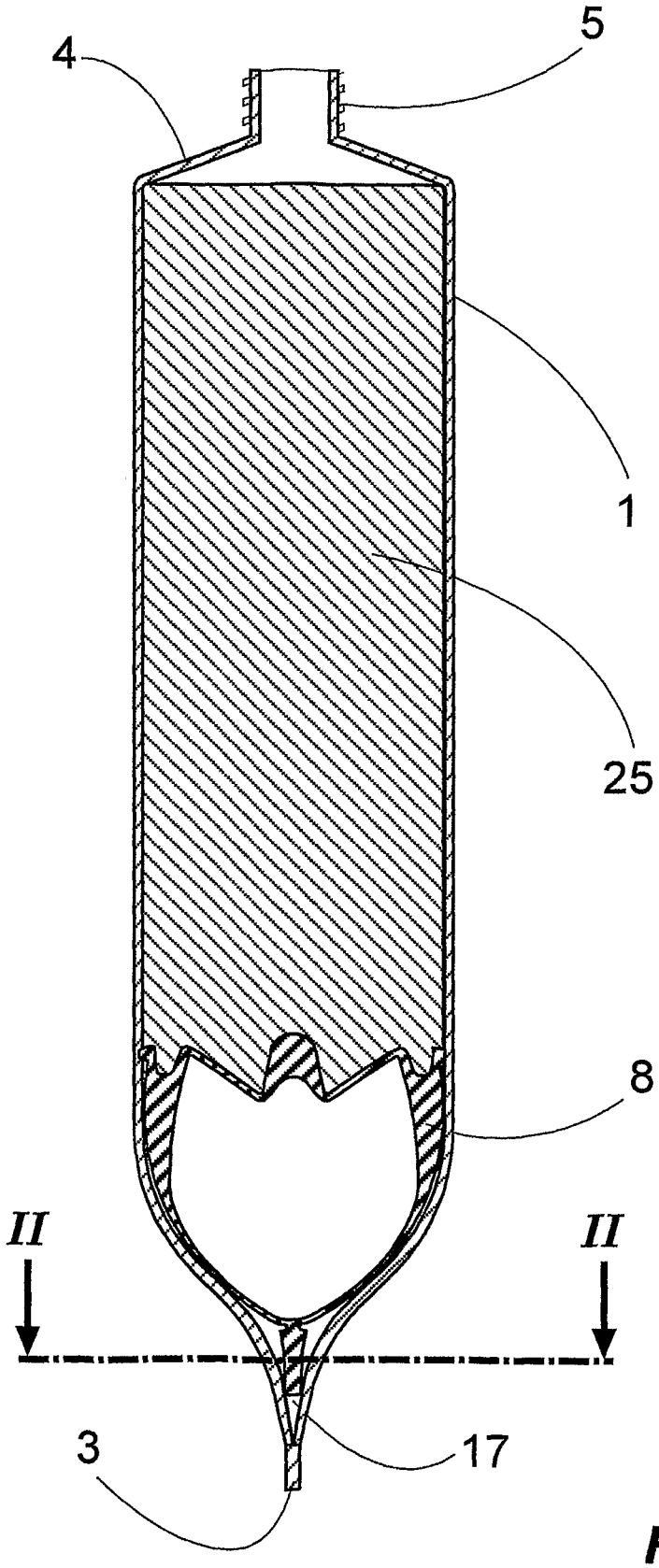

FIG. 45 shows a section through the deformable dispensing tube 1 from a side view of the deformable dispensing tube 1 with the device 8 (also sectioned) in place at the sealed end 3 and the internal volume 25 within the deformable dispensing tube 1.

Figure 46:
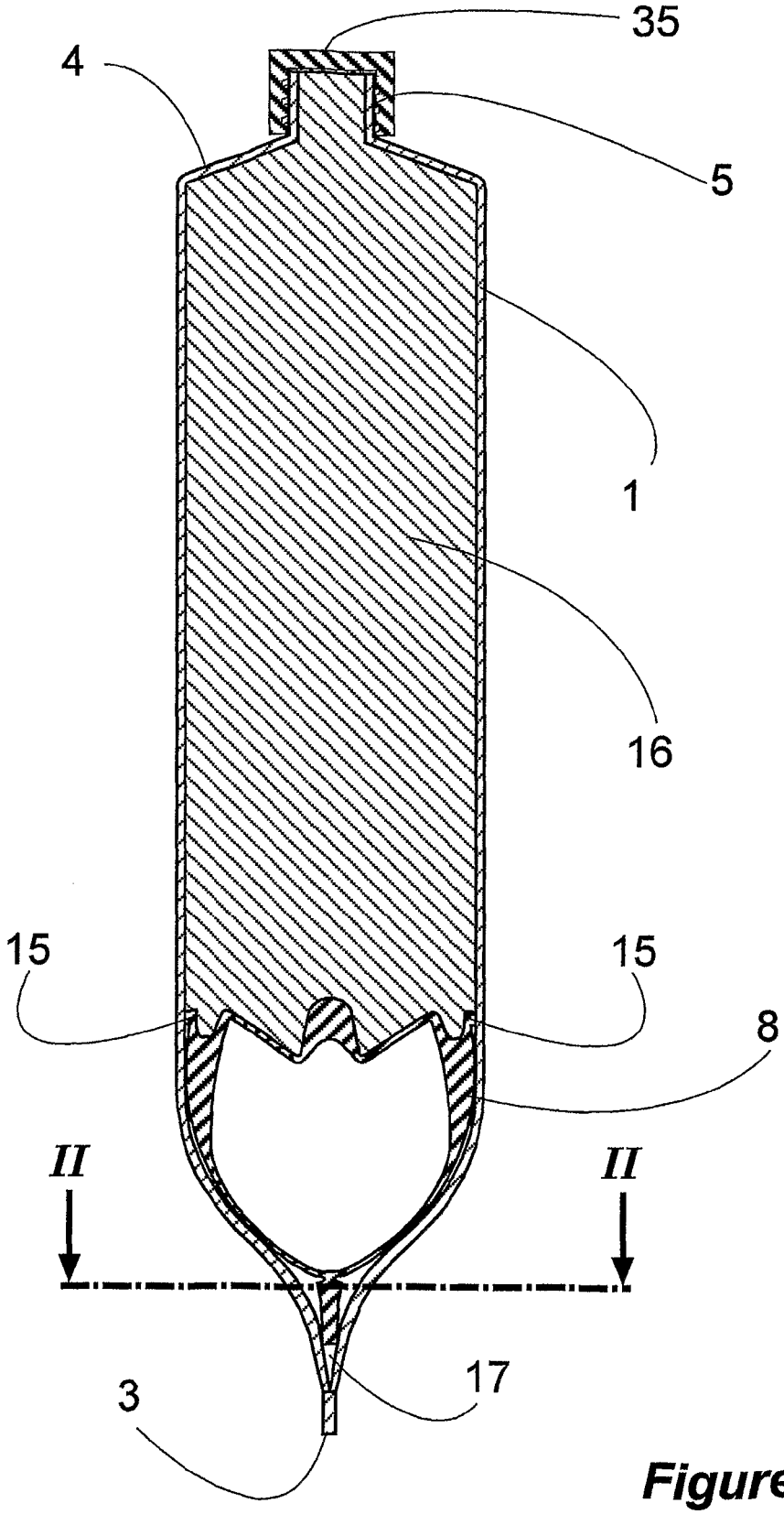

FIG. 46 shows a section through the deformable dispensing tube 1 from a side view with the device 8 (also sectioned) in place at the sealed end 3, the orifice 5 sealed and the contents 16 within deformable dispensing tube 1.

Figure 47:
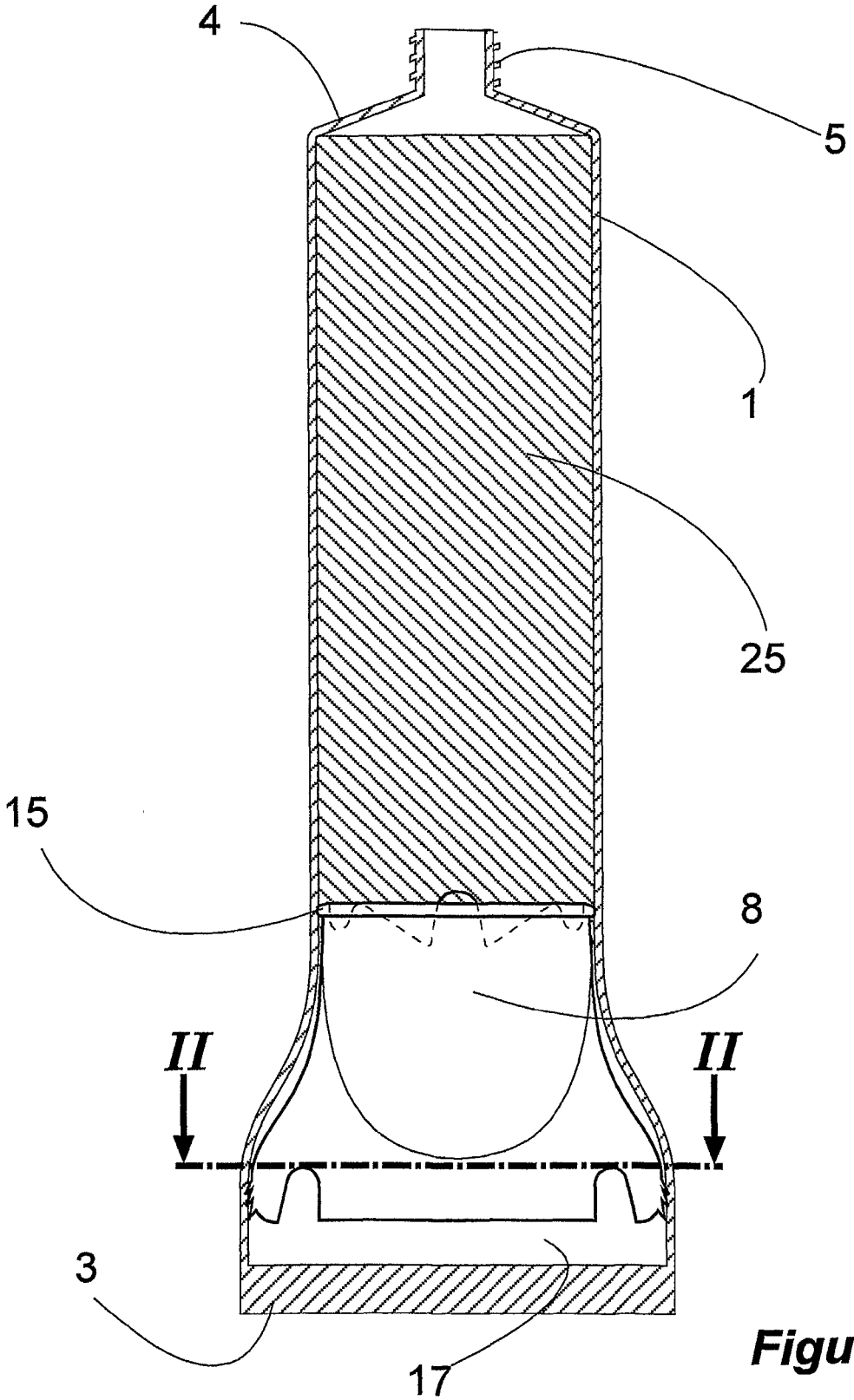

FIG. 47 shows a section through the deformable dispensing tube 1 from a front view of the deformable dispensing tube 1 with the device 8 in place at the sealed end 3 and the internal volume 25 within the deformable dispensing tube 1.

Figure 48:
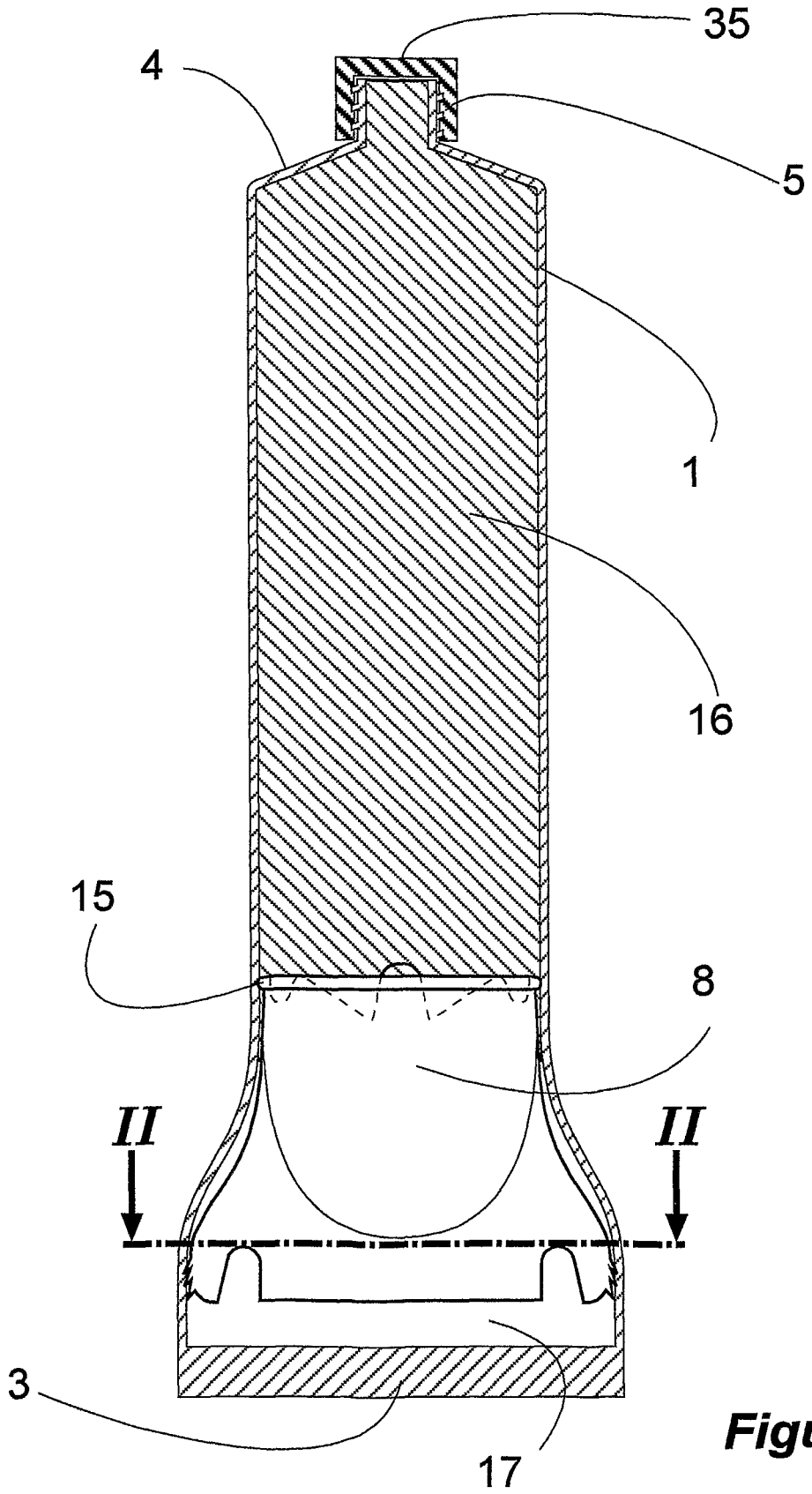

FIG. 48 shows a section through the deformable dispensing tube 1 from a front view with the device 8 in place at the sealed end 3, the orifice 5 sealed and the contents 16 within the deformable dispensing tube 1.

Figure 49:
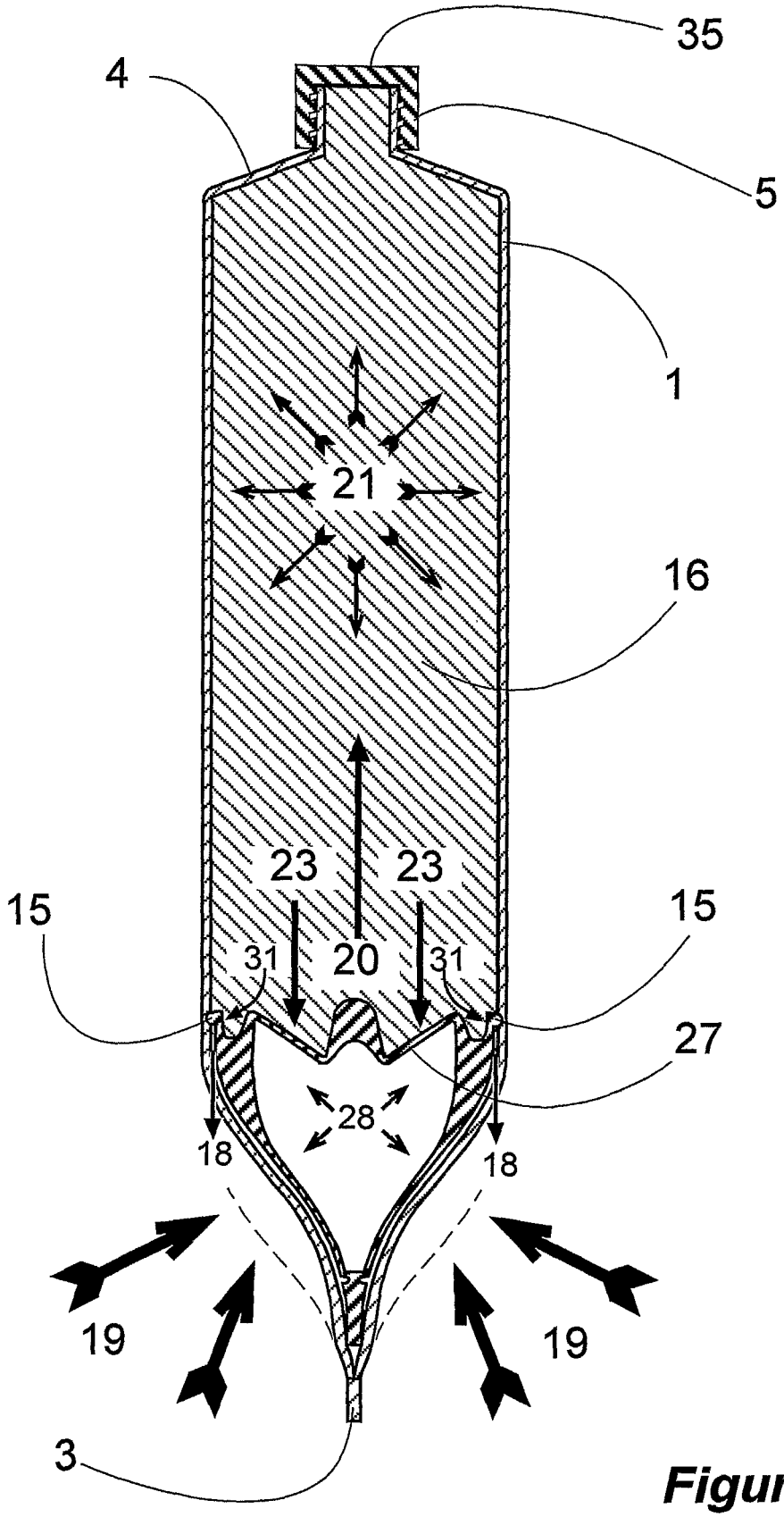

FIG. 49 shows a section through the deformable dispensing tube 1 from a side view of the deformable dispensing tube 1 with the device 8 in place at the sealed end 3 with external forces 19 acting and the orifice 5 sealed.

Figure 50:
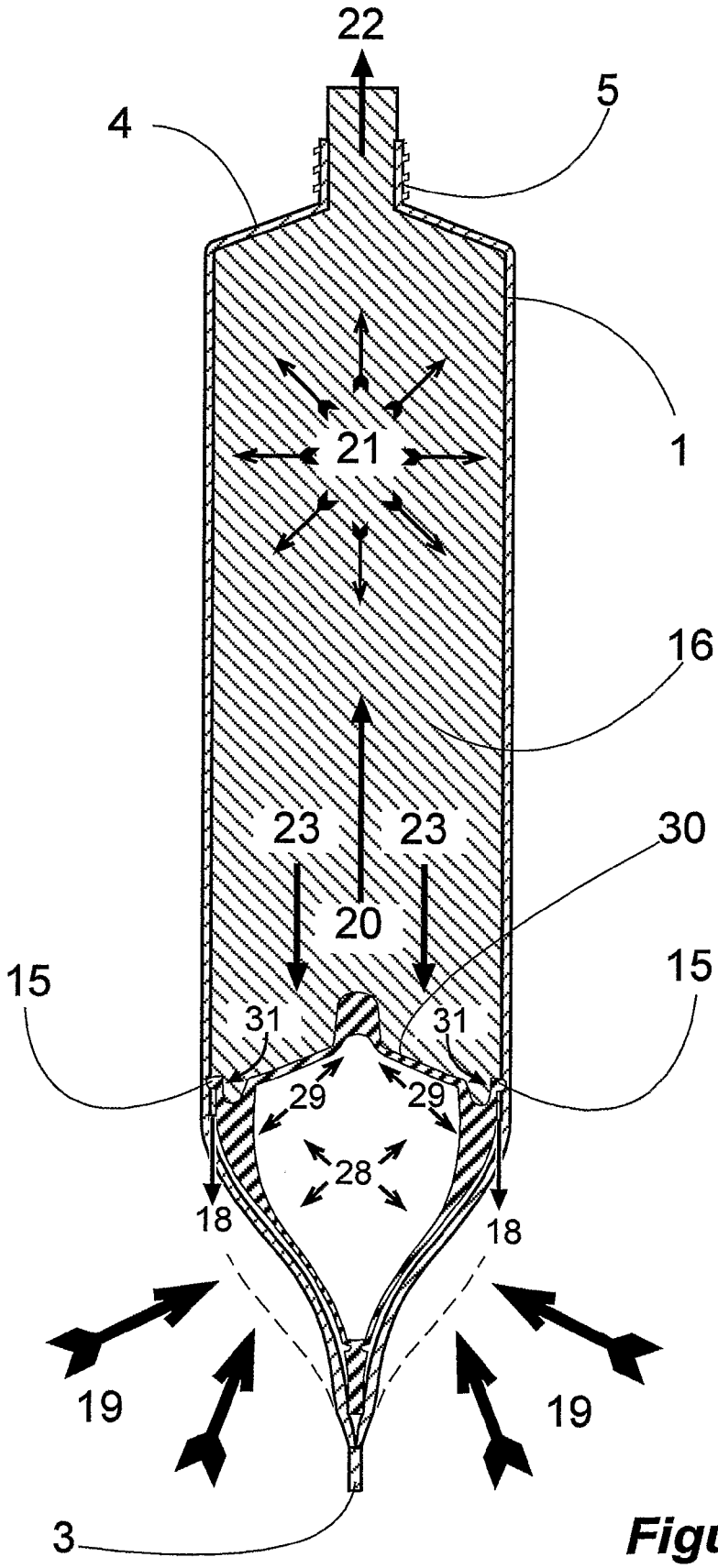

FIG. 50 shows a section through the deformable dispensing tube 1 from a side view of the deformable dispensing tube 1 with the device 8 in place at the sealed end 3 with external forces 19 acting and the orifice 5 un-sealed.

Figure 51:
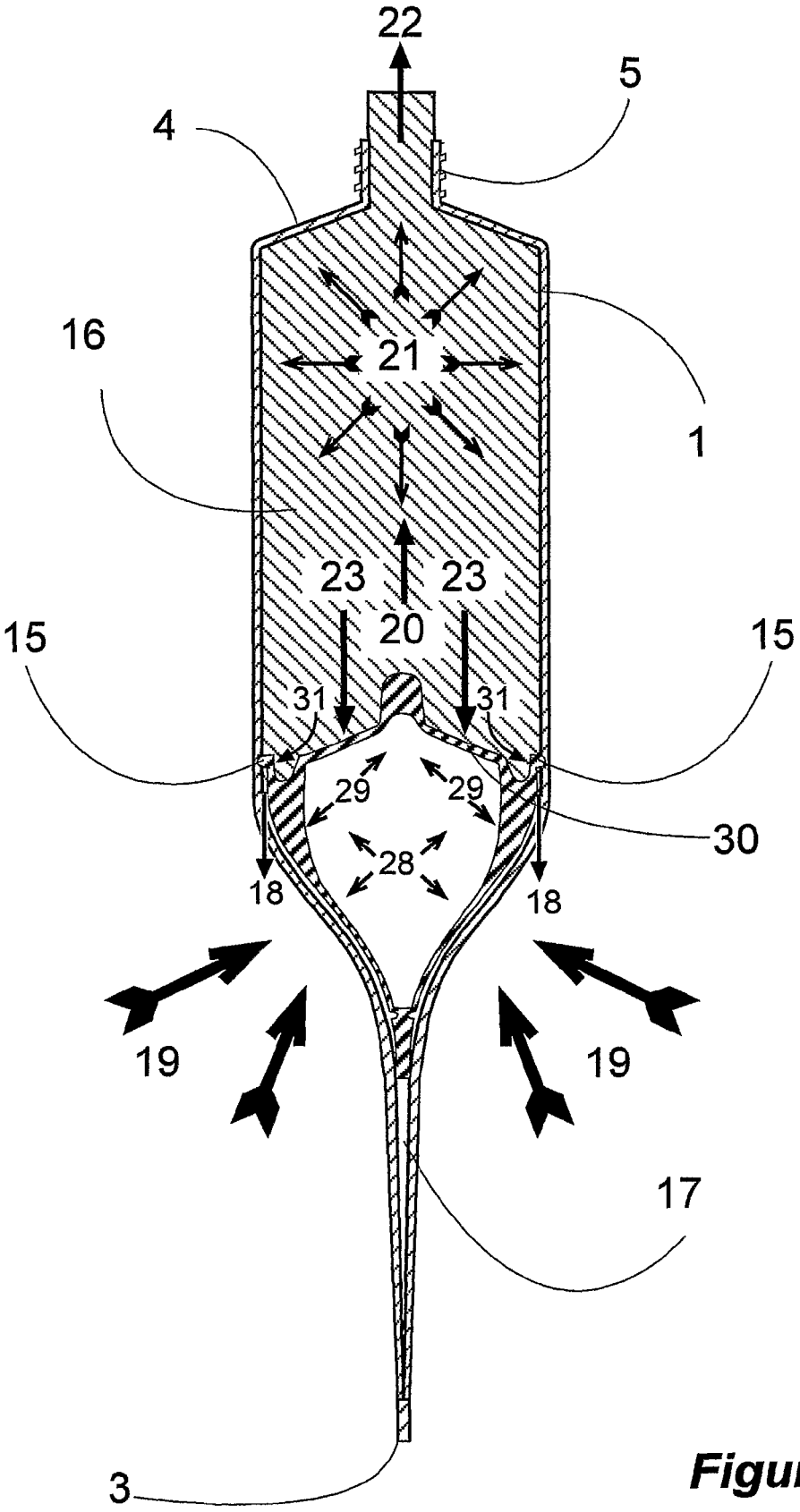

FIG. 51 shows a section through the deformable dispensing tube 1 from a side view of the deformable dispensing tube 1 with the device 8 in place at a point approximately halfway between the sealed end 3 and the formed opening 4, with external pressure 19 acting and the orifice 5 un-sealed.

Figure 52:
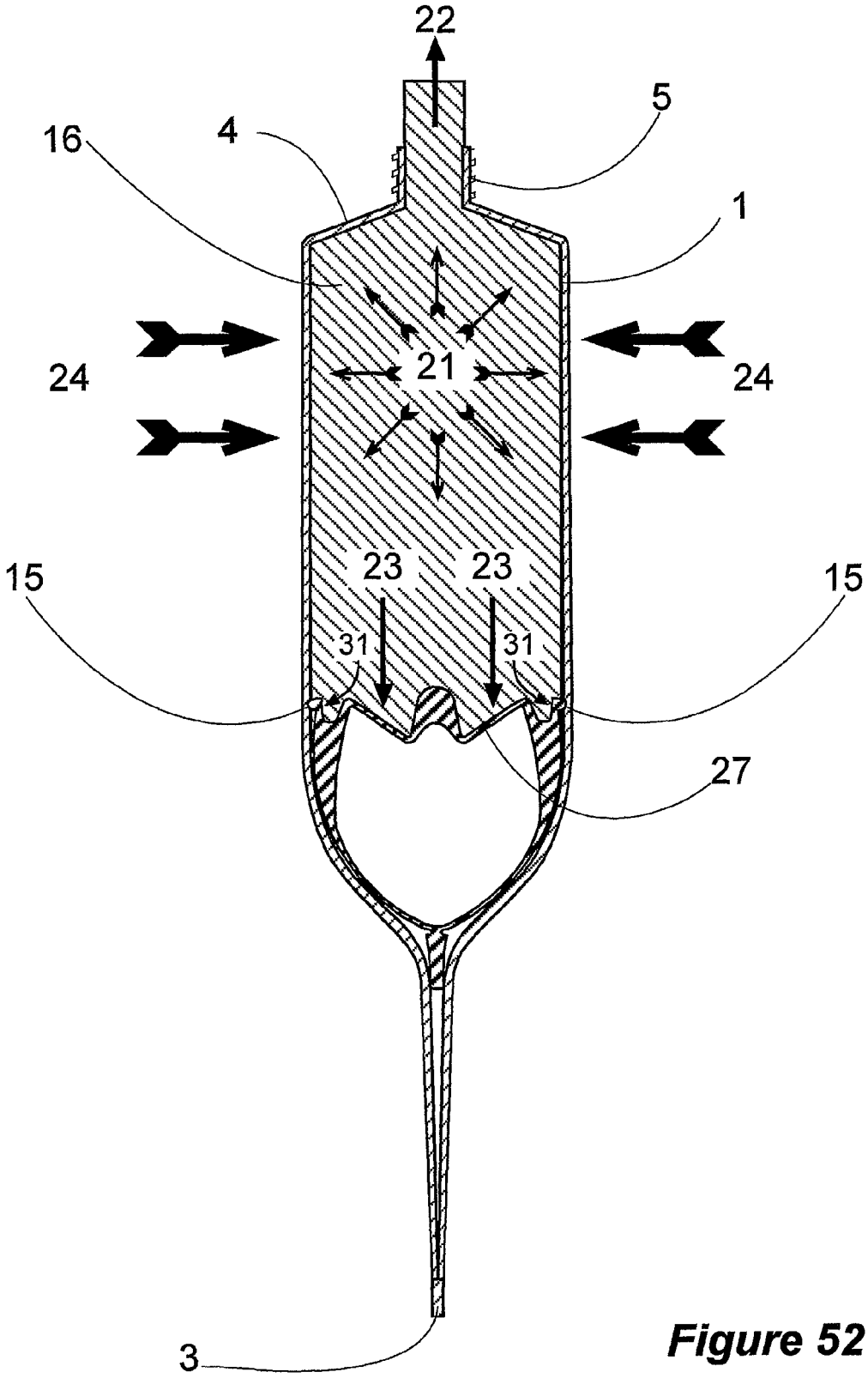

FIG. 52 shows a section through the deformable dispensing tube 1 from a side view of the deformable dispensing tube 1 with the device 8 in place at a point approximately halfway between the sealed end 3 and the formed opening 4 with pressure 24 acting and the orifice 5 un-sealed.

Figure 53:
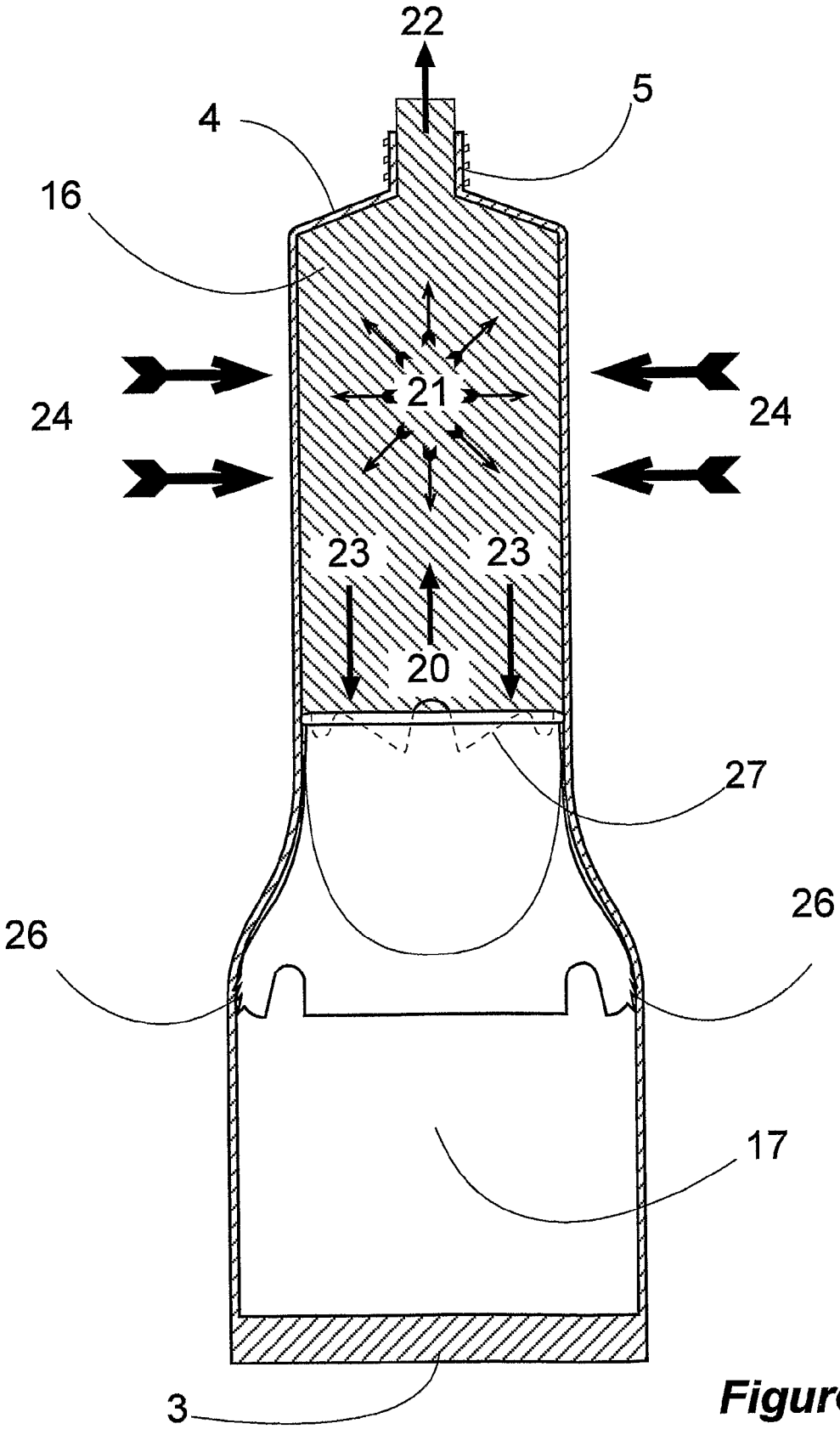

FIG. 53 shows a section through the deformable dispensing tube 1 from a front view of the deformable dispensing tube 1 with the device 8 in place at a point approximately halfway between the sealed end 3 and the formed opening 4 with pressure 24 acting and the orifice 5 un-sealed.

Figure 54:
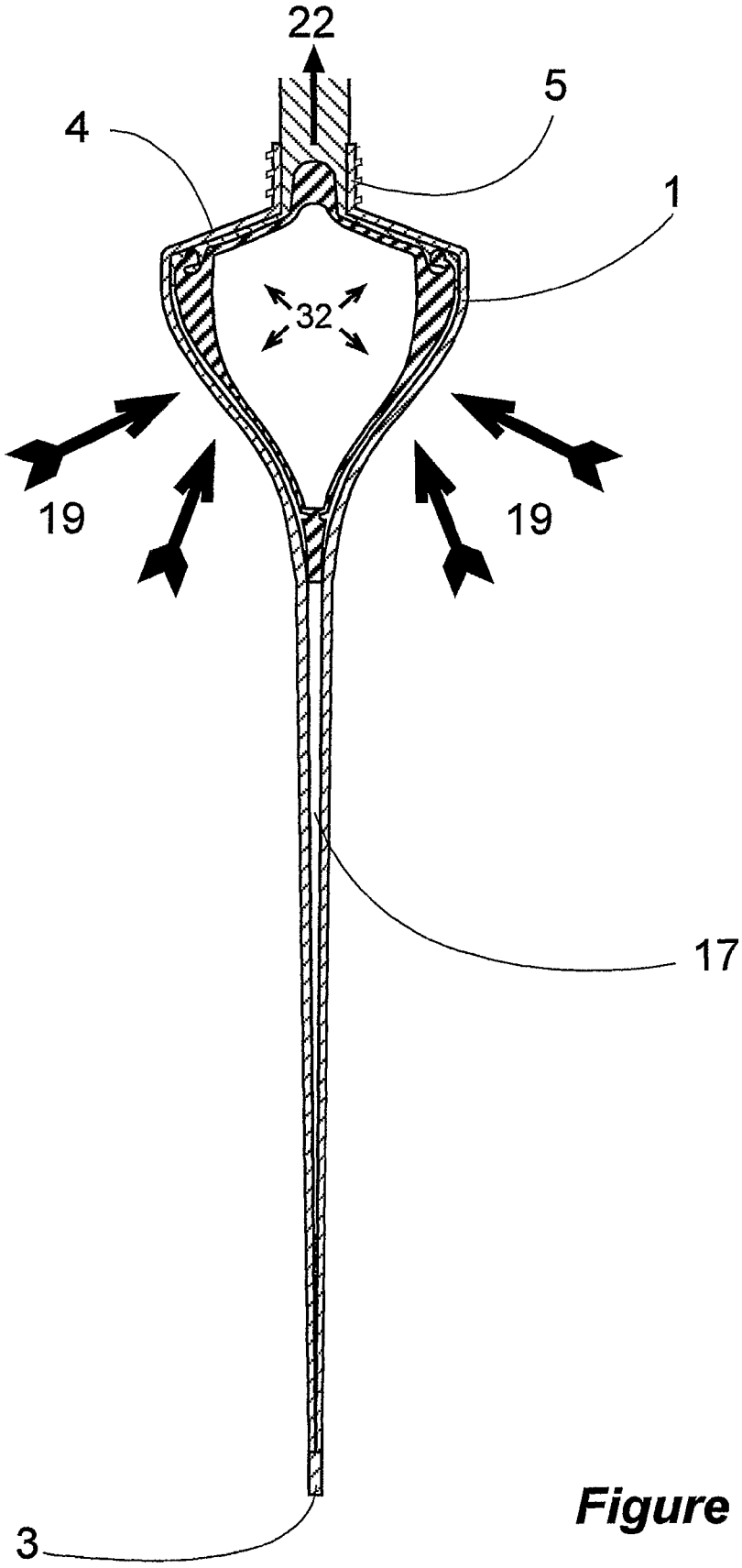

FIG. 54 shows a section through the deformable dispensing tube 1 from a side view of the deformable dispensing tube 1 with the device 8 (also sectioned) in place at the formed opening 4 and the orifice 5 un-sealed.

Figure 55:
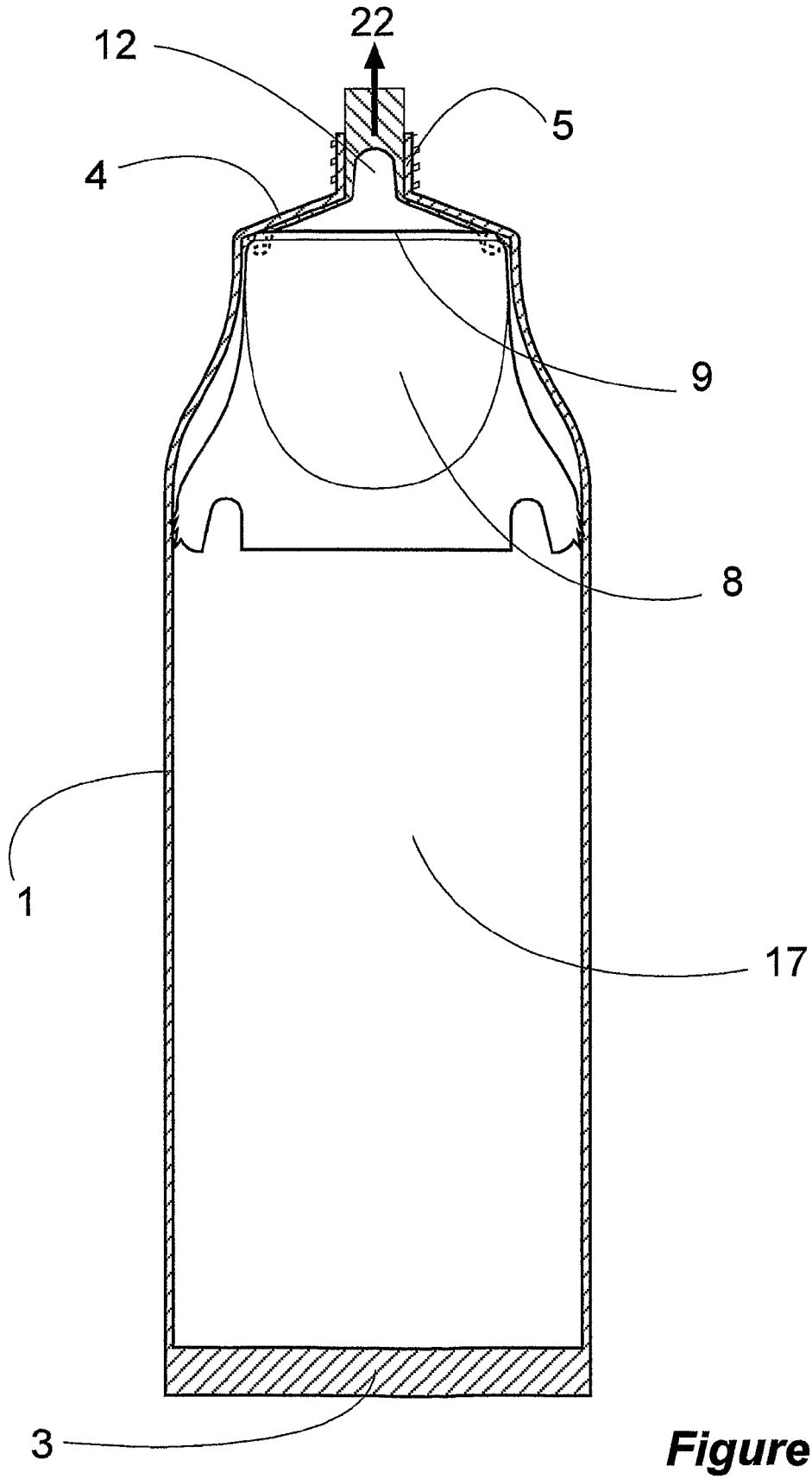

FIG. 55 shows a section through the deformable dispensing tube 1 from a front view of the deformable dispensing tube 1 with the device 8 in place at the formed opening 4 and the orifice 5 un-sealed.

Figure 56:
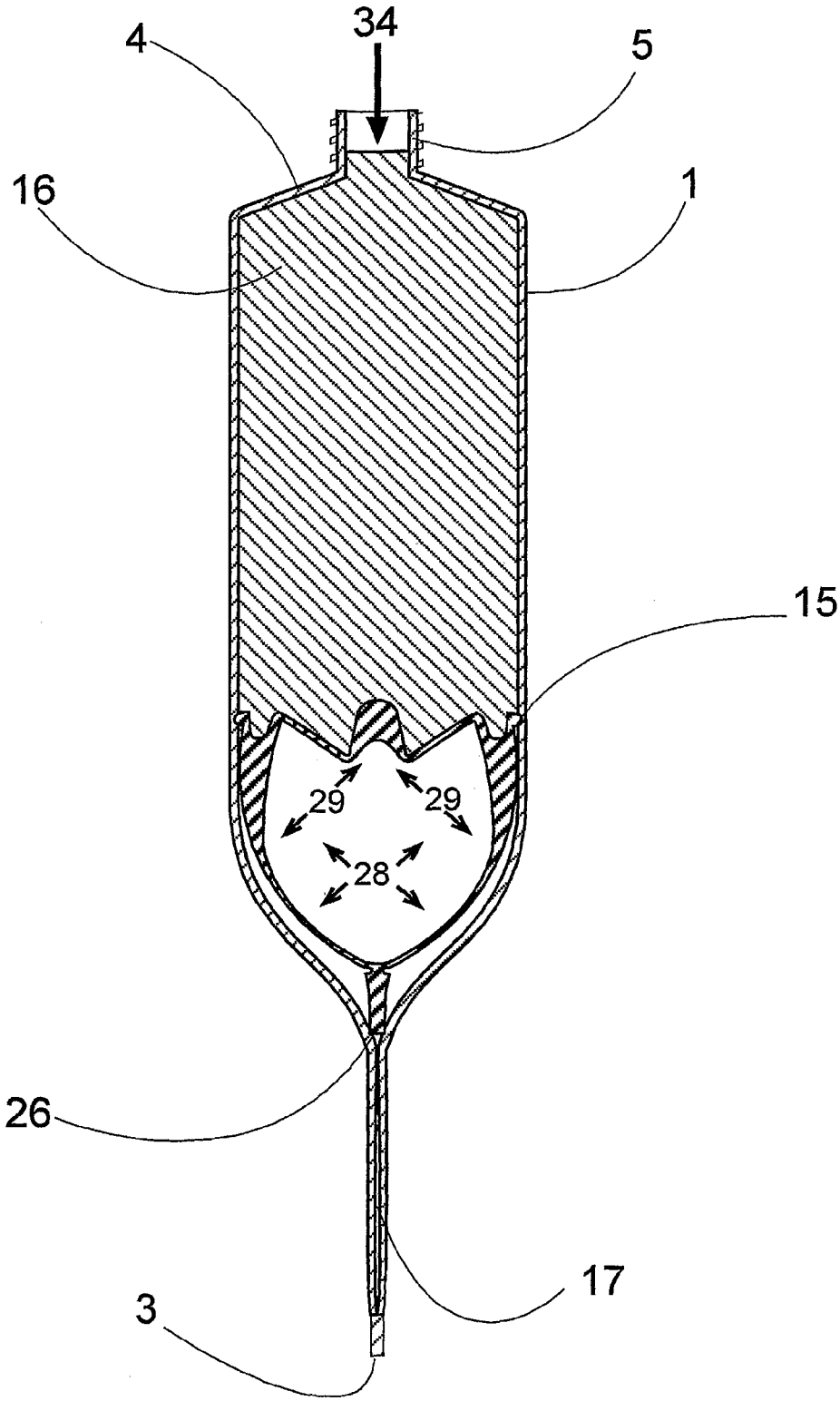

FIG. 56 shows a section through the deformable dispensing tube 1 from a side view of the deformable dispensing tube 1 with the device 8 in place at a point approximately halfway between the sealed end 3 and the formed opening 4 with content retraction 34 acting.

Embodiment C of the invention is a device, hereinafter referred to as the device 8, provided as a separate insert to existing deformable dispensing tubes. A description of a typical deformable dispensing tube is given in reference to the inclusion and working of the device 8. Such a deformable dispensing tube will hereinafter referred to as the deformable dispensing tube 1.

The deformable dispensing tube 1 has a deformable body 2, which is hollow. At one end of the deformable body 2 is a sealed end 3 and at the opposing end of the deformable body 2 is a formed opening 4, which is hollow. Although shown separated in FIG. 2 for clarity the deformable body 2, the sealed end 3 and the formed opening 4 form the deformable dispensing tube 1 as a homogenous whole when the deformable dispensing tube 1 is in its finished manufactured state.

The formed opening 4 has at one end a formed orifice 5 for the opening and re-sealing the formed opening 4, thereby allowing the dispensing of the contents 16 of the deformable dispensing tube 1.

The formed opening 4 transforms in shape and size from the formed orifice 5 into a larger shape where it meets the deformable body 2. The meeting point of the formed opening 4 and the deformable body 2 is herein after referred to as cross-section 6 and is shown hatched on FIG. 2 and is referenced by the line I-I on FIG. 3 and by the line I-I on FIG. 4.

The formed opening 4 varies in rigidity and is substantially more rigid than the deformable body 2, thereby forcing the deformable body 2 to adopt the same shape and size at cross-section 6.

The sealed end 3 is formed by flattening and then permanently sealing or fusing together the material of the deformable dispensing tube 1 at that point such that an internal volume or space can no longer exist within the deformable dispensing tube 1.

By sealing the deformable dispensing tube 1 at the sealed end 3 the deformable body 2 is forced to adopt a certain cross-section as it nears the sealed end 3. The hollow cross section formed by the deformable body 2 in the area just before it becomes part of the sealed end 3 is hereinafter referred to as cross-section 7 and is shown hatched on FIG. 2 and is referenced by the line II-II on FIG. 3 and by the line II-II on FIG. 4.

The volume between cross-section 7 and the sealed end 3 is hereinafter referred to as the void 17.

The deformable body 2 therefore transforms in shape from the cross-section 6 to the cross-section 7 along the length of the deformable body 2 thereby giving the deformable body 2 an internal volume.

The device 8 is a formed three-dimensional moulded part that may or may not be hollow. For the accompanying illustrations the centre of the device 8 is shown as hollow. In this form the centre of the device may contain another material or fluid. For this specific embodiment the device would contain a gas. It is envisaged that the device 8 is moulded from a material or in such material densities or in such varying section thickness or any combination of the three that the device 8 can display varying degrees of flexibility as required at the varying parts of the device 8.

The device 8 comprises the device top 9, the device tail 10, and the device body 11. Although shown separately for clarity in FIG. 40 the device top 9, the device tail 10 and the device body 11 form the device 8 as a homogenous whole. The device top 9 is shown on its own in FIG. 41 to more clearly identify its constituent parts.

The device tail 10 has at its widest point the cross-section 14 shown hatched on FIG. 40 and is referenced by the line IV-IV on FIG. 42 and the line IV-IV on FIG. 43 and by the line IV-IV on FIG. 44. The device tail 10 also has two non-return features at 26. The non-return features 26 may be integrally moulded to the device 8 or may be formed as separate parts from alternative materials.

The device top 9 consists of the device plug 12 that transforms into the larger cross-section 13 where the device top 9 meets the device body 11. The cross-section 13 is shown hatched on FIG. 40 and is referenced by the line III-III on FIG. 42 and by the line III-III on FIG. 43 and by the line III-III on FIG. 44.

The flexible seal feature 15 is located at or near the cross-section 13 as is most clearly shown in FIGS. 42, 43 and 44. The flexible seal feature 15 will be of similar shape to cross-section 13 but of slightly larger size or diameter than the cross-section 13.

Between the device plug 12 and the flexible seal 15 is the deformable centre 27 as is most clearly shown on FIGS. 41 and 43.

The device body 11 transforms smoothly in shape from the cross-section 13 to the cross-section 14.

The device tail 10 is formed from the cross-section 14 tapering or rounding into an end in the direction directly away from the device top 9, as shown in FIGS. 39, 40 and 44. The shape and size of the device tail 10 is such that it will fit into the void 17 when the device 8 is in place within the deformable dispensing tube 1 at the sealed end 3, see FIG. 45 and FIG. 47.

The cross-section 14 at the device tail 10 matches in shape and size the internal shape and internal size of cross-section 7 of the deformable dispensing tube 1.

When the device 8 is in place within the deformable dispensing tube 1, the cross-section 14 at the device tail 10 forces the deformable body 2 to adopt an internal cross-section the same shape and size as the cross-section 14 at any point along the deformable body 2's length at which the device tail 10 and the deformable body 2 are in contact.

The cross-section 13 at the device top 9 matches in shape and size the internal shape and internal size of the cross-section 6 of the deformable dispensing tube 1.

When the device 8 is in place within the deformable dispensing tube 1, the cross-section 13 at the device top 9 forces the internal cross-section of the deformable body 2 to adopt to the same shape and size as the cross-section 13 at any point along the deformable body 2's length at which the device top 9 and the deformable body 2 are in contact.

FIG. 45 and FIG. 47 shows the device 8 situated inside of the deformable dispensing tube 1 at the sealed end 3. The shape of the deformable dispensing tube 1 can be seen to have adapted to the cross section 13 and the cross section 14 of the device 8. The internal volume 25 is created inside the deformable dispensing tube 1 between the device top 9 and the formed opening 4. The void 17 will be partly occupied with the device tail 10.

The contents 16 are contained within internal volume 25 and partly within the formed opening 4 as shown in FIG. 46 and FIG. 48. The cap 35 is shown as a method of sealing the orifice 5.

The fit between the internal surface of the deformable body 2 and the cross-section 13 of the device 8 is such that a seal is formed between the internal surface of the deformable body 2 and the device 8 thereby preventing any transgression by the contents 16 even when under pressure.

When not under any pressure or force, the flexible seal feature 15 will be of similar shape to cross-section 13 but of slightly larger size than the cross-section 13. It follows that the cross-section of the flexible seal feature 15 is also slightly larger than the internal cross-section of the deformable body 2 formed by the presence of the device 8 within the deformable body 2.

When the device 8 is in place within the deformable dispensing tube 1, the flexible seal feature 15 is compressed to fit within the internal cross-section of the deformable body 2.

The flexible seal feature 15 having been compressed to fit within the deformable dispensing tube 1 is under pressure against the internal surface of the deformable body 2 thereby providing enhanced or further sealing against any transgression by the contents 16 while still allowing the device 8 to move freely within the dispensing tube 1.

When not under any pressure or force, the non-return features 26 are flexible parts that have external dimensions greater than those of the cross-section 14 and the corresponding cross-section 7 into which they must fit.

When the device 8 is in place within the deformable dispensing tube 1 the non-return features 26 flex or are compressed to fit within the cross-section 7 in such a manner that if the device 8 is moved in the direction of the formed opening 4 the non-returns features flex or compress further thereby still allowing the device 8 to move freely within the dispensing tube 1. However, when the device 8 is in place within the deformable dispensing tube 1, the non-return features 26 flex or are compressed to fit within the cross-section 7 in such a manner that if the device 8 begins to move in the direction of the sealed end 3 the non-return features 26 are forced or expand against or into the internal surface of the deformable dispensing tube 1 thereby locking the device 8 at that point and preventing the device 8 from moving any further in the direction of the sealed end 3.

With reference to FIGS. 54 and 55, the outer shape of the device top 9 will be of such a shape and size or can deform to such a shape and size that it can move inside of the formed opening 4 of the deformable dispensing tube 1 in such a manner that it expels as much of the contents 16 as is feasible.

The device plug 12 of the device top 9 will be of such a shape and size or can deform to such a shape and size that it can move inside of the formed orifice 5 while still allowing the contents 16 to be expelled as shown in FIG. 54 and FIG. 55.

With reference to FIG. 49 the user applies external pressure as indicated by the arrows at 19 directly or indirectly to the outside of the deformable dispensing tube 1. A result of the external pressure 19 acting on the device 8 through the deformable dispensing tube 1 will be to create a resultant force 20 within the device 8 in the direction of the formed opening 4. The resultant force 20 in turn acts through the device 8 onto the contents 16 thereby creating an internal pressure 21 within contents 16 contained within the deformable dispensing tube 1.

The internal pressure 21 will create an opposing force 23 on the device 8. An internal friction force 18 occurs between the device 8 and the internal surfaces of the deformable dispensing tube 1. The opposing force 23 combines with the internal friction force 18 to resist the resultant force 20.

In order to transfer the external pressure 19 into the resultant force 20 that acts on the contents 16 the device 8 and the gas or material within its centre will become subject to internal forces or internal pressure represented by the arrows 28 and is hereinafter referred to as the "device pressure 28".

Consistent with the overall illustrations and description of device 8 and considering the disclosed manner of use within deformable dispensing tube 1, it is noted that the hollow interior (i.e. the centre) of device 8 is sealed closed (i.e. enclosed) so as to capture and retain therein the gas or material.

Dependent on the material nature of the device 8 and the gas or material within its centre a further result of the external pressure 19 combined with the opposing force 23 will be to compress or distort the device 8 as shown in FIG. 49. This compression or distortion is illustrated by the differing outlines of the non-compressed device 8 in FIG. 46 and the compressed device 8 in FIG. 49. This compression or distortion is also illustrated by the differing outlines between the dashed lines of the non-compressed deformable dispensing tube 1 indicated at the arrows 19 and the now compressed or distorted outlines of both the deformable dispensing tube 1 and the device 8, as also shown in FIG. 49. The device 8 is so designed that when the device 8 is in the afore-mentioned compressed or distorted state the resultant outer three-dimensional form the device 8 adopts is such that the external pressure 19 continues to produce the resultant force 20.

The effects of the sealing between the device 8 and the internal surface of the deformable body 2 ensure the contents 16 remain within the internal volume 25 that is on the formed opening 4's side of the device top 9. The device pressure 28 will further increase or enhance the sealing between the device 8 and the internal surface of the deformable body 2.

The internal pressure 21 will also bear on the internal seal surfaces 31 thereby increasing the effectiveness of the flexible seal 15 in proportion to any increase in the internal pressure 21 of the contents 16 against which the flexible seal 15 acts.

With reference to FIG. 50, when the formed orifice 5 is un-sealed the internal pressure 21 will cause the contents 16 to begin to be expelled through the formed orifice 5, as arrowed 22.

Initially as the contents 16 are expelled from the deformable dispensing tube 1 the volume required to contain the remaining contents 16 will be reduced which in turn will create a corresponding reduction in the internal pressure 21. In this instance, the resultant force 20 will not be in balance with the opposing force 23 and so the resultant force 20 will cause the deformable centre 27 to distort in the direction of the resultant force 20. The distortion of the deformable centre 27 in the direction of the resultant force 20 and towards the formed opening 4 will hereinafter be referred to as the "distorted centre 30" as indicated in FIG. 50.

The distortion of the deformable centre 27 into the distorted centre 30 will result in additional forces being created or stored in the material of the device 8 and these additional forces will hereinafter be referred to as the "stored force 29" and are represented by the arrows at 29 in FIG. 50.

The distorted centre 30 will continue to distort until the stored force 29 combined with the opposing force 23 balances with the resultant force 20 and the internal forces are in equilibrium. By distorting in this way the distorted centre 30 will balance the reduction in the volume of the remainder of the contents 16 within the internal volume 25 and thereby maintain the internal pressure 21 at a level at which the contents 16 continue to flow.

When the distorted centre 30 reaches its maximum designed state of distortion and at which point if the resultant force 20 is great enough to overcome the internal frictional force 27 the device 8 as a whole will begin to move forward within the deformable dispensing tube 1 in the direction of the resultant force 20, that is towards the formed opening 4.

By moving towards the formed opening 4 in this manner the device 8 will reduce the size of the internal volume 25 in line with the reduction in the volume of the remainder of the contents 16 and thereby maintain the internal pressure 21 at a level where the contents 16 will continue to be expelled through the formed orifice 5. As the device 8 moves towards the formed opening 4 the void 17 will increase in length leaving the deformable body 2 empty and in a flat or near flat state around the void 17, as shown in FIG. 51.

With reference to FIGS. 54 and 55, as the device 8 nears the formed opening 4 the shape and size of the device top 9 corresponding to or distorting to the internal shape and internal size of the formed opening 4 allows the device top 9 to move inside the formed opening 4 in such a manner that as much of the contents 16 are expelled as is feasibly possible. In this instance, the device plug 12 is of such a shape and size that the contents 16 are still able to flow through the formed orifice 5 even when the device plug 12 has moved inside of the formed orifice 5.

The user is able to vary the external pressure 19 in such a manner that the user can then control the rate at which the contents 16 are expelled.

When the user removes the external pressure 19 the consequent forces that have been set up within the deformable dispensing tube 1 and the device 8 are removed in the reverse order to which they were set up.

Therefore, firstly the device 8 as a whole unit will stop moving and consequently the contents 16 will cease to flow. Secondly, the stored force 29 will retract the distorted centre 30 to its original state. At this point one of two alternative actions (or ideally a combination of both) can occur by design.

Either the device 8 as a whole unit can move in the direction of the formed opening 4 to fill the space occupied by the distorted centre 30. Or alternatively the contents 16 can be drawn or retracted back into the deformable dispensable tube 1 to fill the space occupied by the distorted centre 30. This movement of the contents 16 back into the deformable dispensing tube is hereinafter referred to as "content retraction 34" as is shown by the arrow 34 in FIG. 56.

With reference to FIG. 52 and FIG. 53, the internal pressure 21 can also be created by an external force at 24 on the deformable body 2 between the formed opening 4 and the location of the device 8.

When an external force at 24 generates the internal pressure 21, the consequent opposing force 23 can act to move the device 8 as a whole unit in the direction of the opposing force 23 that is towards the sealed end 3. The non-return features 26 will prevent the device 8 moving in the direction of the sealed end 3. Consequently the opposing force 23 will act on the deformable centre 27 to make it distort in the direction of the opposing force 23. However, the design of the deformable centre 27 combined with the constraint of the deformable dispensing tube 1 on the device 8 will be such that the force required to move the deformable centre 27 in the direction of the opposing force 23 is greater than the force required to expel the contents 16 through the orifice 5. Therefore if the formed orifice 5 is un-sealed the internal pressure 20 generated by an external force at 24 will result in the contents 16 being expelled through the formed orifice 5, as arrowed at 22.

As the device 8 is prevented from moving back towards the sealed end 3 by the non-return features 26 the contents 16 will always remain in the area of the formed opening 4 ready for further use.

The invention claimed is:

1. A deformable dispensing tube having a first end portion which is closed and a second end portion with an opening through which, when the tube has been filled, contents can be dispensed by deformation of the tube, the tube comprising:

a dispensing device moveable inside the tube and positioned so that on filling contents are disposed generally between the dispensing device and the opening so that upon application of an external pressure to the tube by a user contents can be dispensed through the opening;

wherein the dispensing device comprises an enclosed hollow skin filled with a fluid, a top portion arranged to be in contact with the tube contents for transferring pressure between the tube contents and the fluid, and a sealing portion for applying a sealing force between the device and the tube for resisting the transgression of contents between the sealing portion and the tube;

wherein the outer hollow skin has a thickness and material which is sufficiently flexible so that:

(a) application of external pressure to the tube at the dispensing device generates an increase in the pressure of fluid in the skin causing the top portion to deform towards the tube opening thereby increasing the pressure of contents in the tube for dispensing the contents and causing an increased sealing force to be applied between the sealing portion and the tube; and (b) application of external pressure to the tube away from the dispensing device dispenses contents and generates an increase in pressure of contents in the tube causing the device top to deform towards the closed end of the tube thereby increasing the pressure on the fluid in the skin and causing an increased sealing force to be applied between the sealing portion and the tube.

2. A tube as claimed in claim 1, wherein the device is resilient and on release of such external pressure the device returns to an un-deformed condition.

3. A tube as claimed in claim 2, wherein when the top portion resiliently returns to an un-deformed condition the internal pressure of the contents in the tube is reduced causing any contents disposed at the opening to be retracted into the tube.

4. A tube as claimed in claim 1, wherein said device is received for sliding movement in the tube so that when the top portion has been deformed towards the opening application of said external pressure at the device causes sliding movement of said device towards the opening for dispensing contents.

5. A tube as claimed in claim 4, wherein the dispensing device comprises non-return means for allowing movement of said device towards said opening and resisting movement of said device towards said closed end portion of the tube.

6. A tube as claimed in claim 5, wherein said non-return means comprises protrusions which are adapted to press against an internal surface of the tube thereby resisting movement of said device towards said closed end portion of the tube.

7. A tube as claimed in claim 1, wherein said top portion is shaped to compliment an internal shape of the tube at the second end portion when the device is moved in use to the second end portion and the top portion is deformed towards the opening.

8. A tube as claimed in claim 7, wherein said top portion can deform into the opening so that contents at the opening can be dispensed.

9. A tube as claimed in claim 1, wherein the dispensing device is shaped at an end thereof towards the first end portion to match an internal cross-section of the tube at the first end portion.

10. A tube as claimed in claim 1, wherein the top portion is connected to a device tail which extends from the top portion towards the first end portion of the tube and the cross-sectional area of the device tail reduces from the device top to an end thereof towards the first end portion of the tube.

11. A dispensing device for the dispensing tube as claimed in claim 1.

12. A deformable dispensing tube for dispensing tube contents through a tube opening, comprising a dispensing device located between a closed tube end and the tube contents, the dispensing device being moveable inside the tube towards a tube opening for dispensing substantially all of the tube contents, the dispensing device comprising an outer hollow skin inflated by a fluid and comprising a deformable portion in contact with the contents in the tube for transmitting pressure between the contents of the tube and the fluid in said skin and a flexible sealing portion responsive to the pressure of fluid in the skin for sealing between the device and the tube, wherein on application of external pressure to the tube, the pressure on the contents of the tube and fluid in the skin is increased so that the contents can be dispensed and the sealing portion applies an increased sealing pressure on an internal surface of the tube.

13. A dispensing device for the dispensing tube as claimed in claim 12.

* * * * *